US007070350B2

(12) United States Patent
Inokuchi et al.

(10) Patent No.: US 7,070,350 B2
(45) Date of Patent: Jul. 4, 2006

(54) IMAGE RECORDING DEVICE

(75) Inventors: Hidehiko Inokuchi, Fukuoka (JP); Masaharu Tanaka, Fukuoka (JP); Hiroyuki Ogata, Fukuoka (JP); Kenji Kanabo, Fukuoka (JP); Yutaka Miyazono, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/843,553

(22) Filed: May 12, 2004

(65) Prior Publication Data

US 2005/0162494 A1 Jul. 28, 2005

(30) Foreign Application Priority Data

May 15, 2003 (JP) ..... 2003-136978
May 15, 2003 (JP) ..... 2003-136979
May 22, 2003 (JP) ..... 2003-145451
May 22, 2003 (JP) ..... 2003-145459

(51) Int. Cl.
*B41J 11/56* (2006.01)
*B41J 29/38* (2006.01)

(52) U.S. Cl. ..... 400/680; 400/54; 400/647; 400/691; 347/104; 271/171; 271/213

(58) Field of Classification Search ..... None
See application file for complete search history.

(56) References Cited

U.S. PATENT DOCUMENTS 4,698,650 A 10/1987 Watanabe et al. ..... 346/134
4,847,632 A 7/1989 Norris ..... 346/107
5,152,622 A 10/1992 Rasmussen et al. ..... 400/579
5,372,512 A 12/1994 Wilson et al. ..... 439/67
5,746,528 A * 5/1998 Mayer et al. ..... 400/625
5,975,520 A * 11/1999 Shim ..... 271/171
6,106,178 A * 8/2000 Chiu ..... 400/624
6,113,093 A * 9/2000 Morinaga et al. ..... 271/162
6,132,122 A 10/2000 Robinson et al.
6,474,884 B1 * 11/2002 Chiu ..... 400/624

FOREIGN PATENT DOCUMENTS

JP 4-79305 12/1992
JP 2002-241026 8/2002

OTHER PUBLICATIONS

English language Abstract of JP 2002-241026.

* cited by examiner

*Primary Examiner*—Andrew H. Hirshfeld
*Assistant Examiner*—Jill E. Culler
(74) *Attorney, Agent, or Firm*—Greenblum & Bernstein, P.L.C.

(57) ABSTRACT

A multi-part output paper tray 14 including a plurality of tray plates 21 to 24 slidably arranged together in a paper eject direction is attached to a printer assembly 1 so that it can be extended/collapsed, the printer assembly 1 including a print head attached thereto for forming an image on recording paper 50. The extended/collapsed state of the output paper tray 14 is detected by an angle sensor 313. A print operation is not performed when it is detected by the angle sensor 313 that the output paper tray 14 is in the housed state, and a print operation is performed when the output paper tray 14 is in the extended state.

10 Claims, 82 Drawing Sheets

IMAGE RECORDING DEVICE

BACKGROUND OF THE INVENTION

1. Field of the Invention

The present invention relates to an image recording device.

2. Description of the Background Art

An inkjet printer for forming an image on recording paper includes an input paper accommodating section for accommodating a stack of recording paper, an image forming section for forming an image on recording paper fed from the input paper accommodating section, and an output paper tray for accommodating printed recording paper on which an image has been recorded.

A plurality of types of recording paper used with a printer have different sizes such as A4 size, B5 size, and postcard size. Therefore, the output paper tray for accommodating the printed recording paper needs to change its length according to the size of the recording paper. Moreover, the output paper tray protrudes from the front side or the rear side of the printer assembly when it receives recording paper. When the printer is not being used, the output paper tray protruding from the printer assembly can be an obstacle.

Conventionally, one or more tray plates are movably attached to the printer assembly. A multi-part output paper tray, including a plurality of tray plates slidable on one another, can be extended by unfolding the tray plates in a stepwise manner in the outward direction, and can be housed into the printer assembly by moving them in the opposite direction. Thus, the multi-part output paper tray can increase/decrease its total length according to the size of the recording paper, and can be housed in the printer assembly when the printer is not in use (see, for example, Japanese Laid-Open Patent Publication No. 2002-241026).

However, conventional printers having an extendable/collapsible output paper tray do not have the function of detecting whether the output paper tray is in its extended state or collapsed state. If a print operation is performed with the output paper tray being housed in the printer assembly, the output paper tray becomes an obstacle for the recording paper, thus causing a paper jam. Moreover, if a print operation is performed while the amount of extension of the output paper tray is not sufficient, recording paper may fall off the output paper tray. Furthermore, an obstacle being present in a front portion of the output paper tray in the eject direction may create problems such as recording paper hitting the obstacle to cause a paper jam or recording paper becoming bent. Moreover, a conventional multi-part output paper tray needs to be extended/collapsed manually, and cannot be extended/collapsed automatically.

An input paper cassette, a type of an input paper accommodating section for accommodating recording paper, is conventionally given a resistance so that it cannot easily be removed from the printer assembly. Therefore, when there is no more recording paper in the input paper cassette, the user needs to remove the input paper cassette from the printer assembly by applying a force onto the input paper cassette to overcome the resistance. In order to facilitate the operation of removing the input paper cassette, a technique has been proposed in the art in which a cassette eject button is provided on an operation panel of the printer assembly, whereby the input paper cassette pops out by a predetermined stroke away from the printer assembly through the operation of the button (see Japanese Patent Publication for Opposition No. 4-79305).

However, if the cassette eject button is operated while the image forming section is printing an image on recording paper, the input paper cassette pops out from the printer assembly, whereby the recording paper being printed may get creased or a paper jam may occur.

The printer disclosed in Japanese Patent Publication for Opposition No. 4-79305 is an off-carriage type recording device in which ink cartridges storing ink therein are placed separately from the carriage. In an off-carriage type recording device, a cartridge holder is provided on the front side of the recording device, whereby the space of the opening is reduced by the amount of the space taken up by the cartridge holder. Therefore, when a paper jam occurs, it is difficult to easily and quickly remove jammed recording paper with the cartridge holder being an obstacle.

Moreover, it is expected that inkjet recording devices, which have been widely used as printers for personal computers, for example, will expand their applications to TVs, VCRs, etc. However, many conventional printers require a large installation space, and can be installed only in places where there is a sufficient space above the installation surface, such as on a PC rack. In view of this, slim printers have been proposed in the art.

In jam removal, or the like, it is necessary to put a hand into the casing of the printer. Therefore, the opening provided in the front surface of the casing is preferably large. However, a larger opening requires a larger cover. Therefore, when opening the cover, there needs to be a large space above the casing.

However, it is typical with slim printers that there is not a sufficient space above due to installation place limitations. For example, where a printer is installed on a shelf of an audio rack, a portion of the cover being opened may hit a shelf above if the upper surface of the cover has a large depth. Therefore, it is difficult to increase the size of the cover of a slim printer. Thus, it is difficult to provide a sufficiently large opening in the casing, whereby it is difficult to efficiently perform a jam removal operation, etc.

Moreover, even if there is a sufficient space for opening the cover in the installation place, it would still be difficult to easily and quickly replace an ink cartridge unless the cover can be opened easily.

SUMMARY OF THE INVENTION

It is an object of the present invention to provide an image recording device in which the extended/collapsed state of the output paper tray is detected.

It is another object of the present invention to provide an image recording device in which the output paper tray is extended/collapsed automatically.

It is still another object of the present invention to provide an image recording device in which the input paper cassette is prevented from being removed from the printer assembly during a print operation.

In addition, the present invention aims at providing an inkjet recording device in which the efficiency in jam removal, ink cartridge replacement, etc., is increased.

An image recording device of the present invention includes: a printer assembly including an image forming section for forming an image on recording paper accommodated in an input paper tray; an output paper accommodating section attached to the printer assembly so that the output paper accommodating section can be extended/collapsed between an extended state and a housed state; and output paper accommodating section state detection means for detecting an extended/collapsed state of the output paper accommodating section, wherein the image forming section does not perform a print operation when it is detected by the output paper accommodating section state detection means that the output paper accommodating section is in the housed state.

Thus, a print operation on the recording paper is not performed when the output paper accommodating section is in the housed state, thereby preventing a paper jam.

Another image recording device of the present invention includes: a printer assembly including an image forming section for forming an image on recording paper accommodated in an input paper tray; an output paper accommodating section attached to the printer assembly so that the output paper accommodating section can be extended/collapsed between an extended state and a housed state; and driving means for extending/collapsing the output paper accommodating section from the housed state to the extended state and/or from the extended state to the housed state.

Thus, the output paper accommodating section can be extended/collapsed automatically.

Still another image recording device of the present invention includes: a printer assembly including an image forming section for forming an image on recording paper; an input paper cassette detachably attached to the printer assembly for accommodating the recording paper; a lock lever movably attached to the printer assembly and including a lock section engaged with an engagement section provided on the cassette; a cassette eject button movably attached to the printer assembly and engaged with the lock lever for moving the lock section between a position where the lock section is engaged with the engagement section and another position where the engagement is released; a stopper movable between a lock position where movement of the cassette eject button is restricted and a retracted position where movement of the cassette eject button is allowed; and driving means for moving the stopper to the lock position when forming an image on the recording paper and moving the stopper to the retracted position when not forming an image.

Thus, the operation of the cassette eject button is prohibited while an image is being formed on the recording paper, whereby it is possible to prevent the recording paper from getting creased while forming an image thereon and to prevent a paper jam.

In still another image recording device of the present invention, an additional lock lever engaged with an additional engagement section provided on the cassette is moved to the lock position when forming an image on the recording paper and to the retracted position when not forming an image.

Thus, when forming an image on the recording paper, the additional lock lever is engaged with the additional engagement section, whereby the input paper cassette is prevented from being ejected even if the cassette eject button is operated.

In still another image recording device of the present invention, the connector member is moved to the retracted position so as to disconnect the lock lever and the cassette eject button from each other when forming an image on the recording paper, and the connector member is moved to the connecting position so as to connect the lever and the button to each other when not forming an image.

Thus, while an image is being formed on the recording paper, the operation of the cassette eject button will be of no effect.

An inkjet recording device of the present invention includes: a casing including an opening formed on a front side thereof and including a cover provided for covering the opening so that the cover can be opened/closed; a cartridge holder provided on a front side inside the casing; an ink cartridge which can be attached/detached to/from the cartridge holder through the opening of the casing; and a guide member for supporting the cartridge holder and guiding movement of, or a change of position of, the cartridge holder.

The guide member may be a guide member for guiding movement of the cartridge holder in a front-back direction; and the cartridge holder may be supported by the guide member so that the cartridge holder is movable in a front-back direction between a forward, home position and a rearward, retracted position.

Thus, in a jam removal operation, the space of the opening can be increased by opening the cover and moving the cartridge holder rearward to the retracted position. Therefore, it is possible to perform a jam removal operation without being obstructed by the cartridge holder, thereby increasing the efficiency in the jam removal operation.

Another inkjet recording device of the present invention includes: a casing generally having a rectangular parallelepiped shape whose length in an up-down direction is shorter than those in a left-right direction and a front-back direction, and including an opening extending from a front side to an upper side thereof; a front cover and an upper cover arranged in a vertical direction of the opening with respect to each other for covering the opening so that the covers can be opened/closed; and an image forming section including an inkjet recording head and arranged on a front side inside the casing.

In the recording device, the opening is covered by two covers, i.e., the front cover and the upper cover. Therefore, as the area of the covers is increased, the size of the opening can be increased.

Still another inkjet recording device of the present invention uses a cover that can rotate about a rotation shaft extending in a left-right direction on a lower side of the opening of the casing, whereby the cover covers the opening so that the cover can be opened/closed, the cover being foldable in a vertical direction.

Thus, it is possible to reduce the amount by which the cover protrudes upward when opening/closing the cover.

In still another inkjet recording device of the present invention, the cover includes a first cover with an opening formed therein, and a second cover for covering the opening in the first cover so that the second cover can be opened/closed.

Thus, the inside of the casing is exposed through the main opening of the casing if the first cover is opened, whereas the inside of the casing is exposed through another opening smaller than the opening of the casing if the second cover is opened. Therefore, the first cover can be opened for an operation that requires a large opening area such as a jam removal operation, and only the second cover may be opened for an operation that requires only a small opening area such as replacing an ink cartridge.

Other objects of the present invention will be more apparent to those skilled in the pertinent art from the following detailed description taken in conjunction with the accompanying drawings.

BRIEF DESCRIPTION OF THE DRAWINGS

FIG. 98 is an enlarged partial cross-sectional view illustrating a top cover according to a variation.

FIG. 99 is a perspective view illustrating a portion of a printer according to a variation of Embodiment 14.

FIG. 100 is a side view illustrating a cover according to a variation of Embodiment 14 with the cover being closed.

FIG. 101 is a side view illustrating the cover with the cover being open.

DESCRIPTION OF THE PREFERRED EMBODIMENTS

Figure 1:
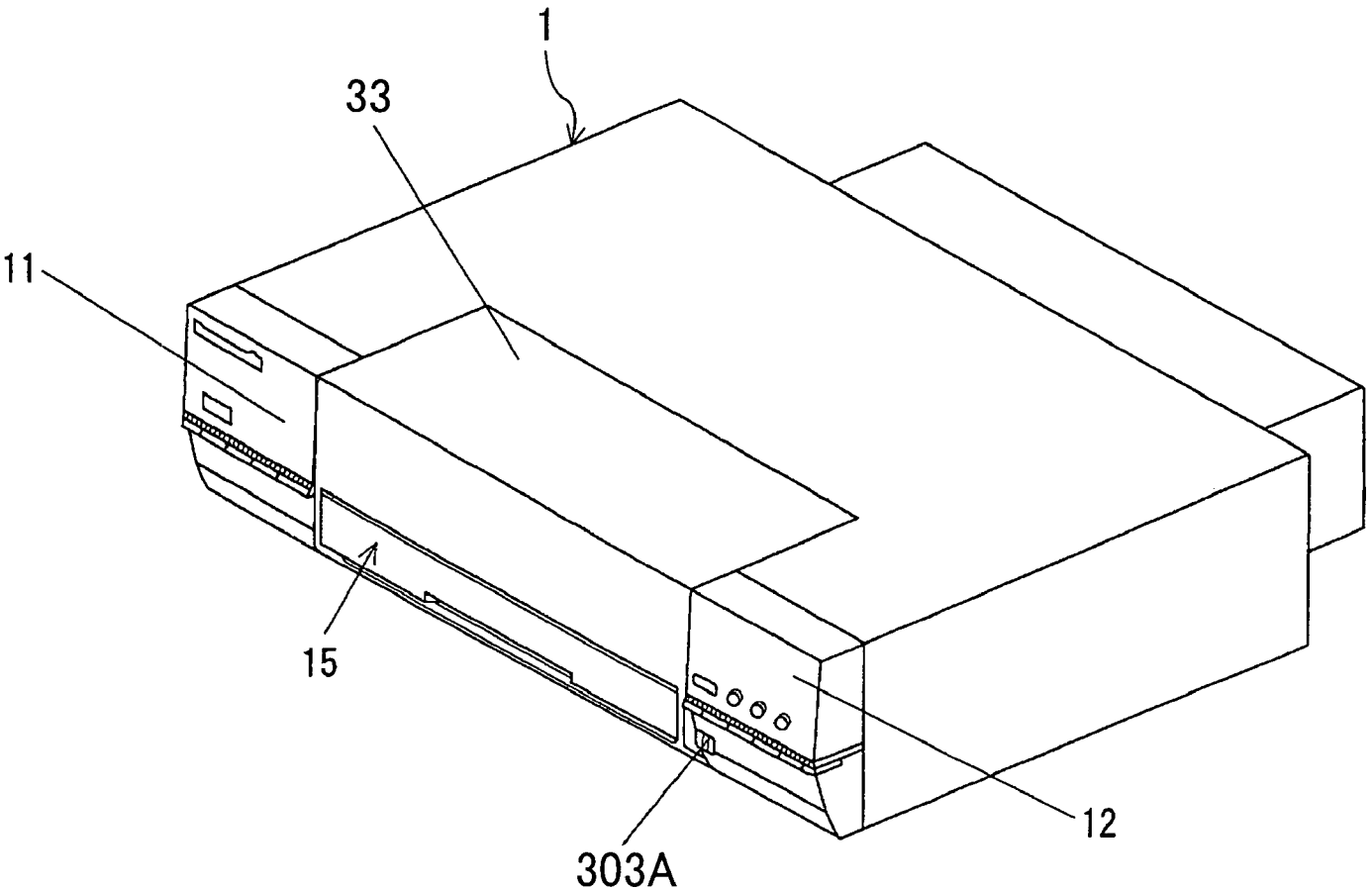
FIG. 1 is a perspective view illustrating an image recording device of Embodiment 1.

Embodiments of the present invention will now be described with reference to the drawings. Note that like reference numerals denote like members throughout the figures, and those members will not be described redundantly.

Embodiment 1

Figure 2:
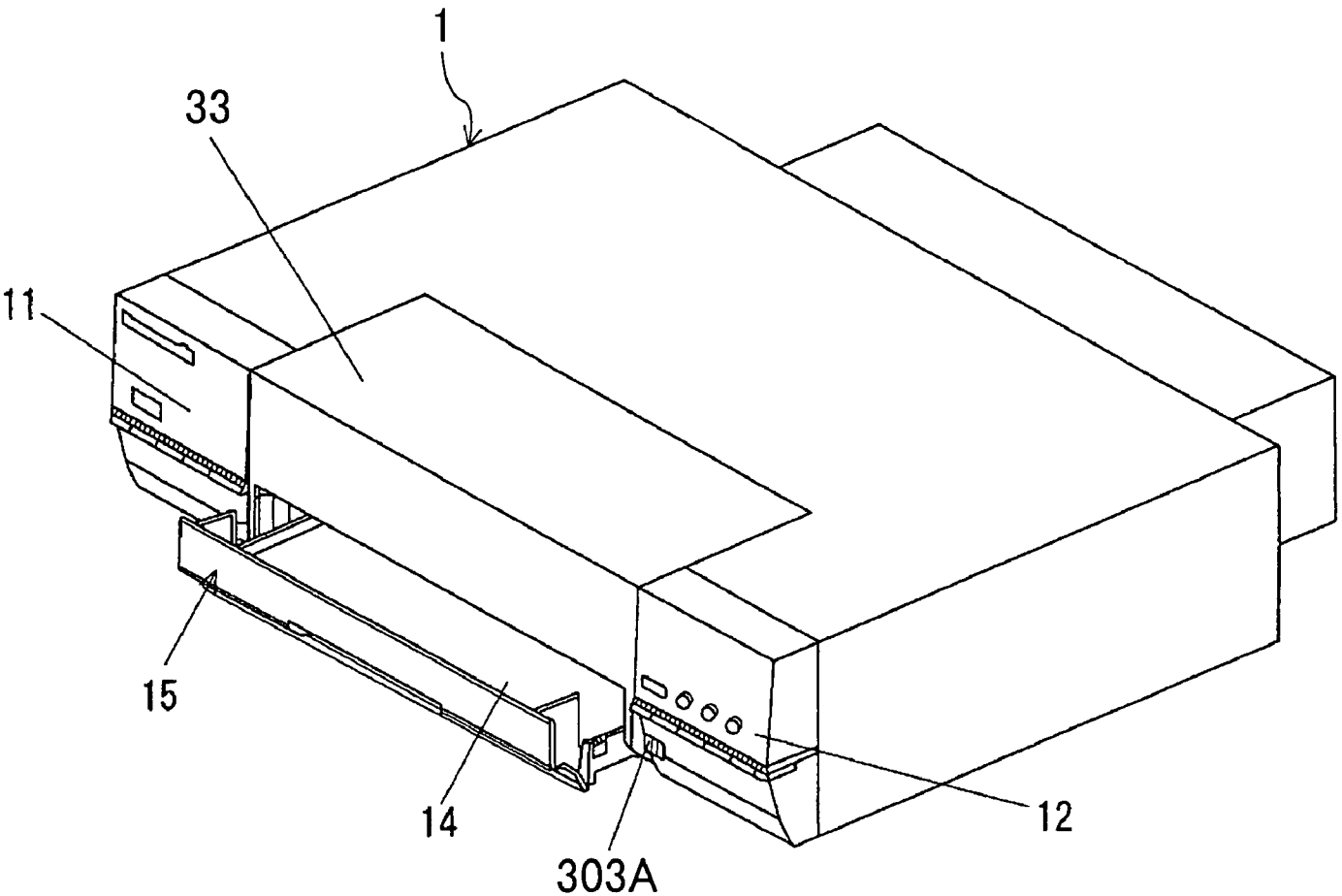
FIG. 2 is a perspective view illustrating a state where an input paper accommodating section is protruding from a printer assembly.

As illustrated in FIG. 1 and FIG. 2, an image recording device of the present embodiment is a slim inkjet printer that can be placed in an audio rack, or the like.

As illustrated in FIG. 1, the image recording device of the present embodiment has a printer assembly 1 including left and right side plate portions, a top plate portion and a bottom plate portion. An image forming section (not shown) for forming an image on recording paper 50 is provided in the printer assembly 1. Operation panels 11 and 12 are provided in left and right portions, respectively, of the front surface of the printer assembly 1, and a cover 33, which is bent so as to extend from between the operation panels 11 and 12 along the top plate portion, is attached to the printer assembly 1 so that it can be opened/closed. Note that a transparent resin material may be used for the cover 33.

Figure 5:
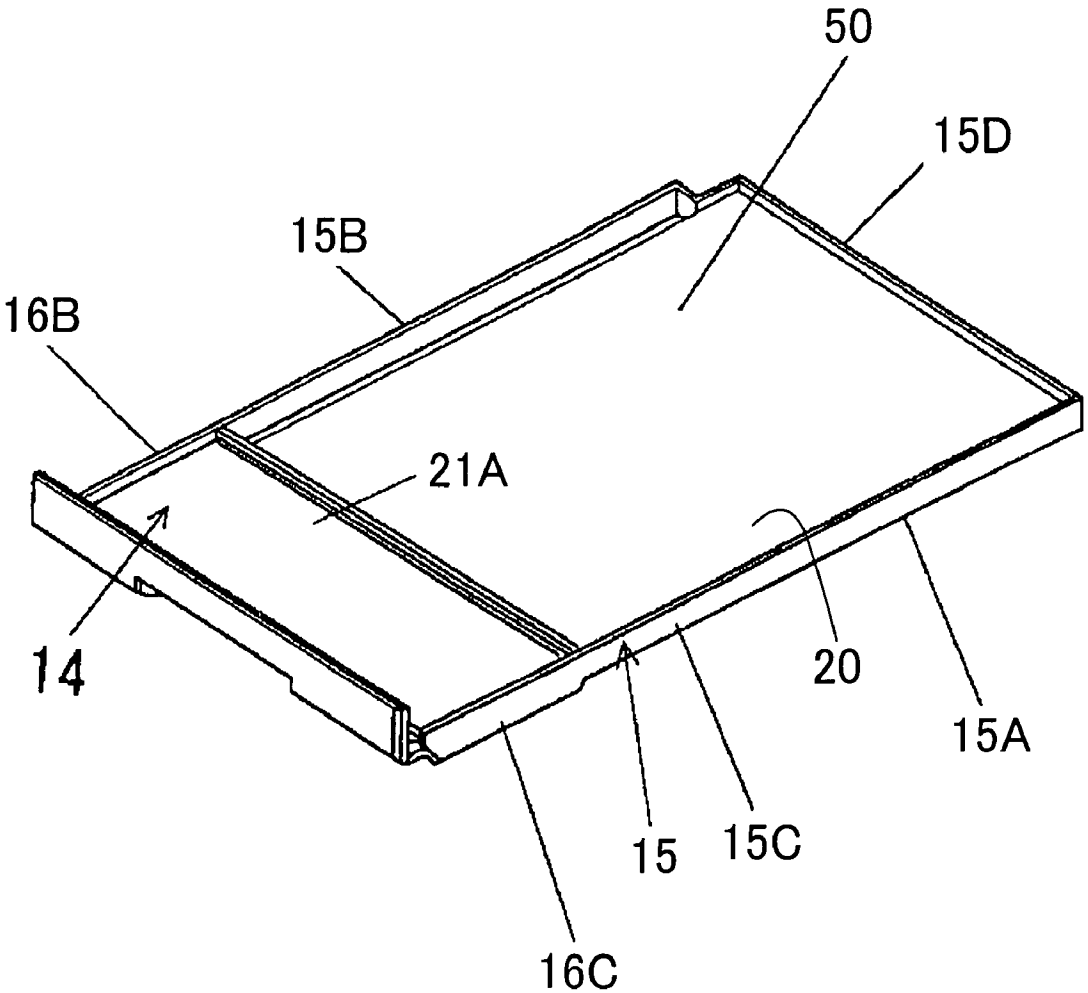
FIG. 5 is a perspective view illustrating the output paper tray in the housed state.
Figure 6:
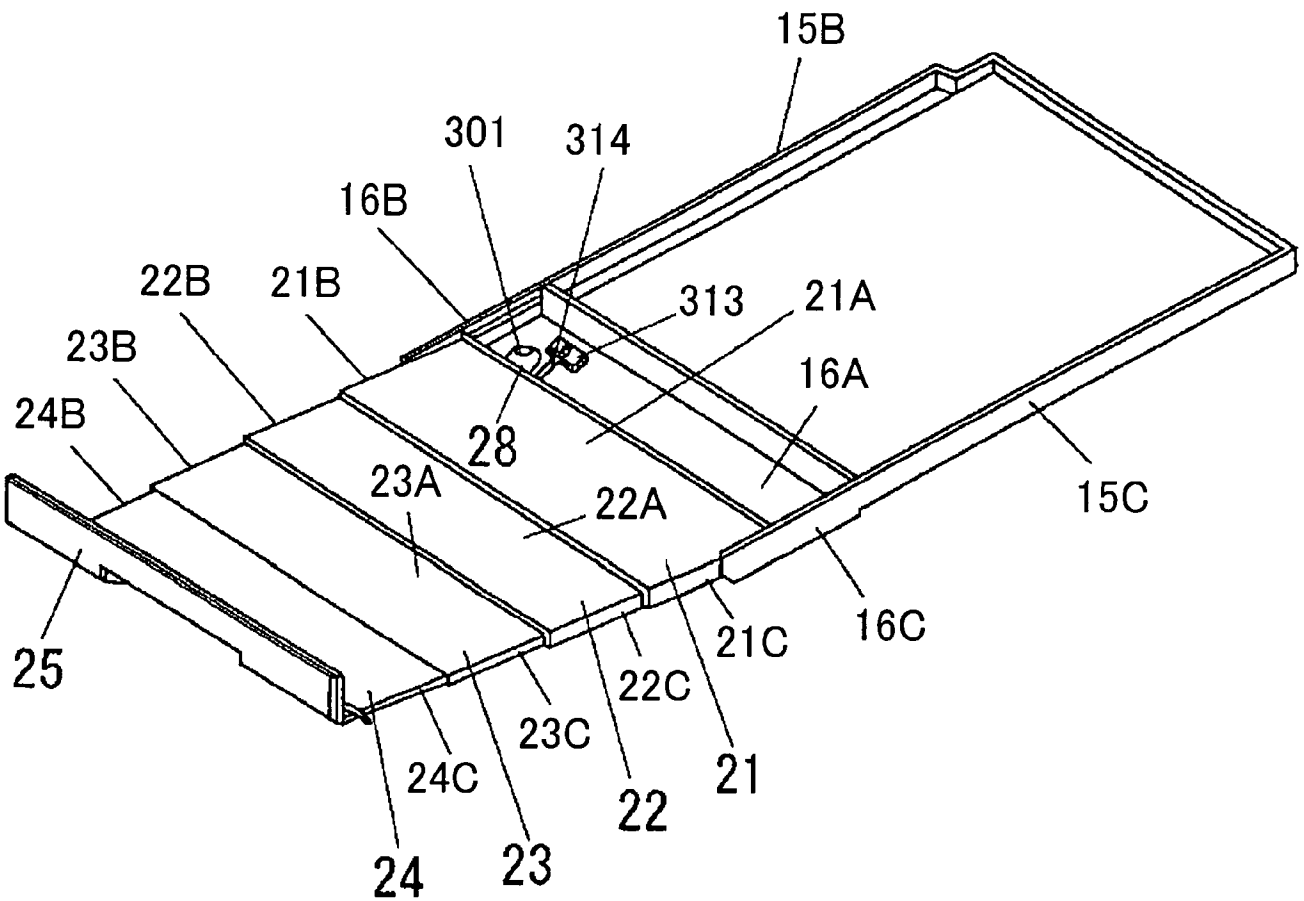
FIG. 6 is a perspective view illustrating the output paper tray in the extended state.
Figure 7A:
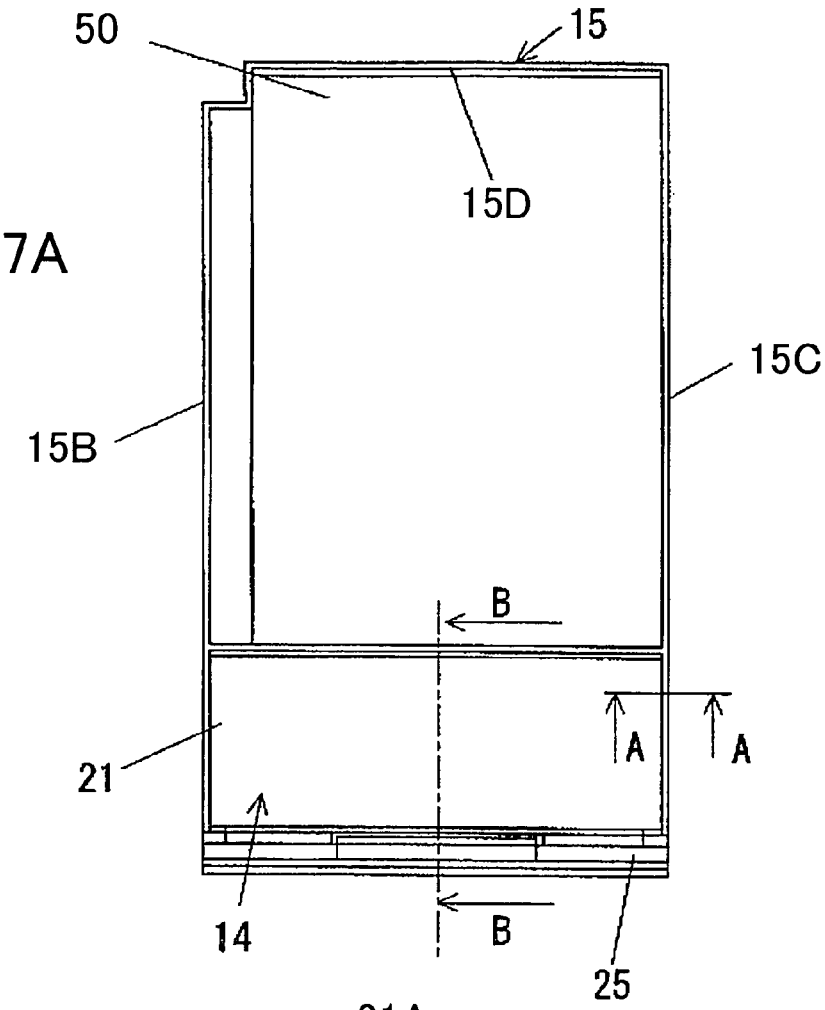
FIG. 7A is a plan view illustrating the output paper tray.
Figure 7B:
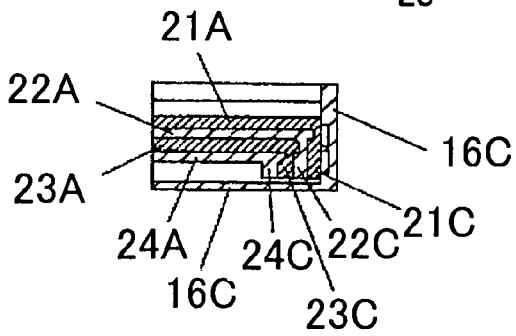
FIG. 7B is a cross-sectional view taken along line A—A in FIG. 7A.
Figure 7C:
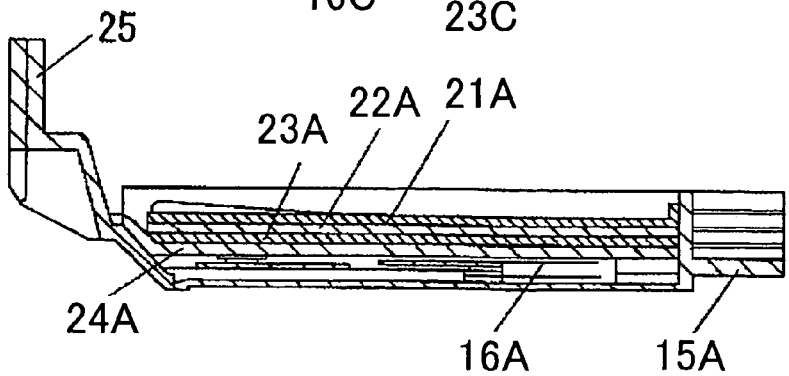
FIG. 7C is a cross-sectional view taken along line B—B in FIG. 7A.

A multi-part output paper tray 14 is attached to the printer assembly 1 so as to protrude from the front surface thereof so that it can be extended/collapsed. In the illustrated embodiment, the output paper tray 14 is integrally attached to the front end of an input paper tray 20 as illustrated in FIG. 5 to FIG. 7. The output paper tray 14 and the input paper tray 20 are integrated together to form an input paper cassette 15. The input paper cassette 15 includes a bottom plate portion 15A, left and right side plate portions 15B and 15C and a rear plate portion 1SD, and can accommodate a predetermined number of sheets of the recording paper 50 having an A4 size, for example.

In front of the input paper tray 20, a support plate portion 16A, being integral with the bottom plate portion 15A, protrudes in the forward direction from the printer assembly 1, and guides 16B and 16C are integrated with the left and right side plate portions 15B and 15C of the input paper tray 20, the guides 16B and 16C being integral with the support plate portion 16A. A proximal tray plate 21 is attached to the guides 16B and 16C so that it is slidable in the paper eject direction. The tray plate 21 includes a main portion 21A parallel to the support plate portion 16A, and side plate portions 21B and 21C bent to extend downward from the left and right edges, respectively, of the main portion 21A. The side plate portions 21B and 21C slidably engage with the inner surfaces of the guides 16B and 16C, respectively.

Moreover, an intermediate tray plate 22 is provided under the proximal tray plate 21 so that it is slidable in the paper eject direction. The tray plate 22 includes a main portion 22A overlapping the main portion 21A, and side plate portions 22B and 22C bent to extend downward from the left and right edges, respectively, of the main portion 22A. The side plate portions 22B and 22C slidably engage with the inner surfaces of the left and right side plate portions 21B and 21C, respectively, of the proximal tray plate 21.

Another intermediate tray plate 23 is provided under the intermediate tray plate 22 so that it is slidable in the paper eject direction. The tray plate 23 includes a main portion 23A overlapping the main portion 22A, and side plate portions 23B and 23C bent to extend downward from the left and right edges, respectively, of the main portion 23A. The side plate portions 23B and 23C slidably engage with the inner surfaces of the left and right side plate portions 22B and 22C, respectively, of the intermediate tray plate 22.

Moreover, a distal tray plate 24 is provided under the intermediate tray plate 23 so that it is slidable in the paper eject direction. The tray plate 24 includes a main portion 24A overlapping the main portion 23A, and side plate portions 24B and 24C bent to extend downward from the left and right edges, respectively, of the main portion 24A. The side plate portions 24B and 24C slidably engage with the inner surfaces of the left and right side plate portions 23B and 23C, respectively, of the intermediate tray plate 23, and a cover portion 25 is provided at the front end of the tray plate 24. Note that while the illustrated output paper tray 14 includes two intermediate tray plates 22 and 23 between the proximal tray plate 21 and the distal tray plate 24, the number of intermediate tray plates may be set to any number according to the size of the recording paper 50, the length of each tray plate in the paper eject direction, etc.

As described above, the output paper tray 14 includes four tray plates 21 to 24 that slidably engage with one another, and the slide limit positions of the engaging tray plates in the paper eject direction are restricted by stoppers (not shown). The output paper tray 14 can be extended by unfolding the tray plates 21 to 24 in a stepwise manner in the outward direction and can be housed into the printer assembly 1 by moving them in the opposite direction. As illustrated in FIG. 1, as the multi-part output paper tray 14 is collapsed and housed into the printer assembly 1, the cover portion 25 is substantially flush with the surfaces of the operation panels 11 and 12.

The input paper cassette 15, including the output paper tray 14 and the input paper tray 20 integrated together, can be attached/detached to/from the printer assembly 1. The input paper cassette 15 can be ejected from the printer assembly 1 by operating a cassette eject button 303A provided on the operation panel 12. When the cassette eject button 303A is operated, the input paper cassette 15 protrudes in the forward direction from the printer assembly 1 by a predetermined distance as illustrated in FIG. 2. The user of the printer can hold the guides 16B and 16C by hand to pull out the input paper cassette 15 in the forward direction from the printer assembly 1. The protruding motion can be achieved by a spring member (not shown) provided in the printer assembly 1, or by a motor. Moreover, the amount by which the input paper cassette 15 protrudes can be set to any amount.

Figure 3:
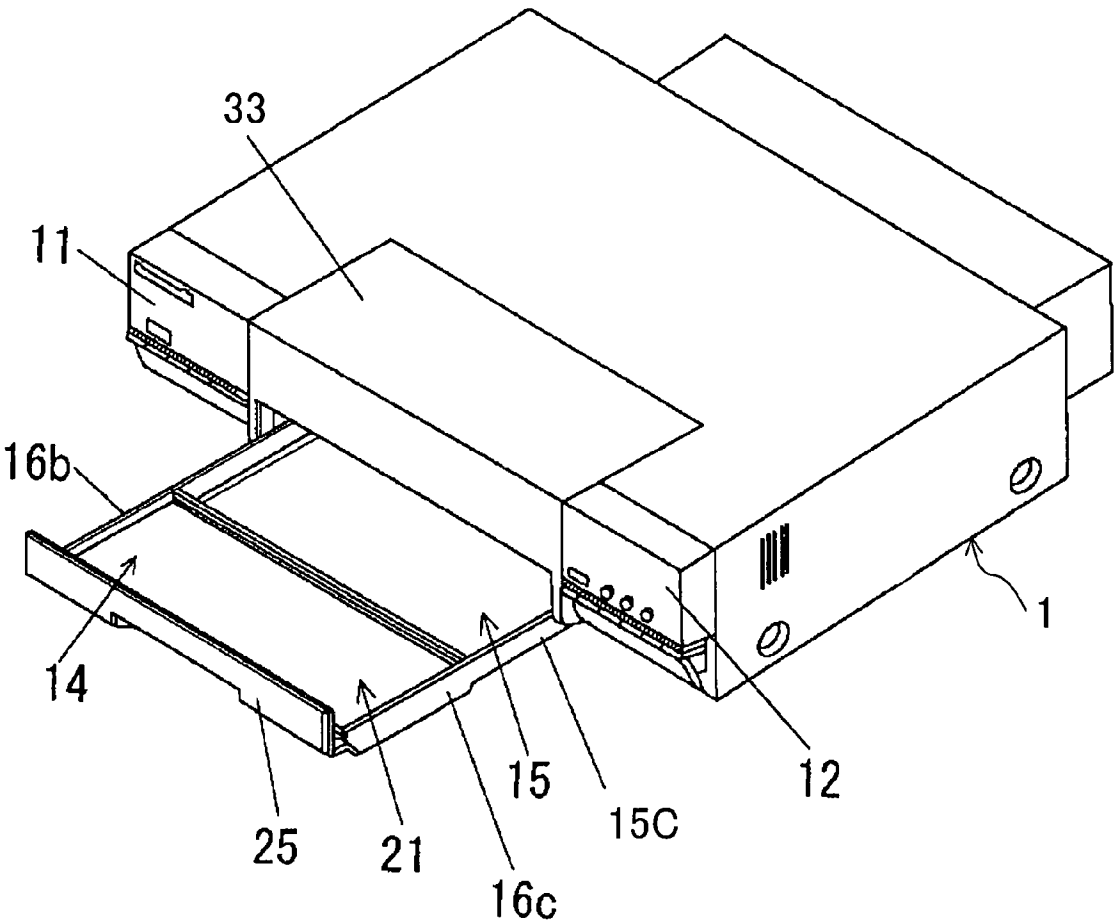
FIG. 3 is a perspective view illustrating a state where an output paper tray is extended in the forward direction from the printer assembly.
Figure 4:
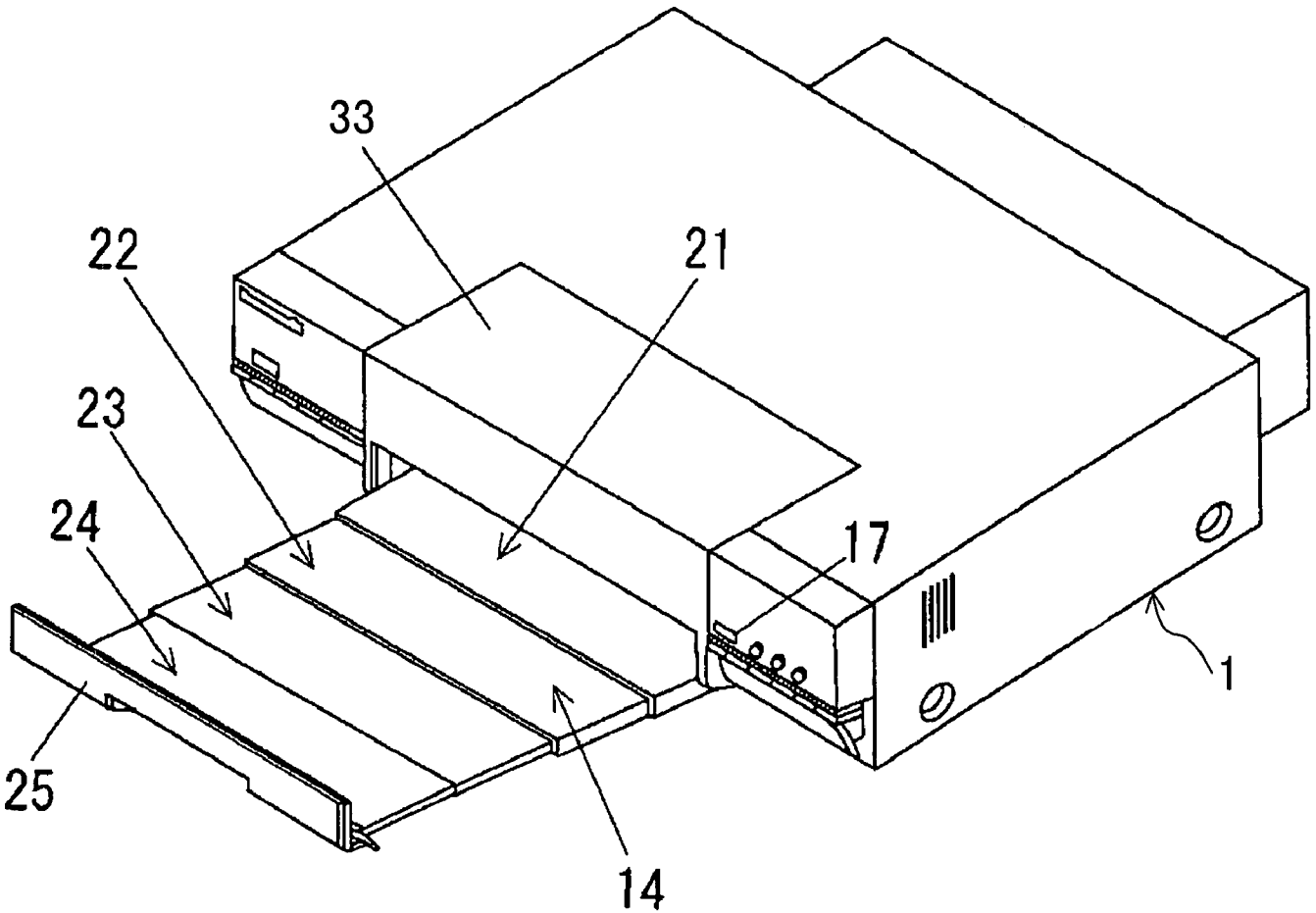
FIG. 4 is a perspective view illustrating a state where the output paper tray is extended to the extension limit position.

With the input paper cassette 15 protruding as illustrated in FIG. 2, the input paper cassette 15 can be pulled out in the forward direction from the printer assembly 1 as illustrated in FIG. 3 to remove the input paper cassette 15 from the printer assembly 1. FIG. 5 and FIG. 7A illustrate the input paper cassette 15 having been ejected from the printer assembly 1. The output paper tray 14 can be pulled out from the housed state to the extended state with the input paper cassette 15 being secured to the printer assembly 1. In such a case, by manually pulling out the cover portion 25 of the distal tray plate 24, the output paper tray 14 can be extended to its pullout limit position as illustrated in FIG. 4. FIG. 6 illustrates the output paper tray 14 in the extended state with the input paper cassette 15 having been ejected from the printer assembly 1.

Figure 8A:
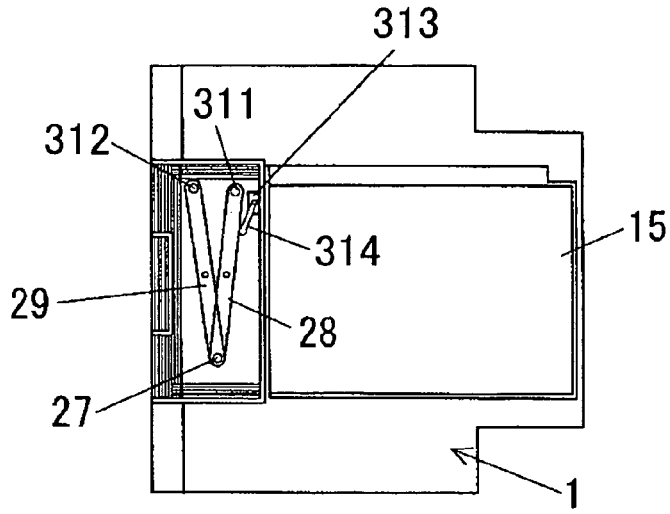
FIG. 8A is a back view illustrating the output paper tray in the housed state.
Figure 8B:
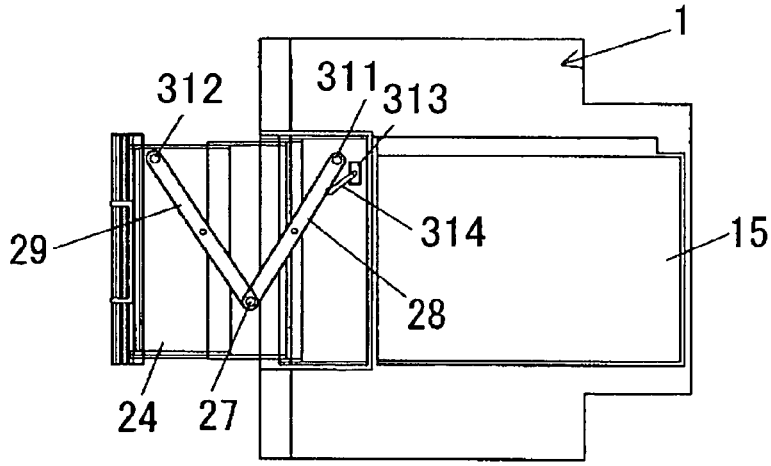
FIG. 8B is a back view illustrating the output paper tray in the extended state.
Figure 8C:
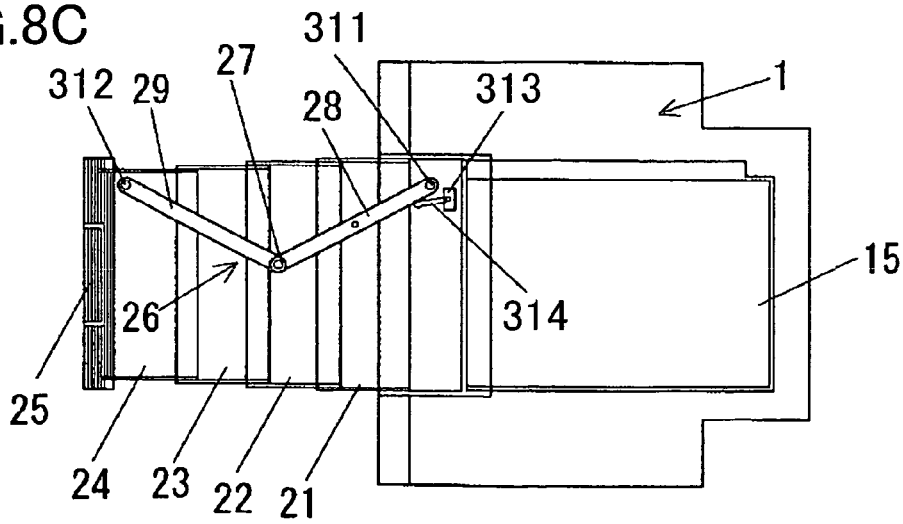
FIG. 8C is a back view illustrating the output paper tray extended to the extension limit position.

As illustrated in FIG. 8, a link mechanism 26 is attached to the back surface of the output paper tray 14 for transmitting the manual operation of pulling out the cover portion 25 to the movement of the four tray plates in the paper eject direction. The link mechanism 26 includes two links 28 and 29 connected to each other by a pin 27 at one end. The other end of one link 28 is pivotally connected to the support plate portion 16A by a pin 311, and the other end of the other link 29 is pivotally connected to the distal tray plate 24 by a pin 312. Therefore, as the output paper tray 14 is brought to the housed state by pushing in the distal tray plate 24, the two links 28 and 29 will be bent at an acute angle as illustrated in FIG. 8A. As the distal tray plate 24 is pulled out, the angle between the two links 28 and 29 will be increased from that in the housed state as illustrated in FIG. 8B, and the length of the output paper tray 14 can be set to a length suitable for printing on postcard-size recording paper 50. By extending the distal tray plate 24 to the forward limit position, the length of the output paper tray 14 can be set to a length suitable for printing on A4-size recording paper 50, as illustrated in FIG. 8C, in which case the angle between the two links 28 and 29 is at maximum.

Thus, as the output paper tray 14 is pulled out and extended, the pivot angle between the links 28 and 29 changes according to the amount of the extension, whereby it is possible to detect the amount of extension of the multi-part output paper tray 14 by detecting the angle of one link. In view of this, the support plate portion 16A is provided with an angle sensor 313 for detecting the angle of the link 28, with a contact 314 of the angle sensor 313 being in contact with the link 28. Therefore, by detecting the pivot angle of the link 28 with the angle sensor 313, it is possible to detect whether or not the output paper tray 14 is in the housed state and whether or not it is in the extended state, and it is also possible to detect the amount of extension (the extension length) thereof.

Where it is determined that the output paper tray 14 is in the housed state based on the detection signal from the angle sensor 313, even if the user gives an instruction to print on the recording paper 50, the print operation is canceled (including, in concept, a print operation that is not even started). A print operation is performed when it is determined that the output paper tray 14 is in the extended state. Moreover, when printing an image on B5-size recording paper 50, the print operation is performed when it is determined, based on the signal from the angle sensor 313, that the amount of extension of the output paper tray 14 is longer than the B5 size, i.e., that the amount of extension of the output paper tray 14 is sufficient for the recording paper 50 specified in the print instruction.

Figure 9:
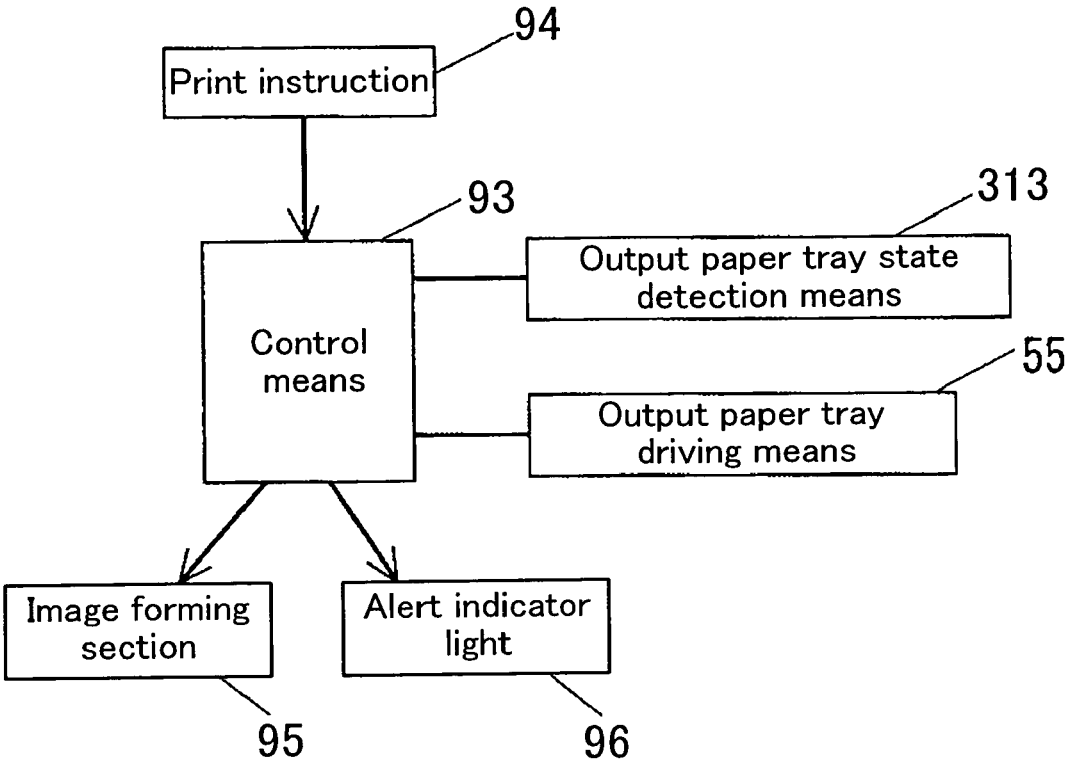
FIG. 9 is a block diagram illustrating a control circuit of the image recording device.

FIG. 9 is a block diagram illustrating a control circuit of the image recording device. Control means 93 including a CPU, a ROM and a RAM receives a detection signal from the angle sensor 313 as the output paper tray state detection section, and receives a print instruction signal 94 from the print start button provided on the printer assembly 1 or from the computer. From the control means 93, a print start instruction signal is sent to an image forming section 95. Moreover, a light-on signal is sent from the control means 93 to an alert indicator light 96 if the output paper tray 14 is in the housed state or if the extension length of the output paper tray 14 is not sufficient for the recording paper 50 specified in the print instruction or shorter than the length of the recording paper 50 specified in the print instruction. An alert sound may be generated instead of, or in addition to, the light indication. Alternatively, even if the amount of extension of the output paper tray 14 is shorter than the length of the recording paper 50 specified in the print instruction, the print operation may be started as long as the output paper tray 14 is not in the housed state.

Embodiment 2

Figure 10:
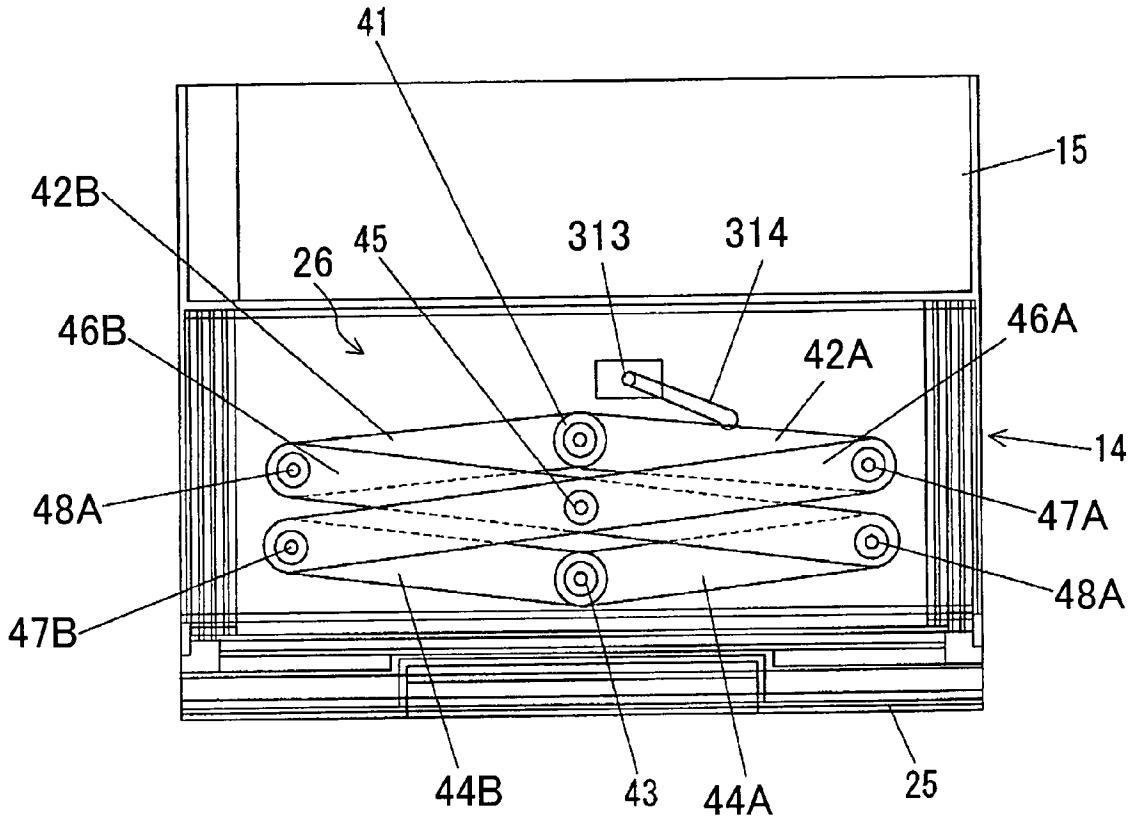
FIG. 10 is a back view illustrating an output paper tray of Embodiment 2.

FIG. 10 is a back view illustrating the output paper tray 14 of Embodiment 2. Note that FIG. 10 shows a portion corresponding to FIG. 8.

In the output paper tray 14 illustrated in FIG. 10, the link mechanism 26 is formed by a pantograph mechanism. The link mechanism 26 includes two proximal links 41A and 42B pivotally attached to a pin 41, which is fixed to the support plate portion 16A, two distal links 44A and 44B pivotally attached to a pin 43, which is fixed to the back surface of the distal tray plate 24, and connector links 46A and 46B pivotally connected to each other at the center by a pin 45. The opposite ends of one connector link 46A are connected to the proximal link 42A and to the distal link 44B by pins 47A and 47B, respectively, and the opposite ends of the other connector link 46B are connected to the proximal link 42B and to the distal link 44A by pins 48A and 48B, respectively.

The support plate portion 16A is provided with the angle sensor 313 for detecting the angle of the proximal link 42A, with the contact 314 of the angle sensor 313 being in contact with the proximal link 42A. Therefore, as with the image recording device of Embodiment 1 described above, by detecting the pivot angle of the proximal link 42A with the angle sensor 313, it is possible to detect whether or not the output paper tray 14 is in the housed state and whether or not it is in the extended state, and it is also possible to detect the amount of extension thereof.

Embodiment 3

Figure 11:
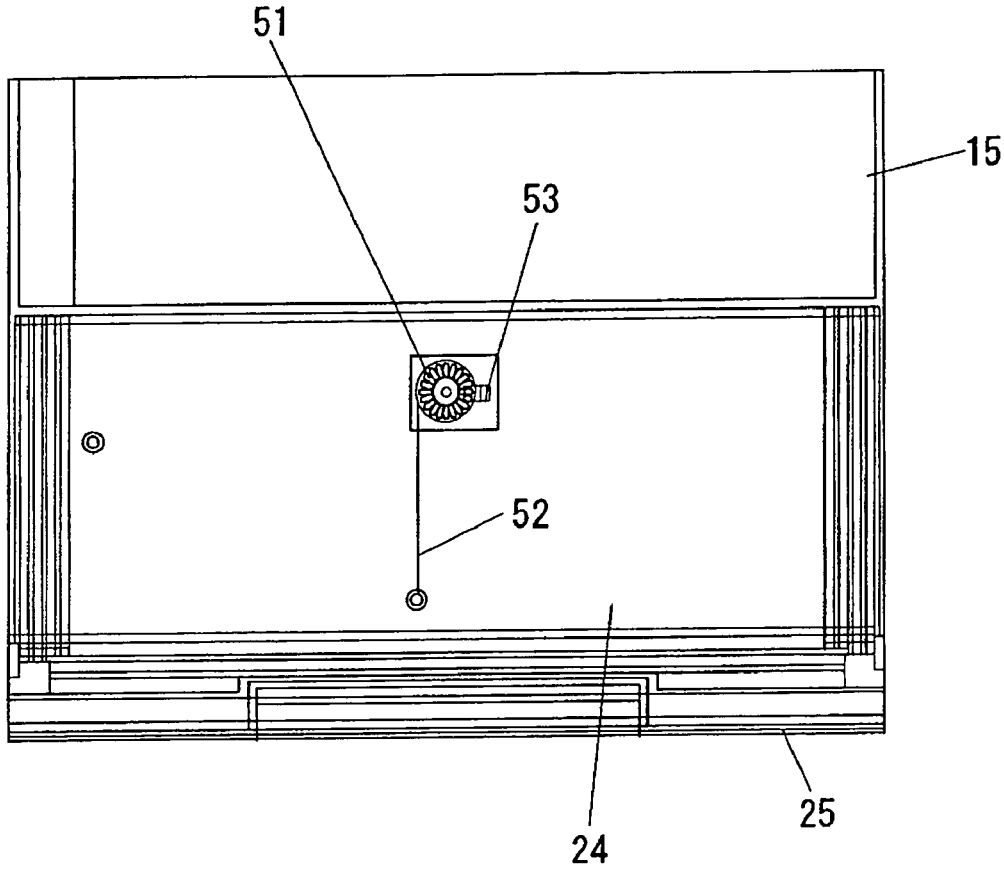
FIG. 11 is a back view illustrating an output paper tray of Embodiment 3.

FIG. 11 is a back view illustrating the output paper tray 14 of Embodiment 3. Note that FIG. 11 shows a portion corresponding to FIG. 10.

In the output paper tray 14 illustrated in FIG. 11, a rotary encoder 51 is attached to the support plate portion 16A for detecting the amount of extension of the output paper tray 14. A wire 52, one end of which is fixed to the distal tray plate 24, is wound around the rotary encoder 51. A spring force urging the wire 52 to be wound is applied to the wire 52 by a spring member (not shown). Extending the output paper tray 14 unwinds the wire 52 while rotating the rotary encoder 51, and collapsing the output paper tray 14 into the housed state winds the wire 52 around the rotary encoder 51.

The support plate portion 16A is provided with a photosensor 53 for detecting the number of rotations of the rotary encoder 51. Based on the signal from the photosensor 53, it is possible to detect whether or not the output paper tray 14 is in the housed state and whether or not it is in the extended state, and it is also possible to detect the amount of extension thereof.

Embodiment 4

Figure 12A:
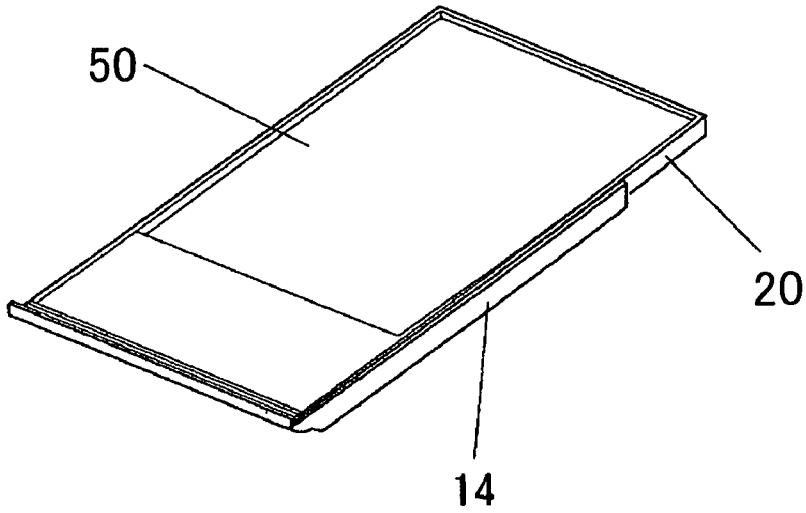
FIG. 12A is a perspective view illustrating an output paper tray not being used and an input paper accommodating section of Embodiment 4.
Figure 12B:
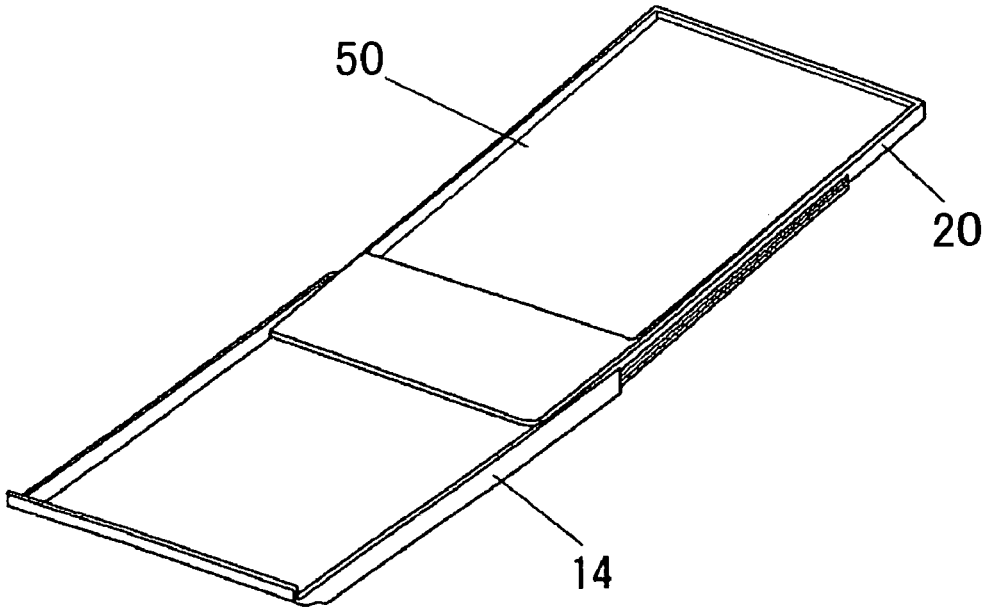
FIG. 12B is a perspective view illustrating a state where the output paper tray is pulled out from the input paper accommodating section.
Figure 13A:
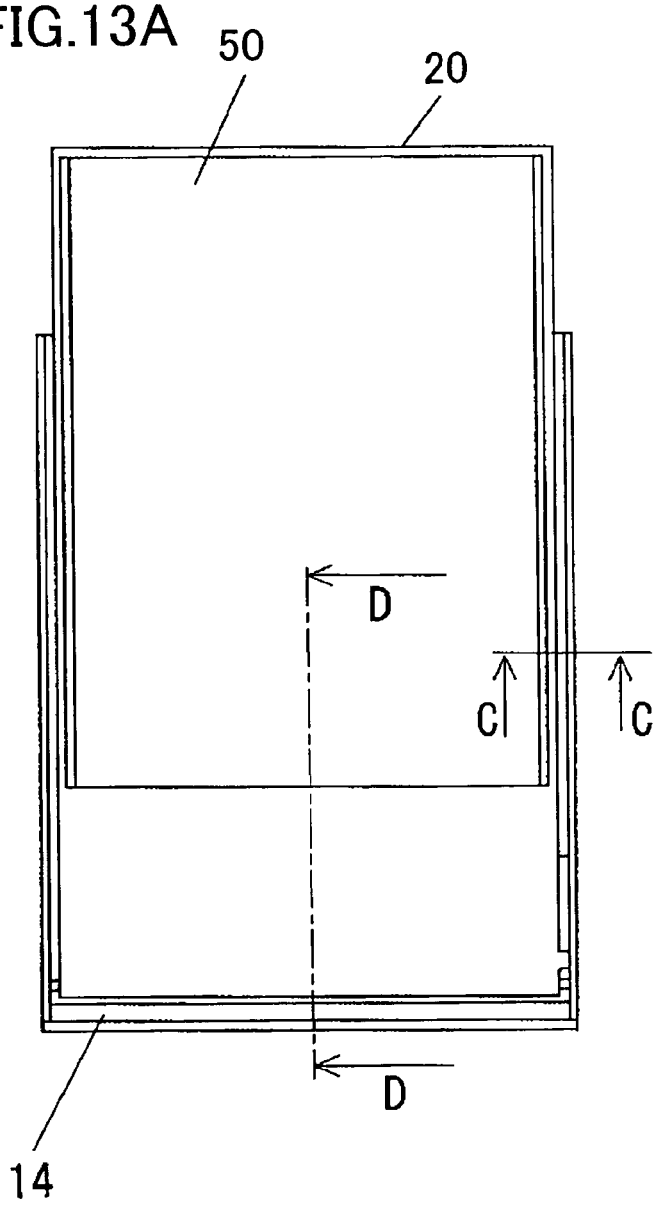
FIG. 13A is a plan view illustrating the input paper cassette.
Figure 13C:
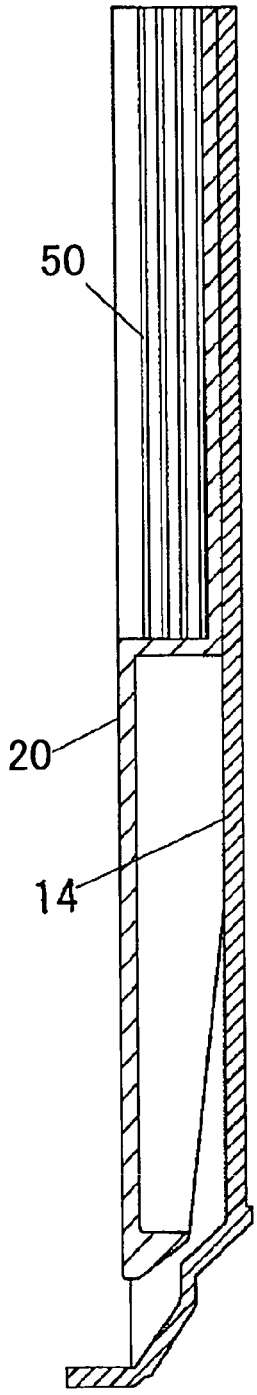
FIG. 13C is a cross-sectional view taken along line D—D in FIG. 13A.
Figure 13B:
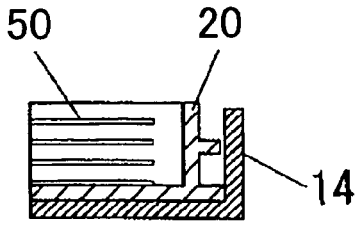
FIG. 13B is a cross-sectional view taken along line C—C in FIG. 13A.

FIG. 12 and FIG. 13 illustrate the output paper tray 14 and the input paper tray 20 in an image recording device of Embodiment 4, in which the output paper tray 14 is provided under the input paper tray 20 so that it is movable in the front-back direction with respect to the input paper tray 20. Therefore, with the output paper tray 14 being in the housed state, the output paper tray 14 and the input paper tray 20 are on top of each other, as illustrated in FIG. 27A, whereby the output paper tray 14 and the input paper tray 20 can be arranged in a limited space.

Embodiment 5

Figure 14:
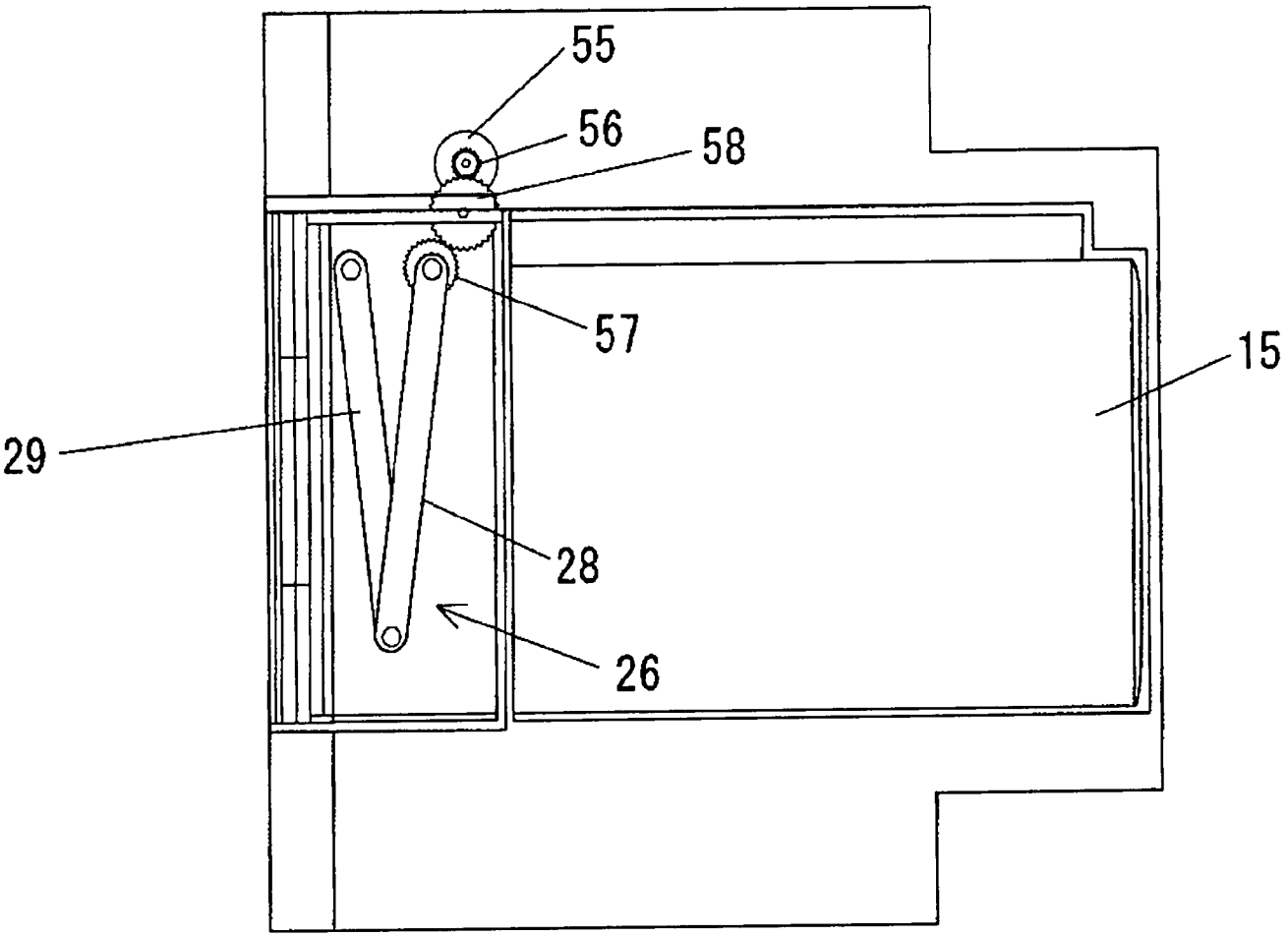
FIG. 14 is a back view illustrating an output paper tray of Embodiment 5.

FIG. 14 is a back view illustrating the output paper tray 14 in an image recording device of Embodiment 5. Note that FIG. 14 shows a portion corresponding to FIG. 8.

In the image recording device illustrated in FIG. 14, a motor 55 for automatically driving the output paper tray 14 between the housed state and the extended state is attached to the printer assembly 1, in addition to the link mechanism 26 illustrated in FIG. 8. A driving gear 56, which is fixed to the main shaft of the motor 55, is meshed with a driven gear 57, which is fixed to the link 28, via an intermediate gear 58. Therefore, in the image recording device illustrated in FIG. 14, the output paper tray 14 can be automatically extended by an amount of extension according to the length of the specified recording paper 50, or collapsed into the housed state, by the motor 55. The extension/collapse action of the output paper tray 14 is controlled by a signal from the control means 93 illustrated in FIG. 9.

Embodiment 6

Figure 15:
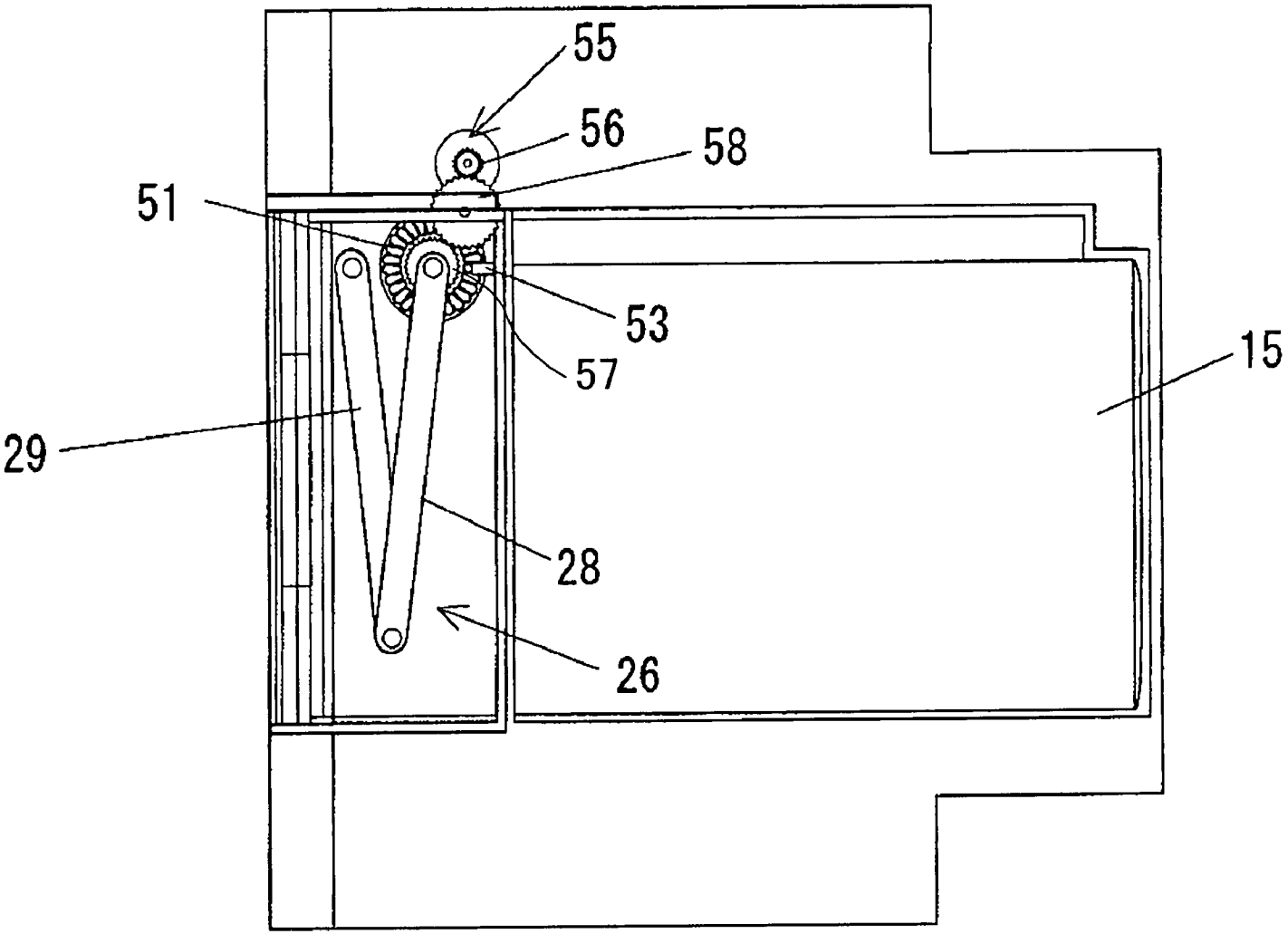
FIG. 15 is a back view illustrating an output paper tray of Embodiment 6.

FIG. 15 is a back view illustrating the output paper tray 14 in an image recording device of Embodiment 6. As is the output paper tray 14 illustrated in FIG. 14, the output paper tray 14 of the image recording device is automatically extended/collapsed by the motor 55. Moreover, in this embodiment, the rotary encoder 51 is attached to the driven gear 57, and the photosensor 53 for detecting the number of rotations of the rotary encoder 51 is attached to the printer assembly 1. Thus, whether the output paper tray 14 automatically extended/collapsed by the motor 55 is in the housed state or in the extended state is detected, and the amount of extension thereof is also detected.

Figure 16:
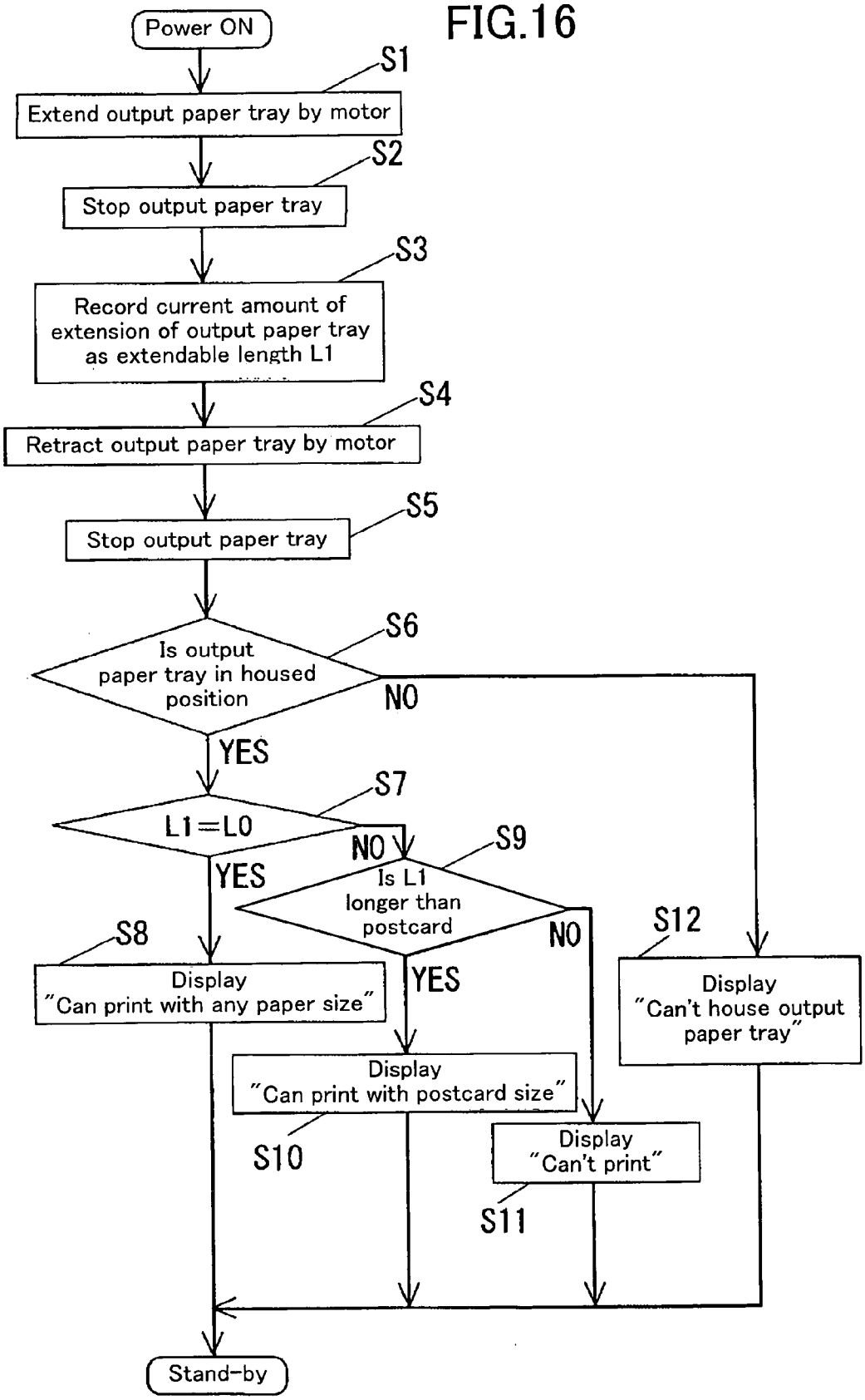
FIG. 16 is a flow chart illustrating the process of making the initial settings for the extension/collapse detection of the output paper tray.

FIG. 16 is a flow chart illustrating the process of making the initial settings for the extension/collapse detection of the output paper tray 14, where the output paper tray 14 is extended/collapsed by the motor 55 as illustrated in FIG. 14 and FIG. 15. The output paper tray 14 is extended by the motor 55 in step S1, and the extension of the output paper tray 14 is stopped in step S2. In step S3, the amount of extension of the output paper tray 14 in this state is recorded in a memory as the maximum extension length L1. The detection of the maximum extension length L1 is performed because the length L1 may vary depending on the environment in which the image recording device is placed.

Then, the output paper tray 14 is moved back into the housed state by the motor 55 in step S4, and the output paper tray 14 is stopped in step S5. If it is determined in step S6 that the output paper tray 14 is in the housed position, it is determined in step S7 whether or not the maximum extension length L1 is equal to L0, which is the structural maximum extension of the device. If it is determined to be equal to the structural maximum extension, a message "Can print with any paper size" is displayed in step S8. If NO is returned in step S7, it is determined in step S9 whether or not the maximum extension length L1 is longer than a postcard. If it is longer than a postcard, a message "Can print with postcard size" is displayed in step S10.

If it is determined to be shorter than a postcard in step S9, the process proceeds to step S11 where a message "Can't print" is displayed. If it is determined in step S6 that the output paper tray 14 has not been housed, the process proceeds to step S12 where a message "Can't house output paper tray 14" is displayed. With such a control, it is possible to detect the maximum extension length of the output paper tray 14 and to determine whether or not there exists any obstacle for the movement of the output paper tray 14.

Figure 17:
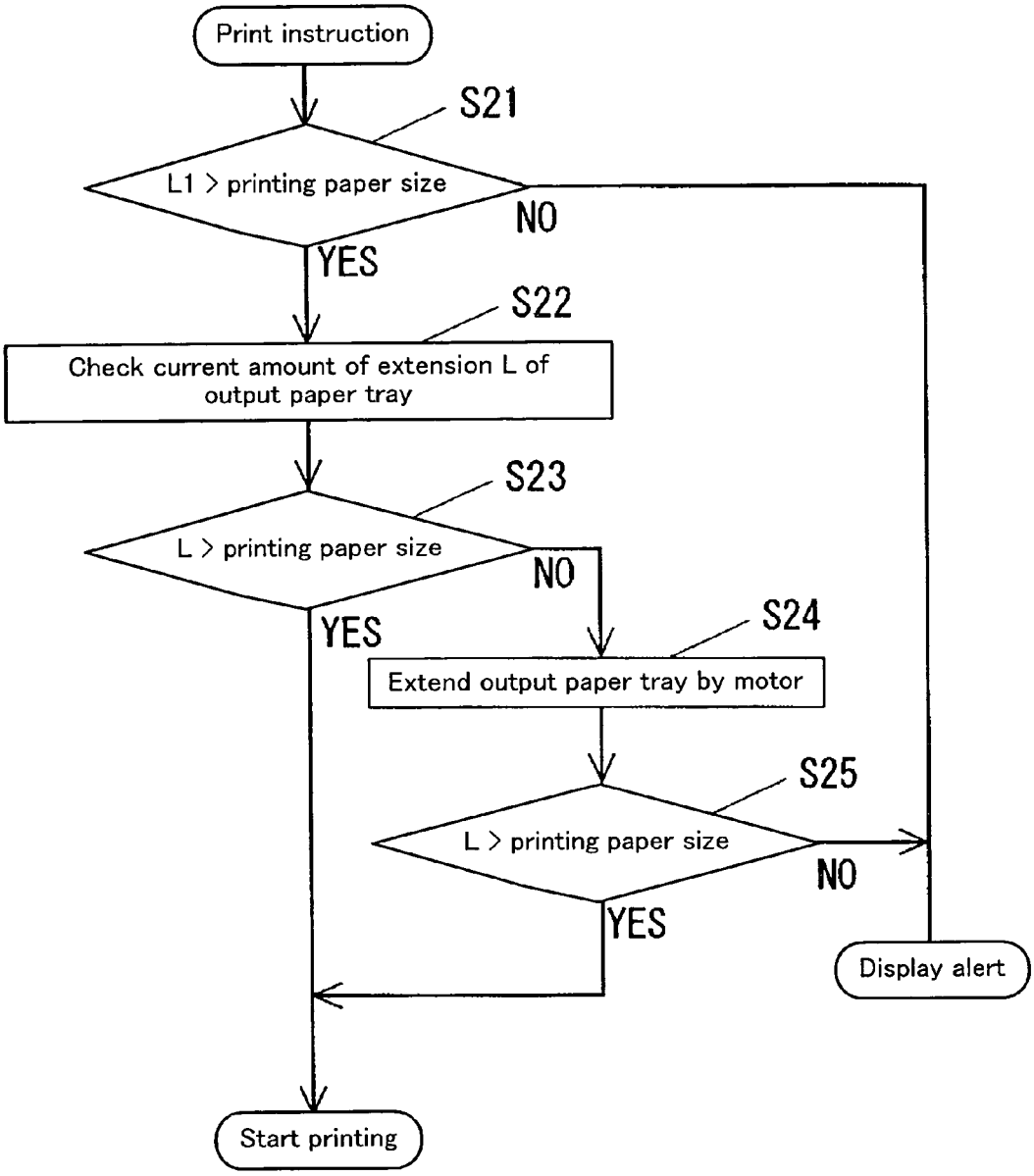
FIG. 17 is a flow chart illustrating the process of driving the output paper tray.

FIG. 17 is a flow chart illustrating the process of driving the output paper tray 14, where the output paper tray 14 is extended/collapsed by the motor 55. When a print instruction is received, the maximum extension length L1 of the output paper tray 14 and the size of the printing paper are compared with each other in step S21. If the maximum extension length L1 is longer, the current amount of extension L is checked in step S22. Otherwise, an alert is issued. If it is determined in step S23 that the current amount of extension L is greater than the size of the printing paper, the print operation is started. Otherwise, the output paper tray 14 is extended by the motor 55 in step S24. If it is determined in step S25 that the amount of extension L is now greater than the size of the printing paper, the print operation is started. Otherwise, an alert is issued.

Thus, in each printer described above, a print operation on the recording paper is not performed when the multi-part output paper tray 14 is housed in the printer assembly 1, thereby providing an advantageous effect that a paper jam is prevented. In the printer described above, a print operation on the recording paper 50 is performed when the length of the output paper tray 14 is sufficiently greater than the length of the recording paper 50 specified in the print instruction, thereby providing a unique effect that the recording paper 50 is prevented from falling off the output paper tray 14 or from becoming bent on the output paper tray 14.

Moreover, the multi-part output paper tray 14 can be extended automatically, thereby providing a unique effect that the output paper tray 14 does not need to be extended manually and the output paper tray 14 can be extended to a sufficient extension length for the recording paper.

Embodiment 7

The appearance of the image recording device of Embodiment 7 is the same as that of the image recording device of Embodiment 1 as illustrated in FIG. 1.

Figure 18:
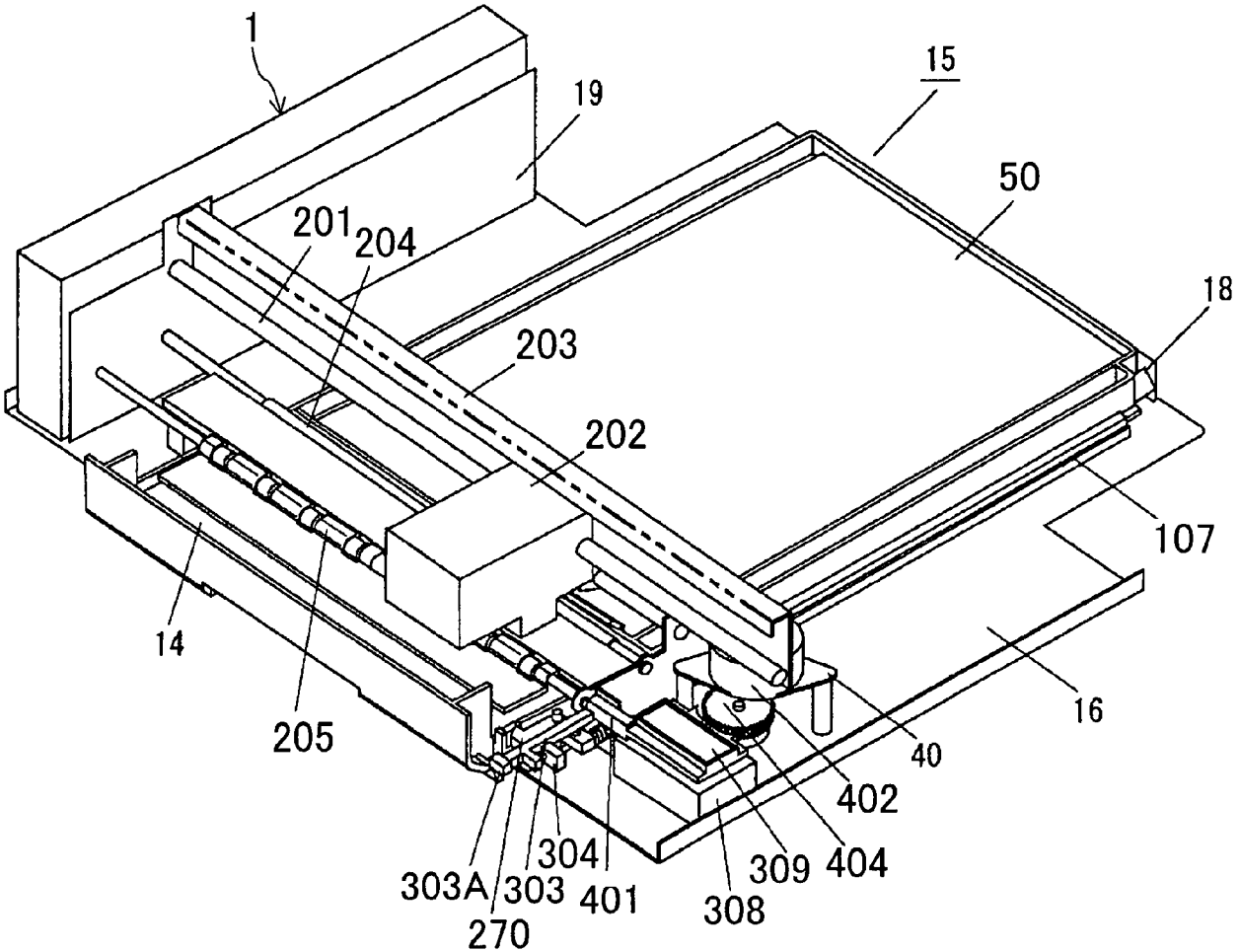
FIG. 18 is a perspective view illustrating the internal structure of an image recording device of Embodiment 7.

In the printer assembly 1, a bottom plate 16 is provided with cassette guides 107 so as to correspond to the opposite sides of the input paper cassette 15 for guiding the sliding movement of the input paper cassette 15 when the input paper cassette 15 is attached/detached to/from the printer assembly 1, as illustrated in FIG. 18. Moreover, the bottom plate 16 is provided with a spring member 18 for applying a spring force to urge the input paper cassette 15 to protrude from the front surface of the printer assembly 1.

A side frame 19 is fixed inside the printer assembly 1. A carriage 202 for recording an image on the recording paper 50 fed from the input paper cassette 15 is slidably attached to a carriage shaft 201, which is attached to the side frame 19. A carriage guide 203 is fixed inside the printer assembly 1 for guiding the sliding movement of the carriage 202. Moreover, a carrier roller 204 for carrying the recording paper 50 during a print operation and a paper eject roller 205 for ejecting the recording paper 50 toward the output paper tray 14 are rotatably attached to the side frame 19.

Figure 19:
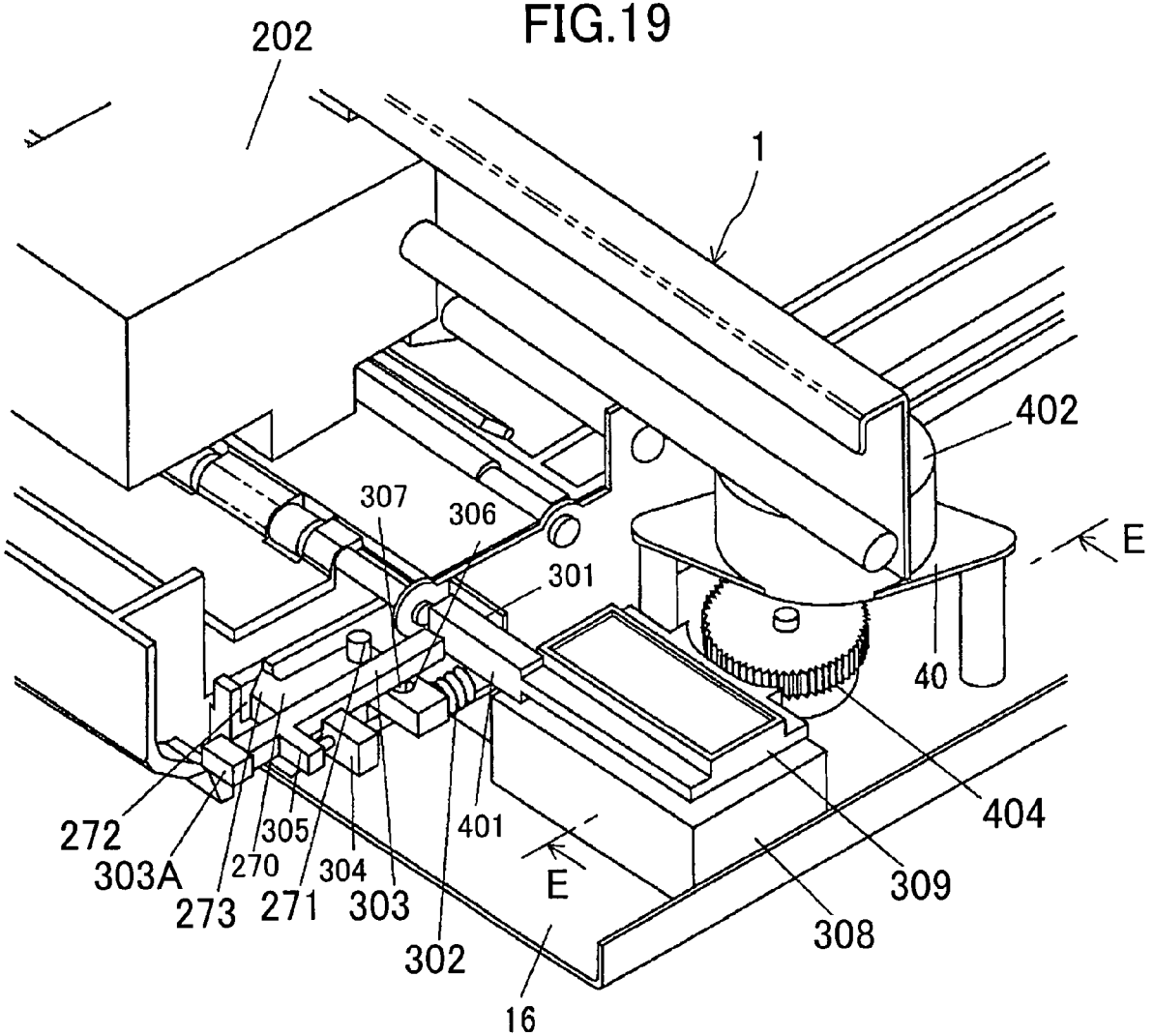
FIG. 19 is an enlarged partial perspective view of FIG. 18.

As illustrated in FIG. 19, a lock lever 270 is pivotally attached to a pin 271, which is fixed to the bottom plate 16 of the printer assembly 1. A locking tongue 273 that engages with a mating groove 272 formed in the input paper cassette 15 is provided at the tip of the lock lever 270 for holding the input paper cassette 15 being housed in the printer assembly 1 against the spring force of the spring member 18. The base portion of the lock lever 270 is bent to be substantially perpendicular to the tip portion thereof, and a spring member 302 for applying a spring force to urge the locking tongue 273 toward the mating groove 272 is provided between the base portion and a support bracket 301. Note that the input paper cassette 15 may be provided with a mating protrusion instead of the mating groove 272, and a mating groove that engages with the mating protrusion may be provided at the tip of the lock lever 270 instead of the locking tongue 273.

A cassette eject rod 303 is attached to the printer assembly 1 so that it can reciprocate in the front-back direction. The cassette eject button 303A is provided at the tip of the rod. As illustrated in FIG. 1 and FIG. 2, the cassette eject button 303A protrudes from the front surface of the printer assembly 1 so that it can be operated by the operator. The cassette eject rod 303 is provided with a protruding portion 305 that activates a detection switch 304 attached to the printer assembly 1. Moreover, the cassette eject rod 303 is provided with a protruding portion 307 that engages with an elongate aperture 306 formed in the base portion of the lock lever 270. When the cassette eject button 303A is pushed in, the lock lever 270 pivots against the spring force of the spring member 302 in such a direction that the locking tongue 273 is disengaged from the mating groove 272. As the engagement between the locking tongue 273 and the mating groove 272 is released, the input paper cassette 15 pops out in the forward direction from the printer assembly 1 by a predetermined distance, as illustrated in FIG. 2, due to the spring force of the spring member 18. Note that instead of providing the spring member 18, the input paper cassette 15 may be entirely manually pulled out from the housed state after the lock of the input paper cassette 15 by the lock lever 270 is released.

If the cassette eject rod 303 is operated so that the input paper cassette 15 protrudes while an image is being printed on the recording paper 50, the recording paper 50 may get creased and the print operation may not be done properly. In view of this, a cap 309, which is provided on a base 308 fixed to the bottom plate 16 so that the cap 309 can move up and down, is integrally provided with a stopper 401 being in contact with the cassette eject rod 303 to restrict the cassette eject button 303A from being pushed in during a print operation. FIG. 19 illustrates a state where the stopper 401 is in a position where it is in contact with the cassette eject rod 303. When the stopper 401 is moved up from this position by the cap 309, the stopper 401 will be retracted in a position where it is not in contact with the cassette eject rod 303.

Figure 20A:
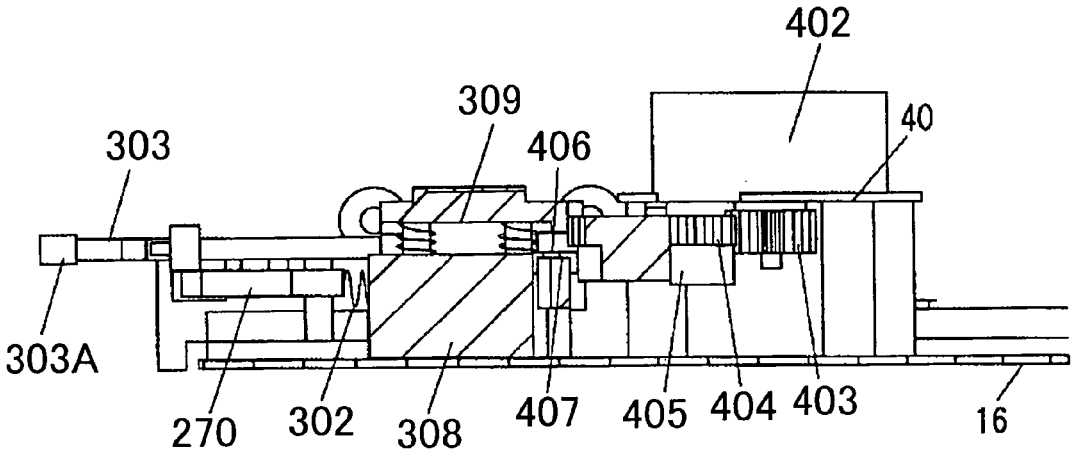
FIG. 20A is a cross-sectional view taken along line E—E in FIG. 19.
Figure 20B:
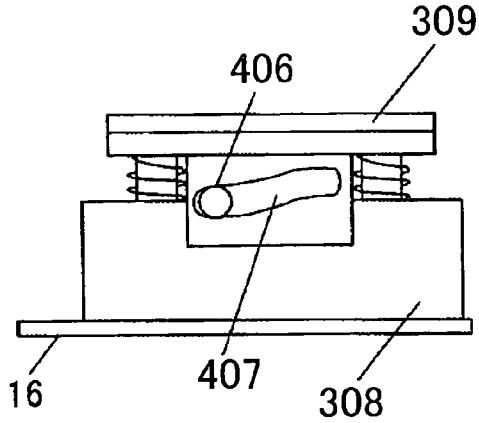
FIG. 20B is a front view illustrating a cam groove.

As illustrated in FIG. 20, a motor 402 is attached to the bottom plate 16 via a support base 40 for moving the cap 309 up and down so as to move the stopper 401 between the lock position (stop position) where it is in contact with the cassette eject rod 303 and the retracted position where it is not in contact with the cassette eject rod 303. A motor gear 403, which is fixed to the main shaft of the motor 402, is meshed with a driving gear 404, which is rotatably attached to the bottom plate 16. The driving gear 404 is provided with a cap driving cam 405, and a mating protrusion 406 protruding from the cap driving cam 405 is engaged with a cam groove 407 formed in the cap 309. Thus, the stopper 401 is moved between the lock position and the retracted position as the cap driving cam 405 is driven by the motor 402 via the motor gear 403 and the driving gear 404.

Figure 21A:
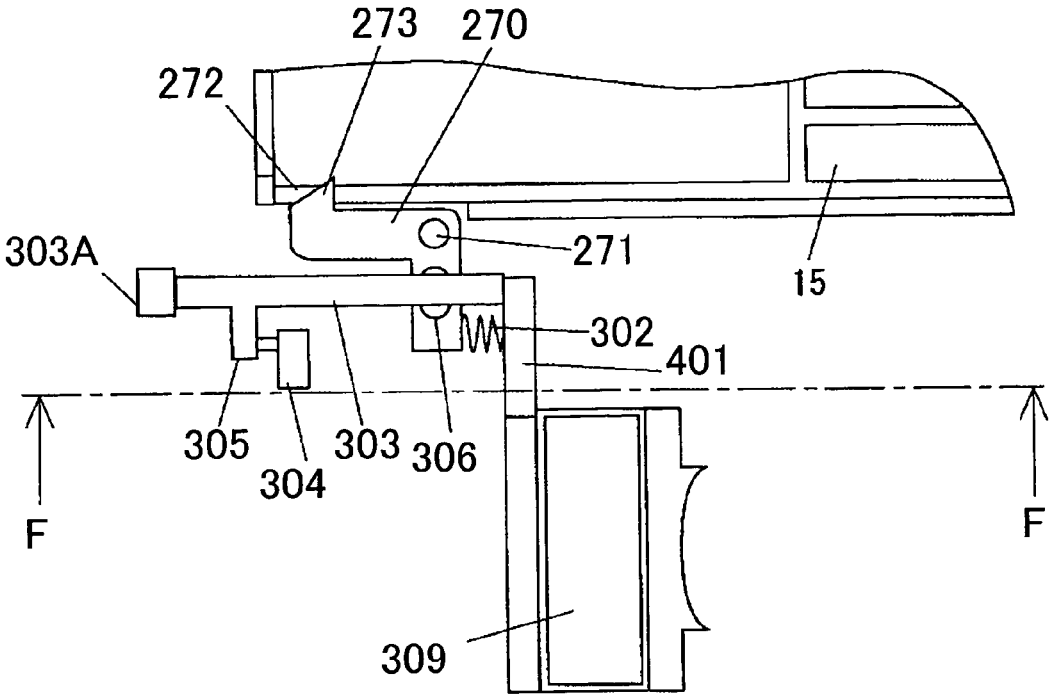
FIG. 21A is a plan view illustrating a part of the image recording device with a stopper being in the retracted position.
Figure 21B:
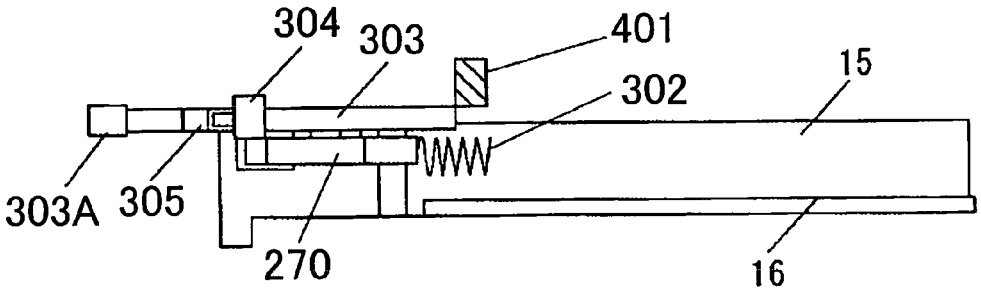
FIG. 21B is a cross-sectional view taken along line F—F in FIG. 21A.
Figure 22A:
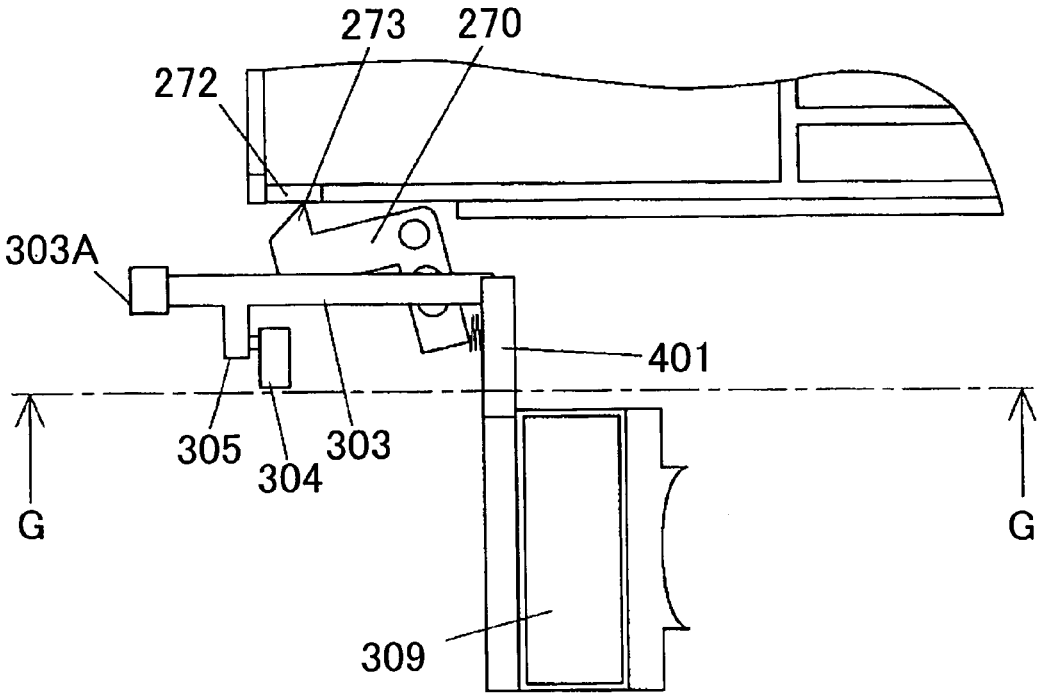
FIG. 22A is a plan view illustrating a part of the image recording device when a cassette eject button is pressed with the stopper being in the retracted position.
Figure 22B:
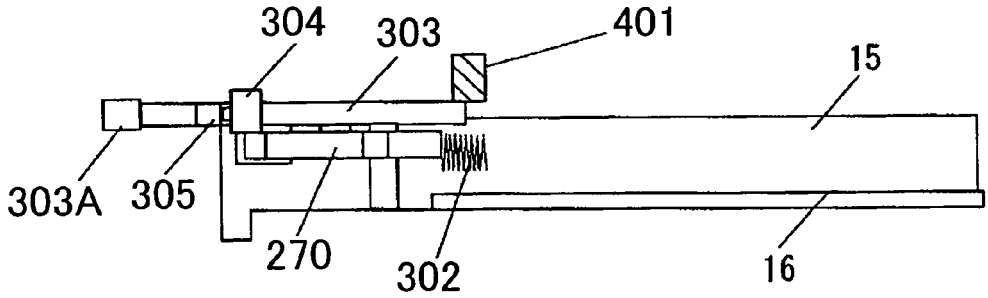
FIG. 22B is a cross-sectional view taken along line G—G in FIG. 22A.
Figure 23A:
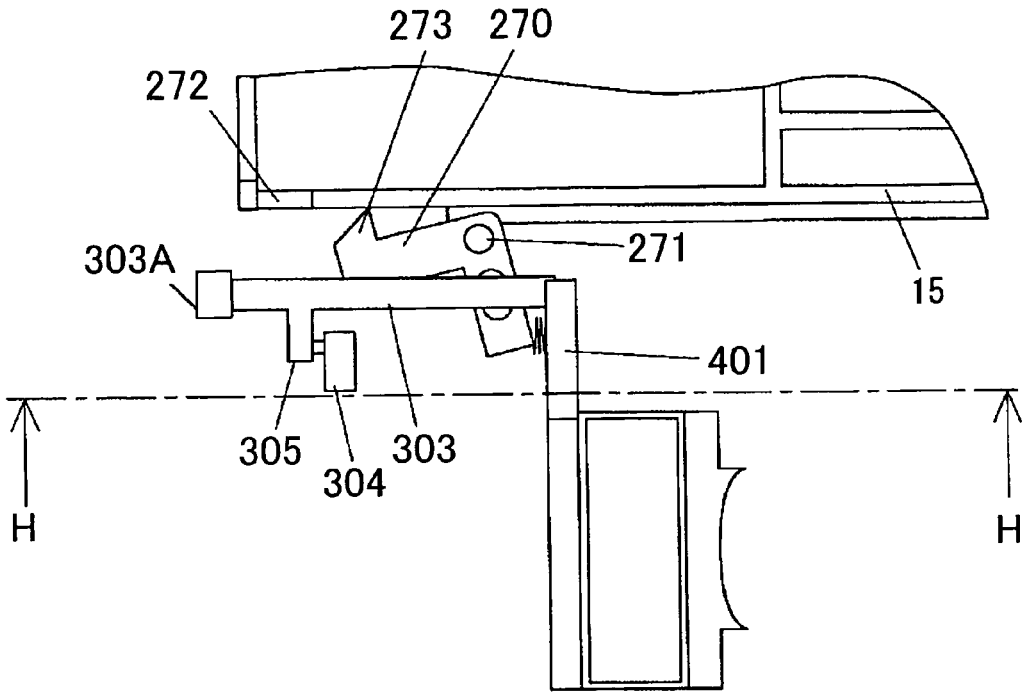
FIG. 23A is a plan view illustrating a part of the image recording device with the input paper cassette popping out after the cassette eject button is pressed.
Figure 23B:
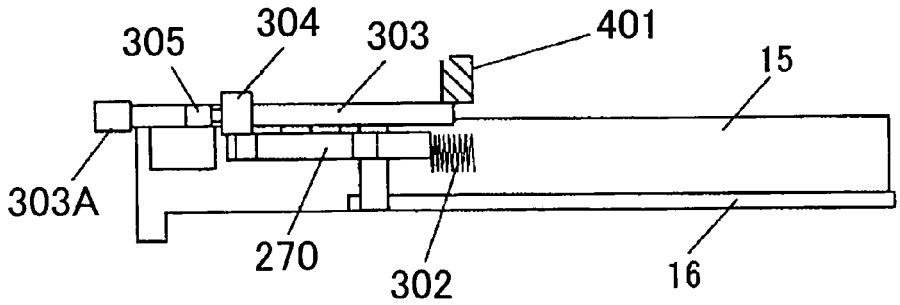
FIG. 23B is a cross-sectional view taken along line H—H in FIG. 23A.

FIG. 21 illustrates the stopper 401 being in the retracted position where it is not in contact with the cassette eject rod 303. While a print operation is not being performed on the recording paper 50, the stopper 401 is in the retracted state, i.e., in the idle state. If the cassette eject button 303A is pushed in the idle state, the cassette eject rod 303 is pushed in as illustrated in FIG. 22. This pivots the lock lever 270 to release the engagement between the locking tongue 273 and the mating groove 272, whereby the input paper cassette 15 pops out in the forward direction from the printer assembly 1, as illustrated in FIG. 23, due to the biasing force of the spring member 18.

Figure 24A:
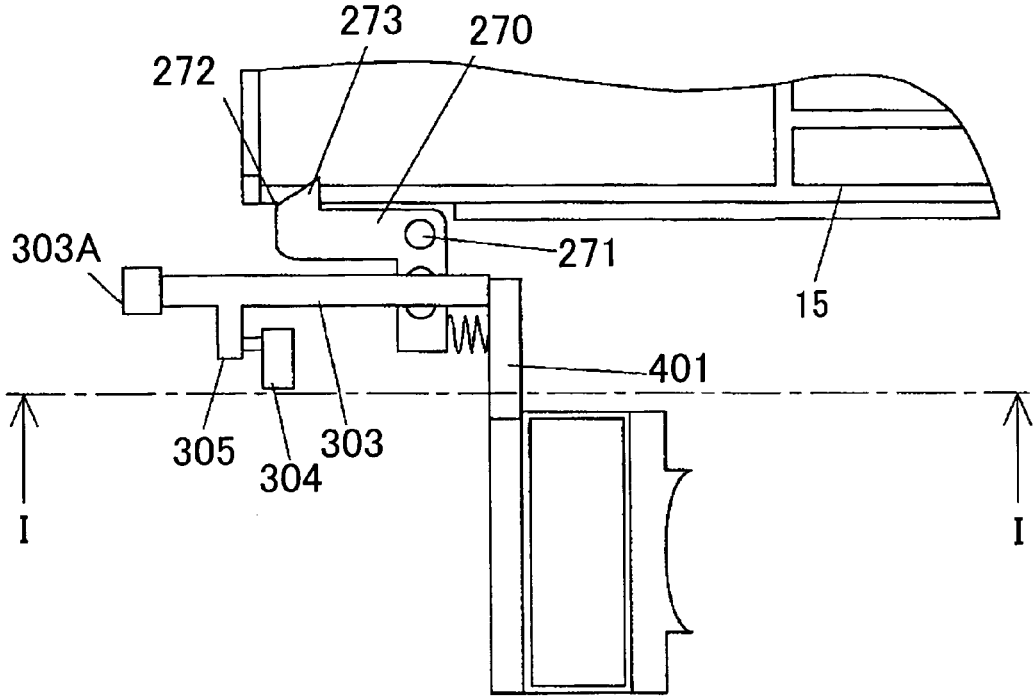
FIG. 24A is a plan view illustrating a part of the image recording device when the cassette eject button is pressed with the stopper being in the lock position.
Figure 24B:
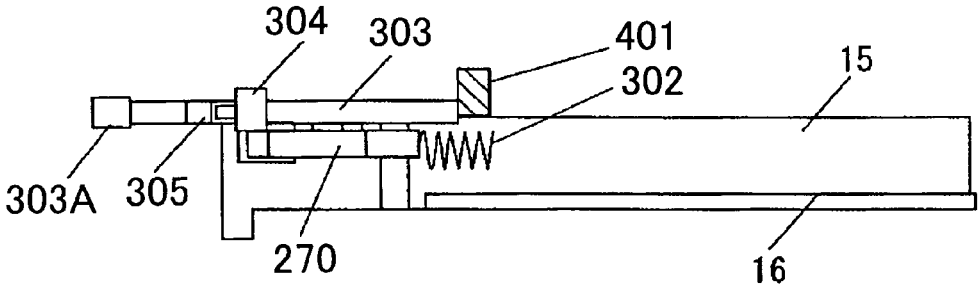
FIG. 24B is a cross-sectional view taken along line I—I in FIG. 24A.

While a print operation is being performed on the recording paper 50, the stopper 401 is set in the lock position where it is in contact with the cassette eject rod 303. FIG. 24 illustrates the stopper 401 being in the lock position. In this state, the movement of the cassette eject rod 303 is restricted even if the cassette eject rod 303 is pushed in, whereby the input paper cassette 15 is prevented from being ejected during a print operation.

Figure 25:
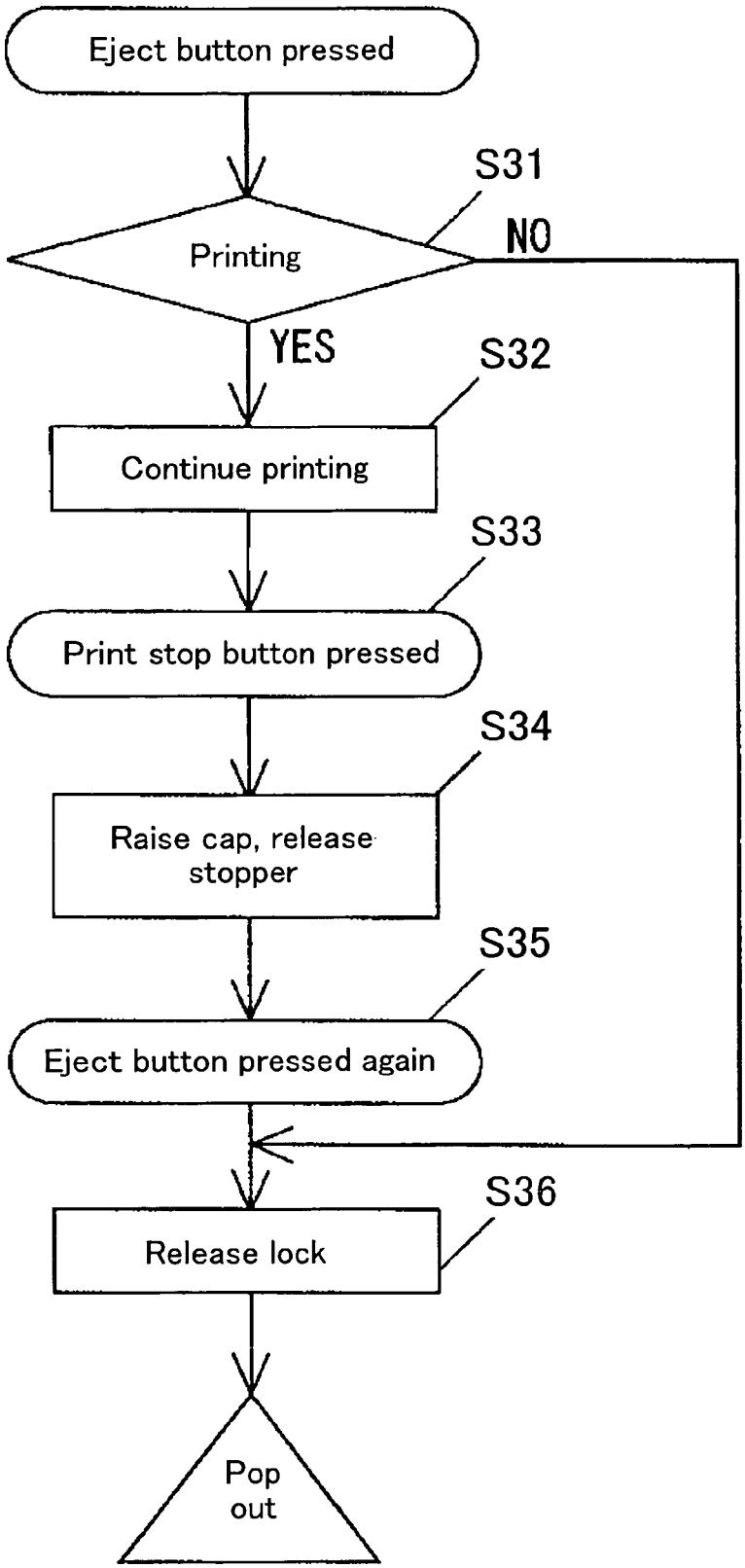
FIG. 25 is a flow chart illustrating a print operation routine.

FIG. 25 is a flow chart illustrating a print operation routine performed in the image recording device of the present embodiment. As described above, the stopper 401 is set in the lock position while an image is being printed on the recording paper 50. During a print operation, even if the cassette eject button 303A is pushed, the print operation is continued (steps S31 and S32). When the print operation is finished or a print stop button is operated (step S33), the process proceeds to step S34 to move the cap 309 up and move the stopper 401 into the retracted position. In this state, if the cassette eject button 303A is pushed in again, the locking tongue 273 is disengaged from the mating groove 272 to release the lock, whereby the input paper cassette 15 pops out in the forward direction from the printer assembly 1 due to the spring force (steps S35 and S36).

Embodiment 8

Figure 26:
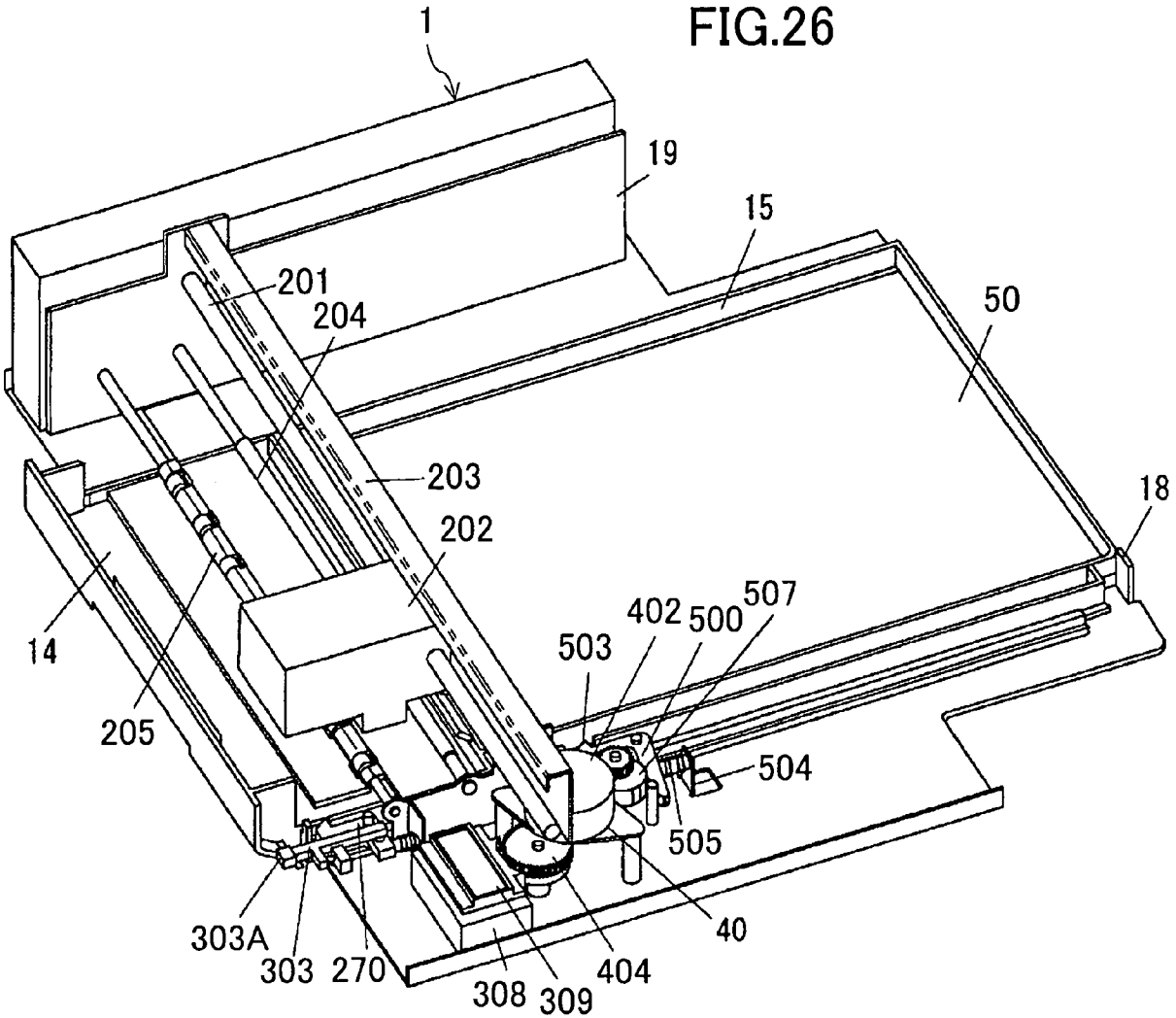
FIG. 26 is a perspective view illustrating the internal structure of an image recording device of Embodiment 8.
Figure 27:
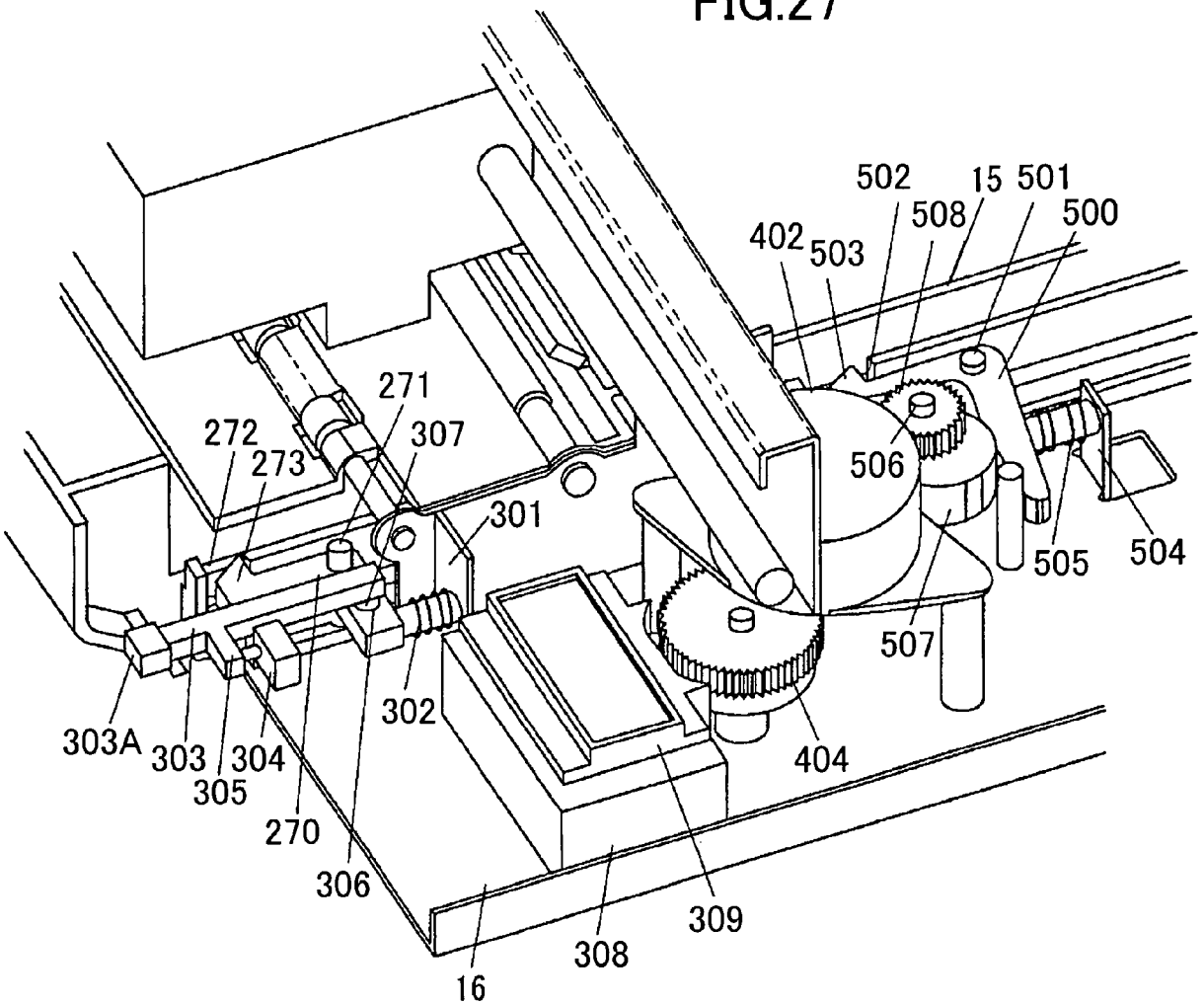
FIG. 27 is an enlarged partial perspective view of FIG. 26.

As in Embodiment 7, the lock lever 270 as a main lock lever is pivotally attached to the pin 271, which is fixed to the bottom plate 16 of the printer assembly 1, as illustrated in FIG. 26 and FIG. 27. The locking tongue 273 that engages with the mating groove 272 formed in the input paper cassette 15 is provided at the tip of the main lock lever 270. The base portion of the lock lever 270 is bent to be substantially perpendicular to the tip portion thereof, and the spring member 302 for applying a spring force to urge the locking tongue 273 toward the mating groove 272 is provided between the base portion and the support bracket 301.

A cassette eject rod 303 is attached to the printer assembly 1 so that it can reciprocate in the front-back direction. The cassette eject button 303A is provided at the tip of the rod, and the cassette eject button 303A is protruding from the front surface of the printer assembly 1 as illustrated in FIG. 1 and FIG. 2. As illustrated in FIG. 27, the cassette eject rod 303 is provided with the protruding portion 307 that engages with the elongate aperture 306 formed in the base portion of the main lock lever 270. When the cassette eject button 303A is pushed in, the main lock lever 270 pivots against the spring force of the spring member 302 in such a direction that the locking tongue 273 is disengaged from the mating groove 272. As the engagement between the locking tongue 273 and the mating groove 272 is released, the input paper cassette 15 pops out in the forward direction from the printer assembly 1 by a predetermined stroke, as illustrated in FIG. 2, due to the spring force of the spring member 18.

While the stopper 401 is provided so as to prevent the cassette eject rod 303 from being operated during a print operation in the image recording device of Embodiment 7 described above, the stopper 401 is not provided in the image recording device of Embodiment 8. Instead, the bottom plate 16 of the printer assembly 1 is provided with a sub-lock lever 500 for preventing the input paper cassette 15 from popping out during a print operation even if the cassette eject rod 303 is pushed in. The sub-lock lever 500 is pivotally attached to the bottom plate 16 via a pin 501, and a locking tongue 503 that engages with a mating groove 502 of the input paper cassette 15 is provided at the tip thereof. The mating groove 502 is provided rearward of the mating groove 272. The base portion of the sub-lock lever 500 is bent with respect to the tip portion thereof, and a spring member 505 for applying a spring force to urge the locking tongue 503 toward the mating groove 502 is provided between a spring support bracket 504 provided on the bottom plate 16 and the base portion of the sub-lock lever 500.

As illustrated in FIG. 27, an eccentric cam 507 is rotatably attached to a pin 506, which is fixed to the bottom plate 16. A driving gear 508 being integral with the eccentric cam 507 is meshed with the motor gear 403 via an intermediate gear 509, as illustrated in FIG. 28 to FIG. 33. Therefore, as the eccentric cam 507 is pivoted by the motor 402, the sub-lock lever 500 is moved between the lock position where the locking tongue 503 is engaged with the mating groove 502 and the retracted position where the engagement is released.

Figure 28A:
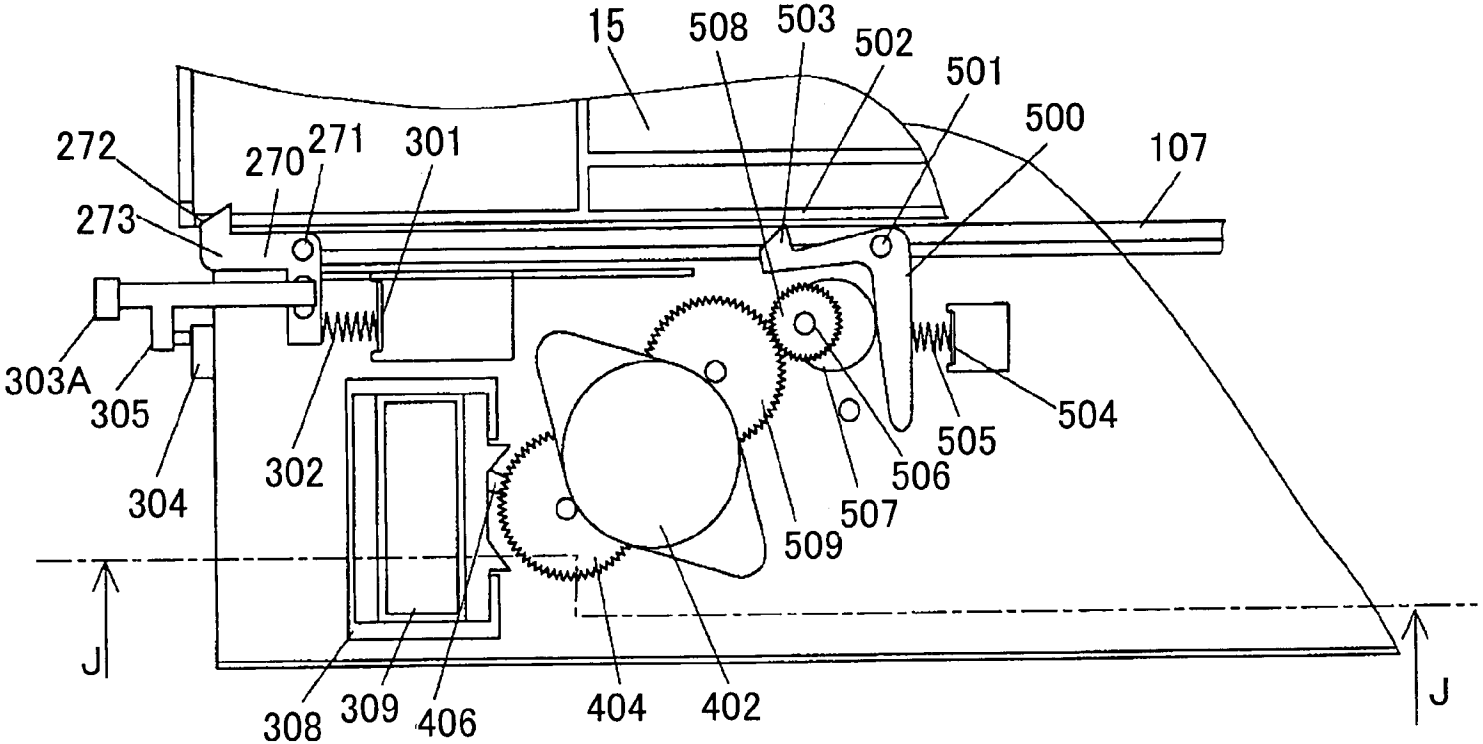
FIG. 28A is a plan view illustrating a part of the image recording device with a sub-lock lever being disengaged.
Figure 28B:
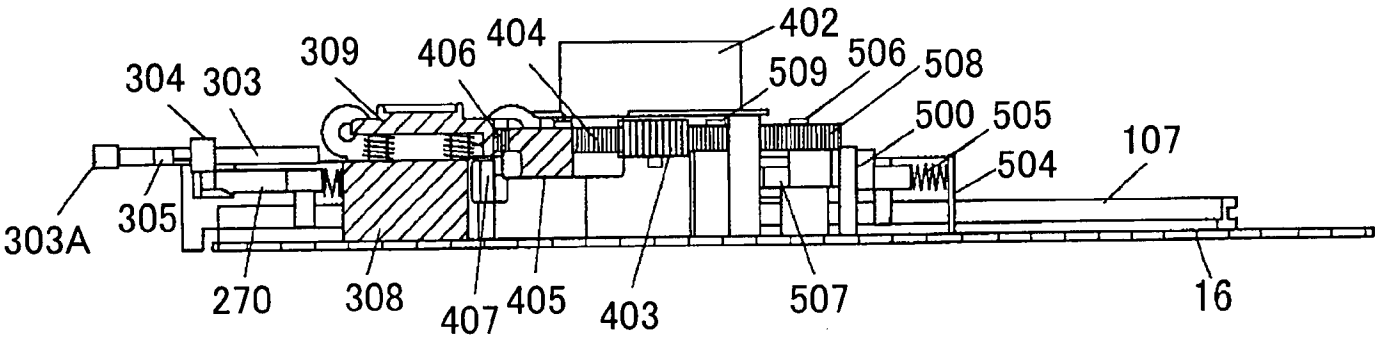
FIG. 28B is a cross-sectional view taken along line J—J in FIG. 28A.
Figure 32:
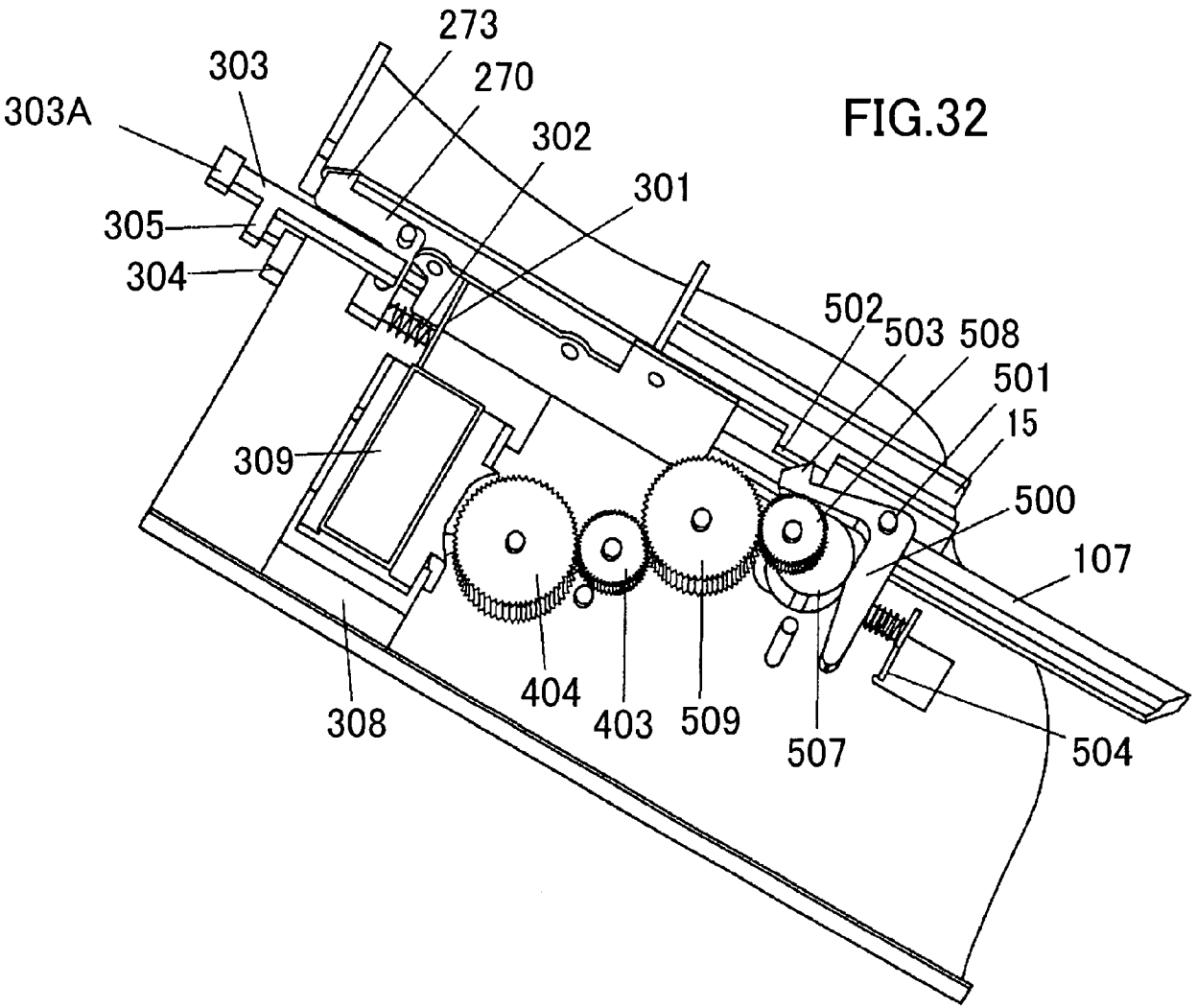
FIG. 32 is a perspective view illustrating a part of the image recording device with the sub-lock lever being disengaged.

FIG. 28 and FIG. 32 illustrate the idle state where a print operation is not performed on the recording paper 50. In this state, the locking tongue 503 of the sub-lock lever 500 is in the retracted position where it is off the mating groove 502 formed in the input paper cassette 15. In the idle state, if the cassette eject button 303A is pushed in, the locking tongue 273 of the main lock lever 270 comes off the mating groove 272 to release the engagement therebetween. Thus, the input paper cassette 15 pops out in the forward direction from the printer assembly 1 due to the biasing force of the spring member 18.

Figure 29A:
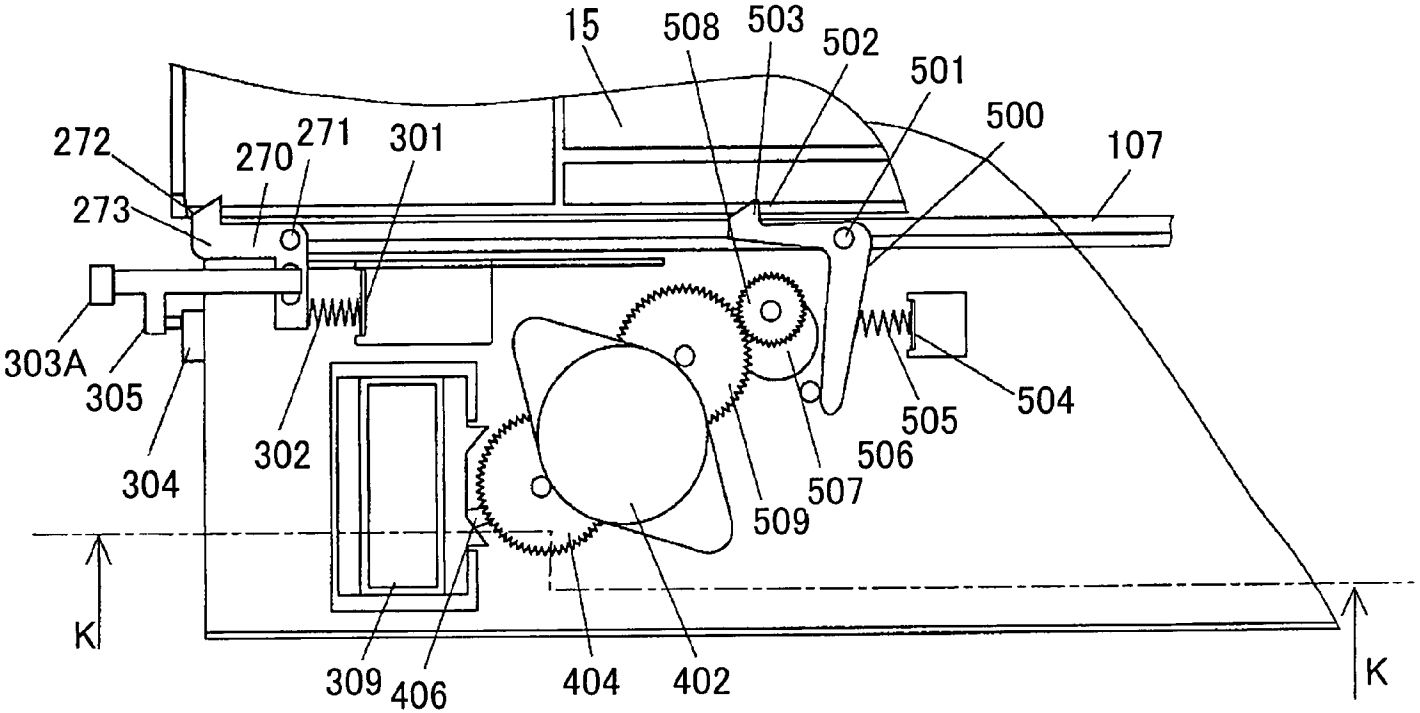
FIG. 29A is a plan view illustrating a part of the image recording device during a print operation.
Figure 29B:
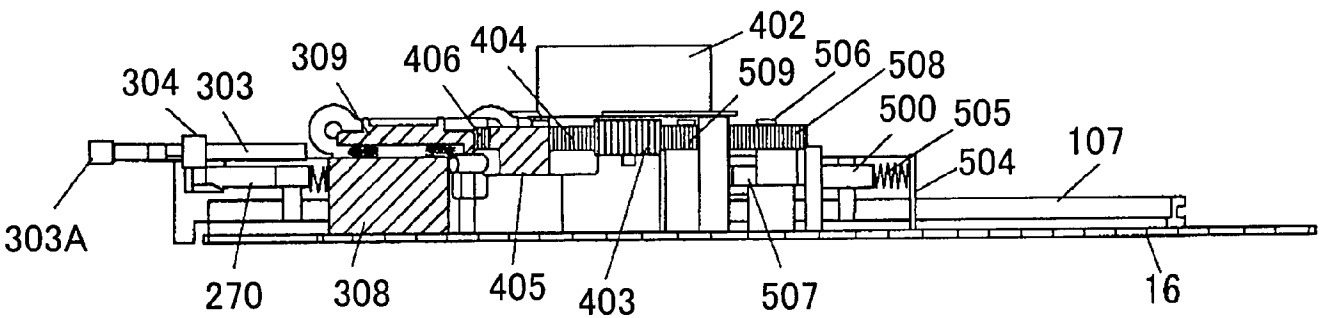
FIG. 29B is a cross-sectional view taken along line K—K in FIG. 29A.
Figure 30A:
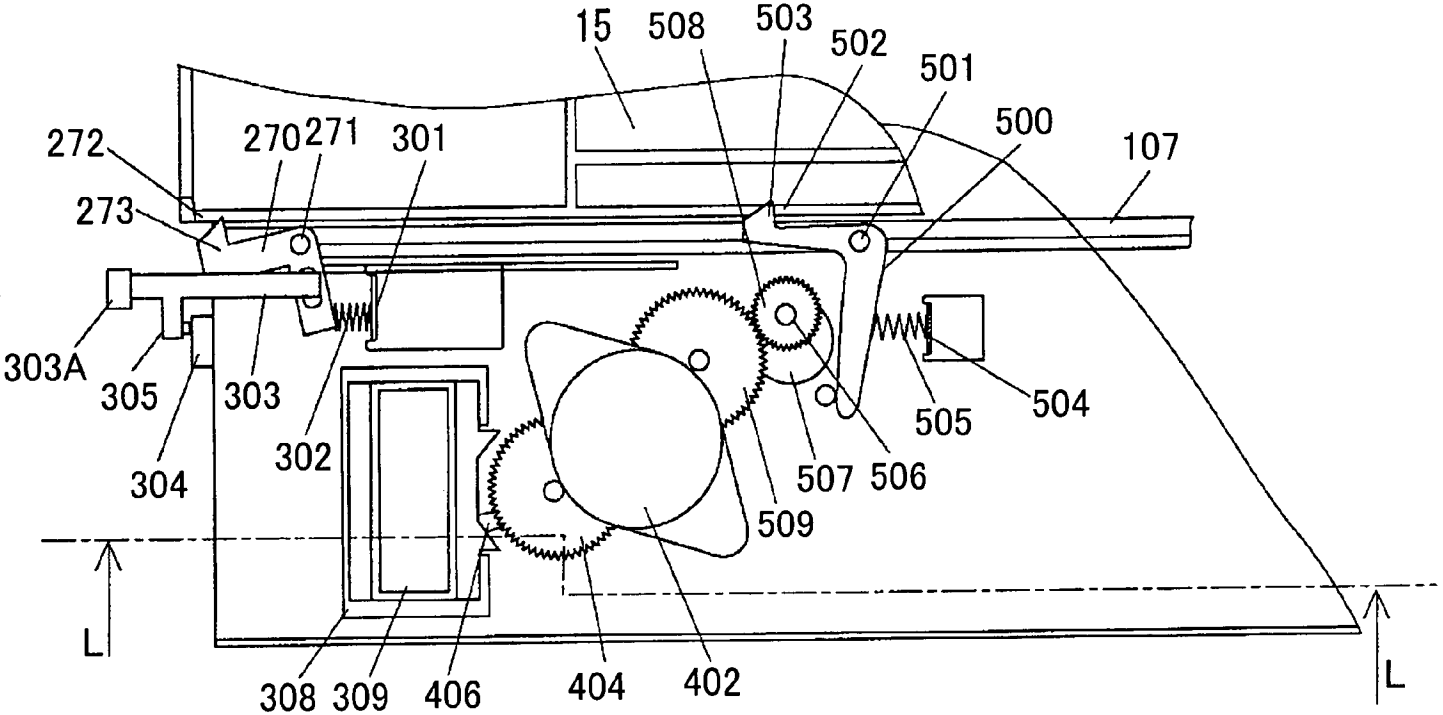
FIG. 30A is a plan view illustrating a part of the image recording device when the cassette eject button is pressed during a print operation.
Figure 30B:
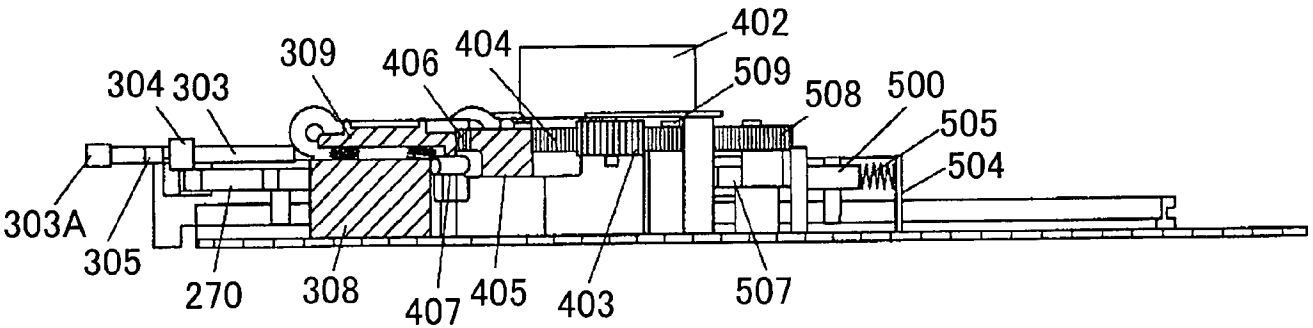
FIG. 30B is a cross-sectional view taken along line L—L in FIG. 30A.
Figure 33:
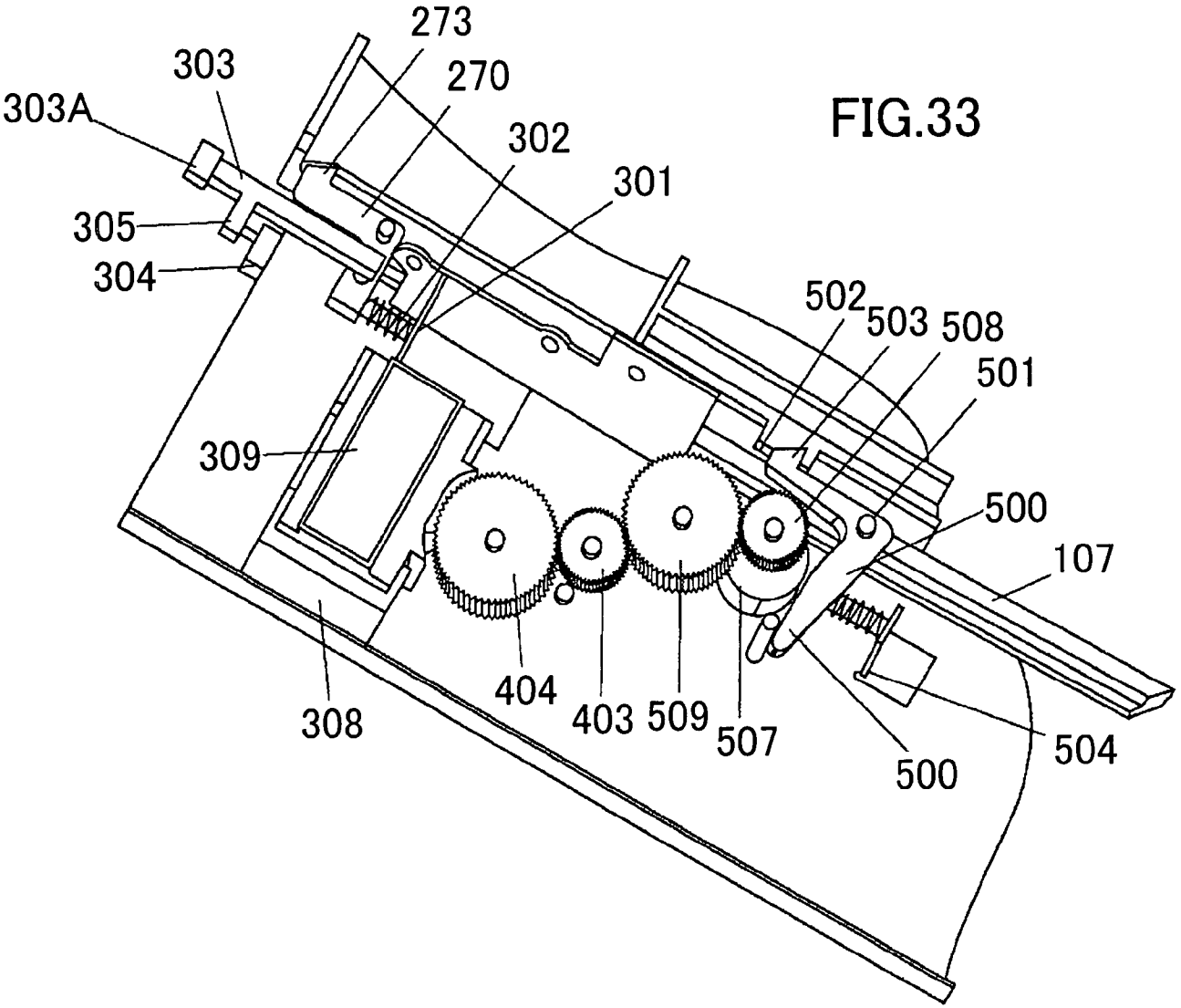
FIG. 33 is a perspective view illustrating a part of the image recording device during a print operation.

While a print operation is being performed on the recording paper 50, the sub-lock lever 500 is driven by the motor 402 into the lock position where the locking tongue 503 thereof is engaged with the mating groove 502. FIG. 29 and FIG. 33 illustrate the sub-lock lever 500 being in the lock position. In this state, even if the cassette eject rod 303 is pushed in so that the locking tongue 273 of the main lock lever 270 comes off the mating groove 272 as illustrated in FIG. 30, the locking tongue 503 of the sub-lock lever 500 is still engaged with the mating groove 502. Thus, during a print operation, the input paper cassette 15 is prevented from popping out in the forward direction from the printer assembly 1.

Figure 31A:
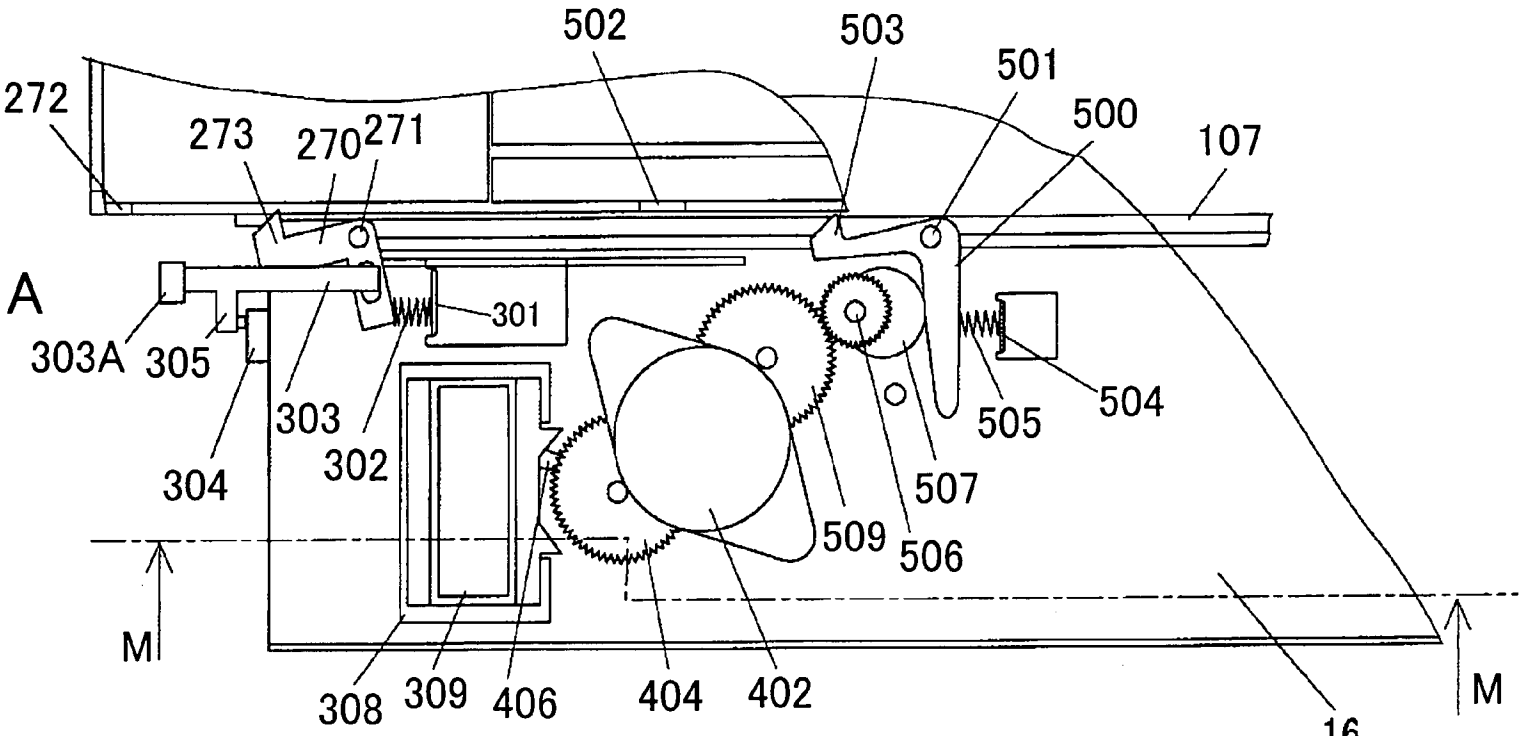
FIG. 31A is a plan view illustrating a part of the image recording device when the cassette eject button is pressed when a print operation is not being performed.
Figure 31B:
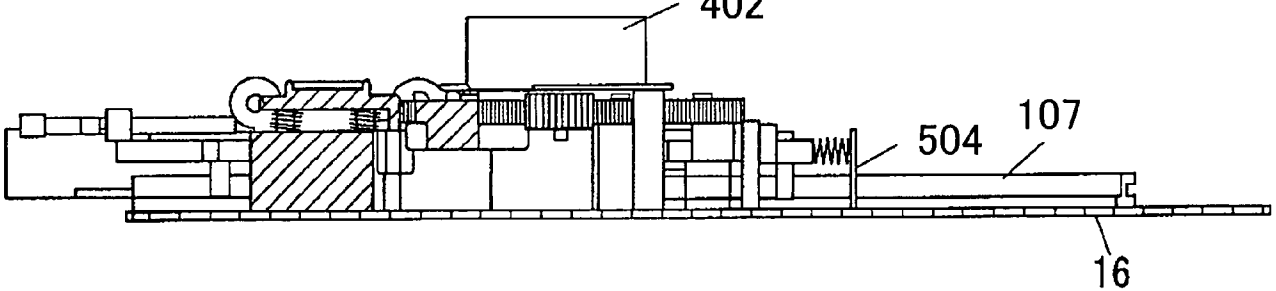
FIG. 31B is a cross-sectional view taken along line M—M in FIG. 31A.

As the eccentric cam 507 is driven by the motor 402 after the print operation is finished, the sub-lock lever 500 is moved into the retracted position as illustrated in FIG. 31, and the input paper cassette 15 pops out in the forward direction from the printer assembly 1 due to the biasing force of the spring member 18.

Figure 34:
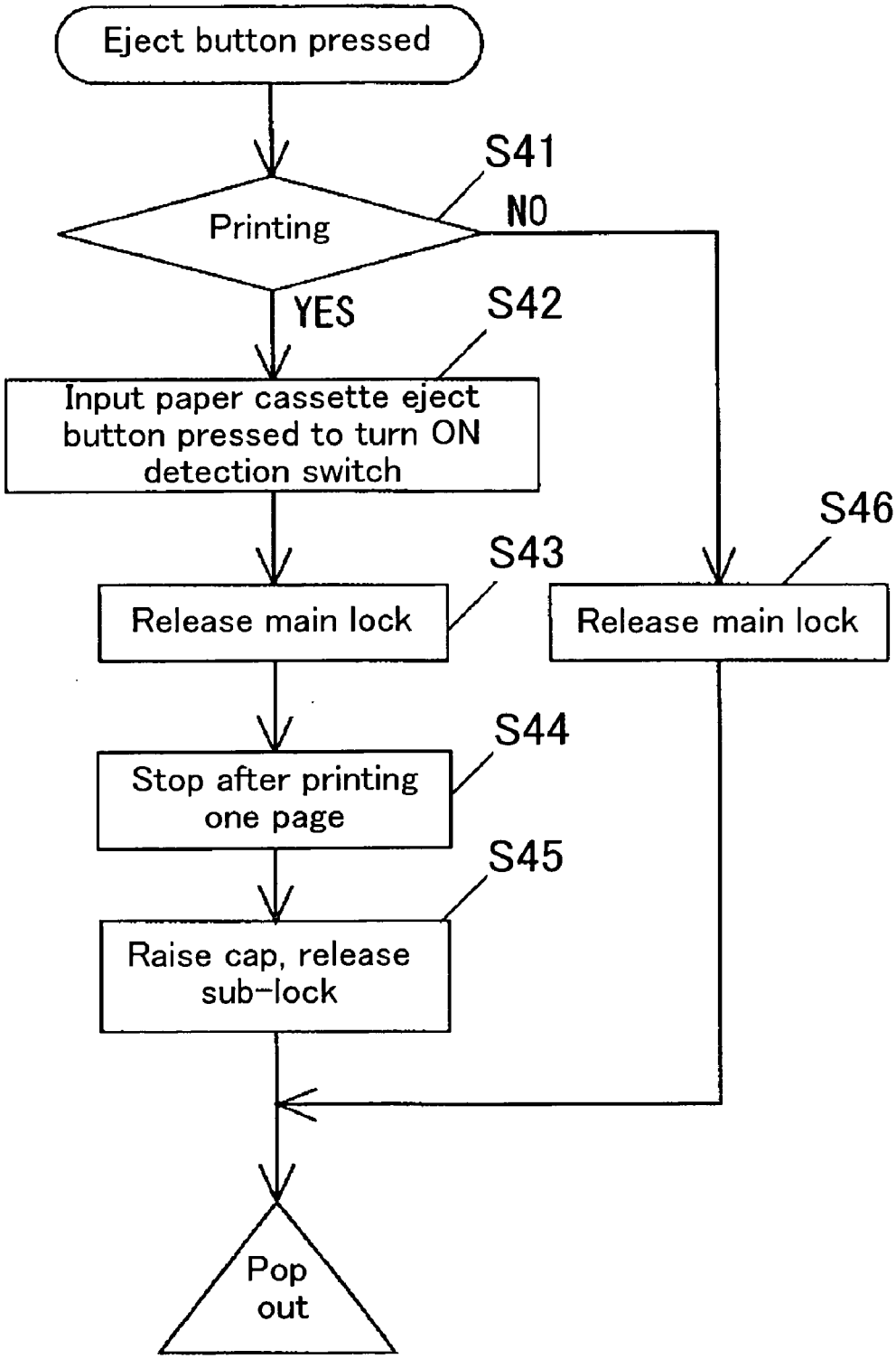
FIG. 34 is a flow chart illustrating a print operation routine.

FIG. 34 is a flow chart illustrating a print operation routine performed in the image recording device of the present embodiment. As described above, the sub-lock lever 500 is set in the lock position while an image is being printed on the recording paper 50. If the cassette eject button 303A is operated to turn ON the detection switch 304 during a print operation (steps S41 and S42), the main lock lever 270 is released, despite which the print operation is continued in step S43. After finishing printing one page, the print operation is stopped in step S44. After the print operation is stopped, the motor 402 is driven to move the cap 309 up, and the sub-lock lever 500 moves into the retracted position to release the lock (step S45). Thus, the input paper cassette 15 pops out in the forward direction. When a print operation is not being performed, the sub-lock lever 500 is in the retracted position. If the cassette eject button 303A is operated in that state, the main lock lever 270 is released in step S46. Thus, the input paper cassette 15 pops out in the forward direction.

Embodiment 9

Figure 35:
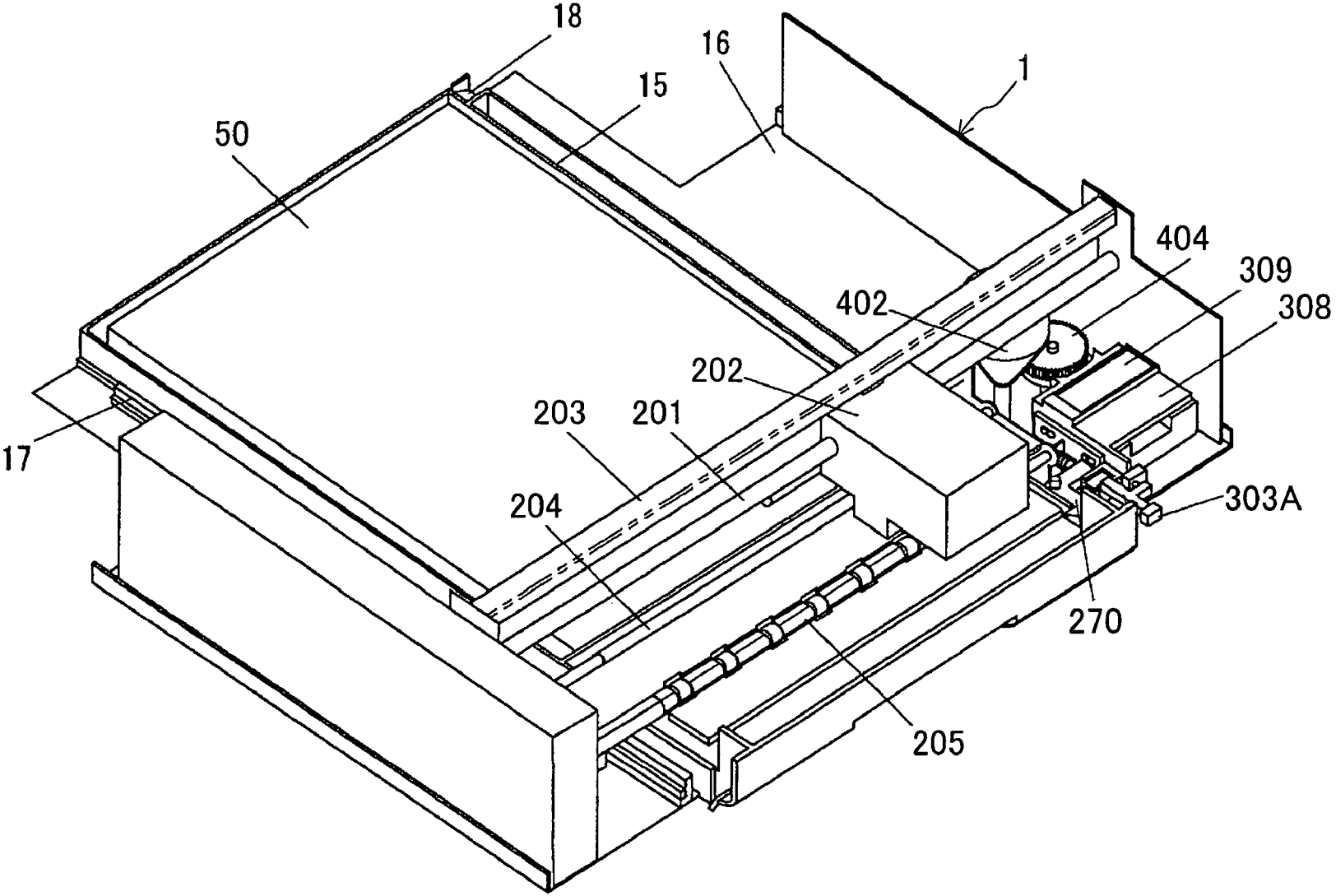
FIG. 35 is a perspective view illustrating the internal structure of an image recording device of Embodiment 9.
Figure 36:
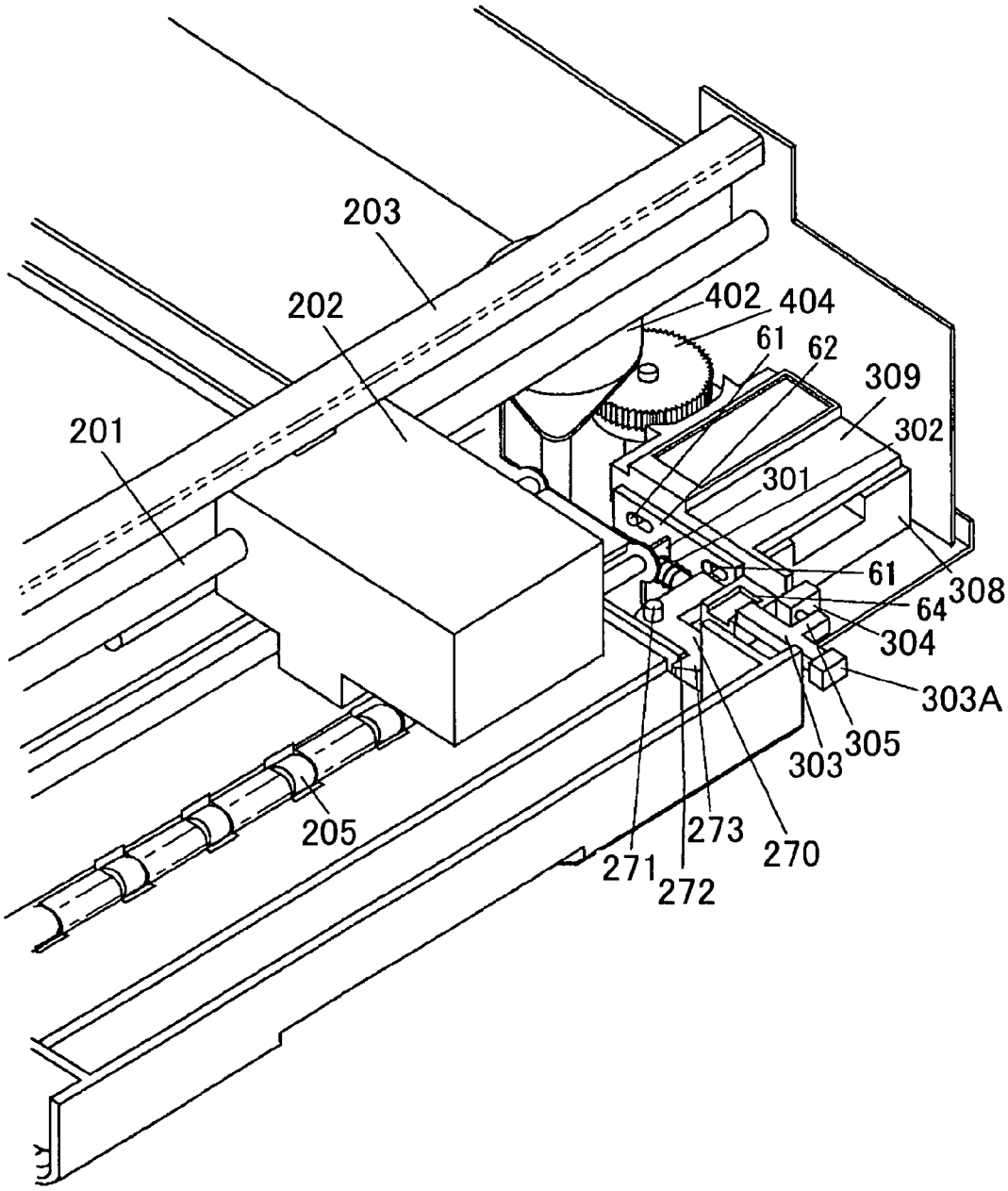
FIG. 36 is an enlarged partial perspective view of FIG. 35.

As in Embodiment 7, the lock lever 270 is pivotally attached to the pin 271, which is fixed to the bottom plate 16 of the printer assembly 1, as illustrated in FIG. 35 and FIG. 36. The locking tongue 273 that engages with the mating groove 272 formed in the input paper cassette 15 is provided at the tip of the lock lever 270. The base portion of the lock lever 270 is bent to be substantially perpendicular to the tip portion thereof, and the spring member 302 for applying a spring force to urge the locking tongue 273 toward the mating groove 272 is provided between the base portion and the support bracket 301.

As illustrated in FIG. 36, two pins 61 are protruding toward the input paper cassette 15 from the cap 309, which is provided on the base 308 fixed to the bottom plate 16 so that it can move up and down, and which is moved up and down by the motor 402. Elongate apertures 63 formed in a joint 62 are engaged with these pins 61. Each elongate aperture 63 extends in the same direction as does the cassette eject rod 303, and the joint 62 can move in the same direction as does the cassette eject rod 303. A connector member 64 provided between the cassette eject rod 303 and the base portion of the lock lever 270 is fixed to the joint 62. The connector member 64 is placed in the connecting position where it transmits the movement of the cassette eject rod 303 to the lock lever 270 when the cap 309 moves up, and into the retracted position where the connection between the cassette eject rod 303 and the lock lever 270 is released when the cap 309 moves down.

Figure 37A:
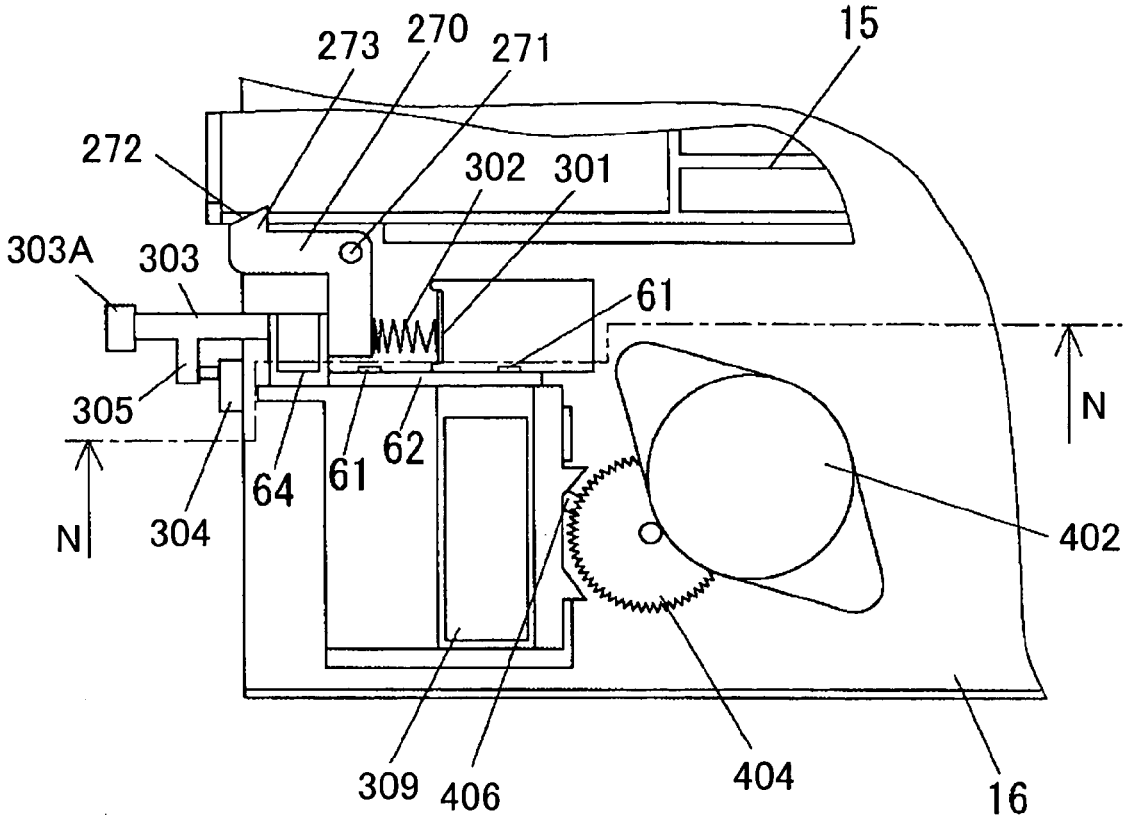
FIG. 37A is a plan view illustrating a part of the image recording device in a state where a connector member is in a connecting position.
Figure 37B:
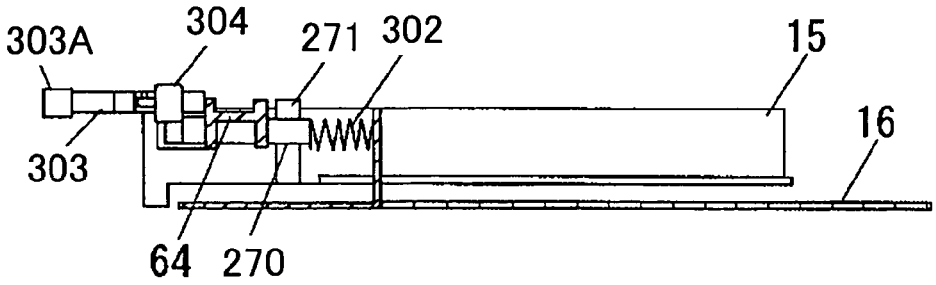
FIG. 37B is a cross-sectional view taken along line N—N in FIG. 37A.
Figure 38A:
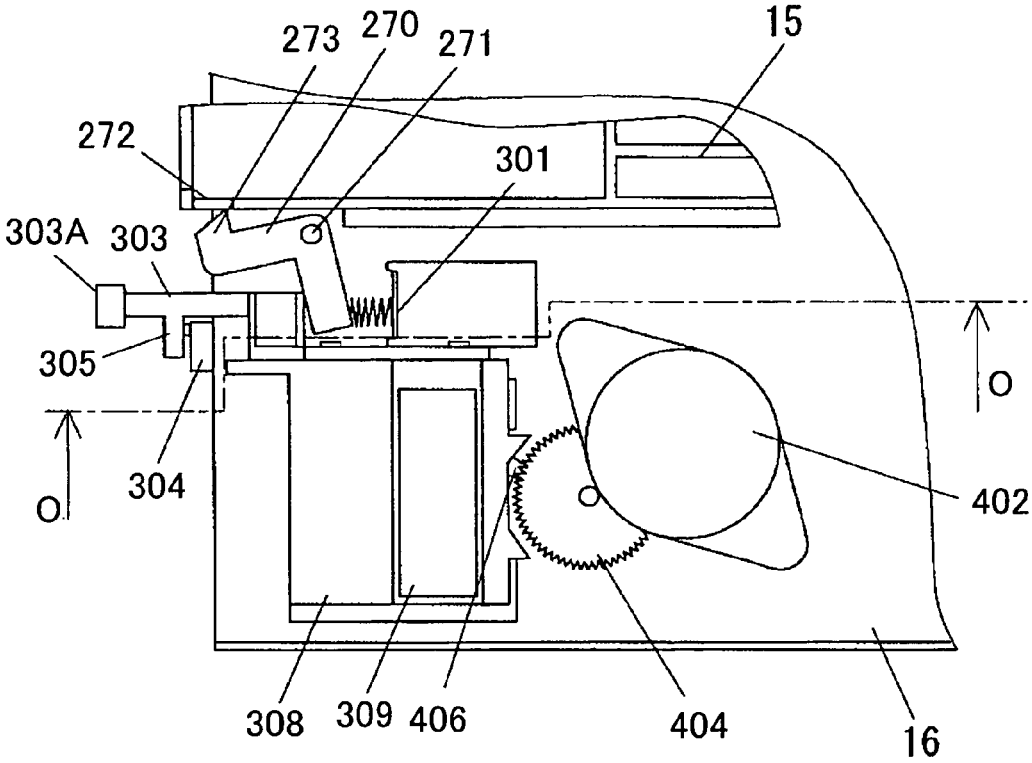
FIG. 38A is a plan view illustrating a part of the image recording device in a state where the cassette eject button is pressed while the connector member is in the connecting position.
Figure 38B:
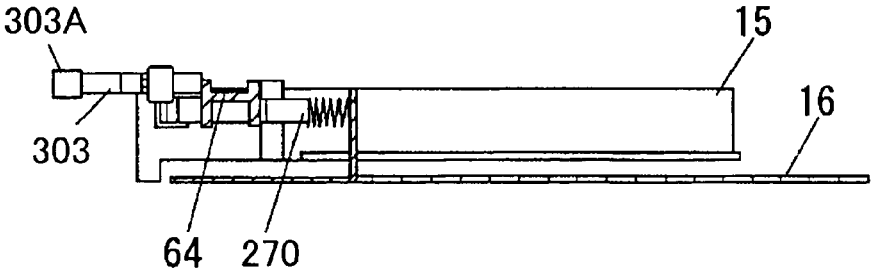
FIG. 38B is a cross-sectional view taken along line O—O in FIG. 38A.
Figure 39A:
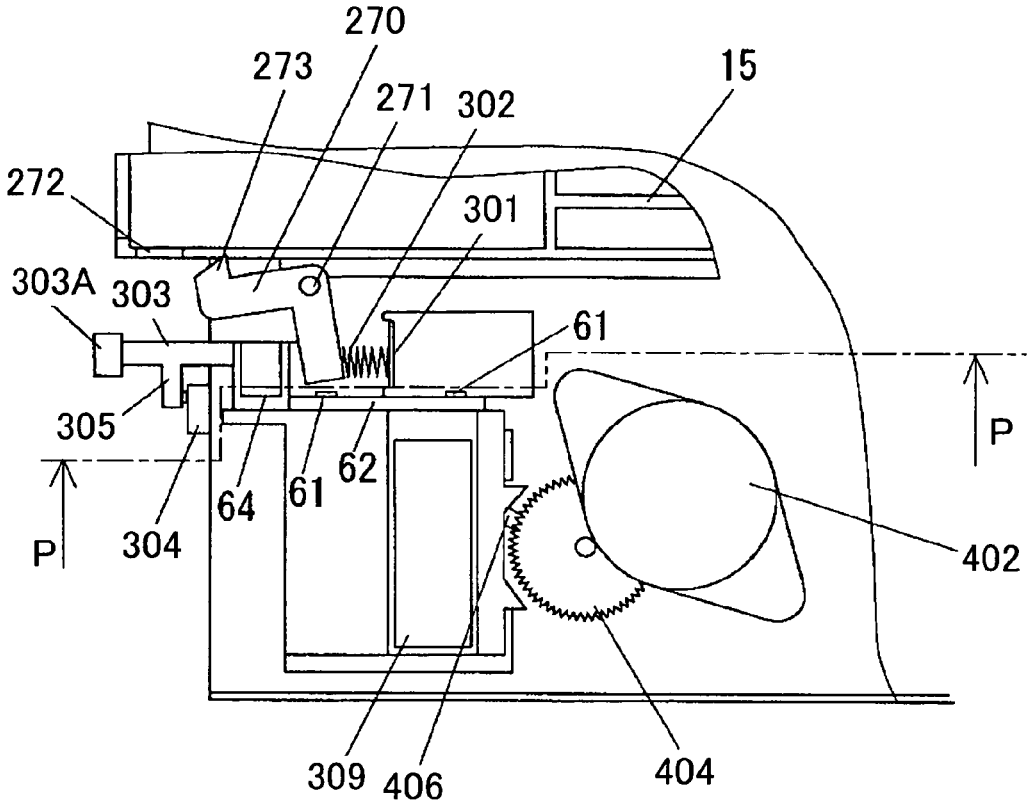
FIG. 39A is a plan view illustrating a part of the image recording device with the input paper cassette popping out after the cassette eject button is operated.
Figure 39B:
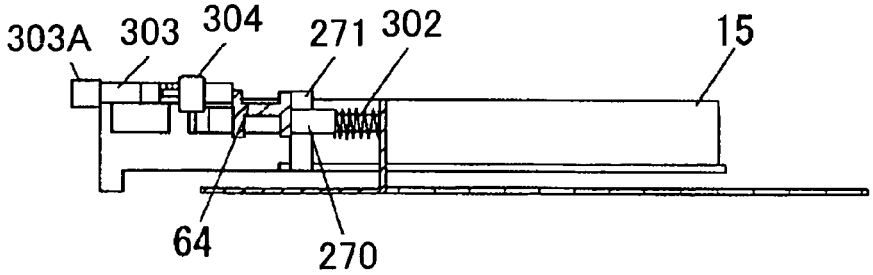
FIG. 39B is a cross-sectional view taken along line P—P in FIG. 39A.

Therefore, as illustrated in FIG. 37, in the idle state in which a print operation is not being performed on the recording paper 50, the cap 309 is up. Thus, the connector member 64 is in the connecting position where it is inserted between the rear end surface of the cassette eject rod 303 and the base portion of the lock lever 270. In this state, if the cassette eject button 303A is pushed in so as to eject the input paper cassette 15, the locking tongue 273 of the lock lever 270 comes apart from the mating groove 272 to release the lock of the input paper cassette 15, as illustrated in FIG. 38, since the connector member 64 is fixed to the joint 62, which moves in the same direction as does the cassette eject rod 303. Thus, the input paper cassette 15 pops out in the forward direction from the printer assembly 1 due to the biasing force of the spring member 18 as illustrated in FIG. 39.

Figure 40A:
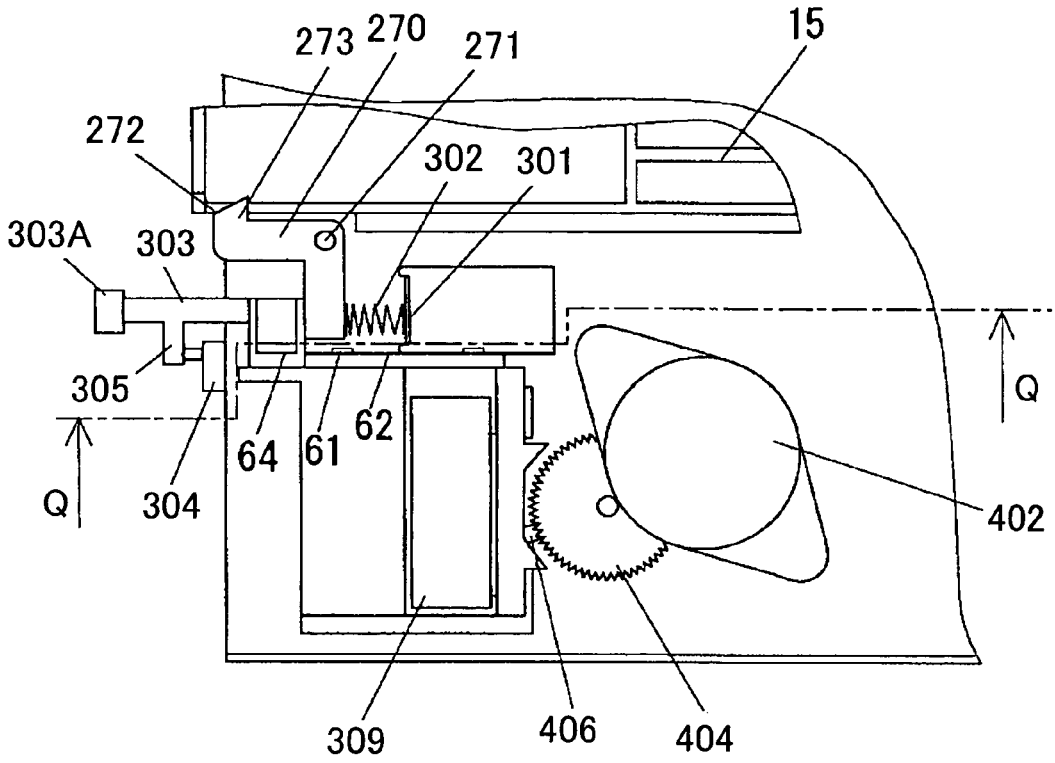
FIG. 40A is a plan view illustrating a part of the image recording device during a print operation.
Figure 40B:
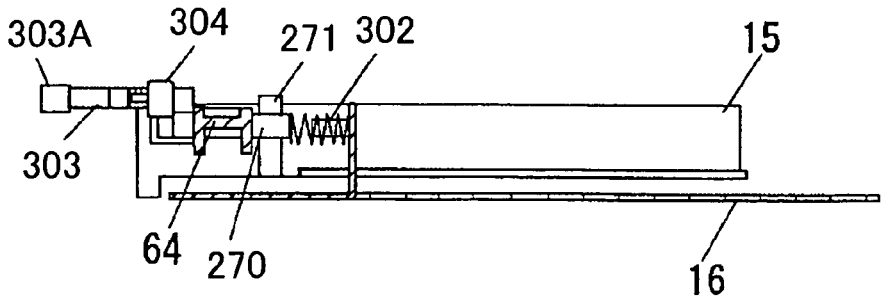
FIG. 40B is a cross-sectional view taken along line Q—Q in FIG. 40A.
Figure 41A:
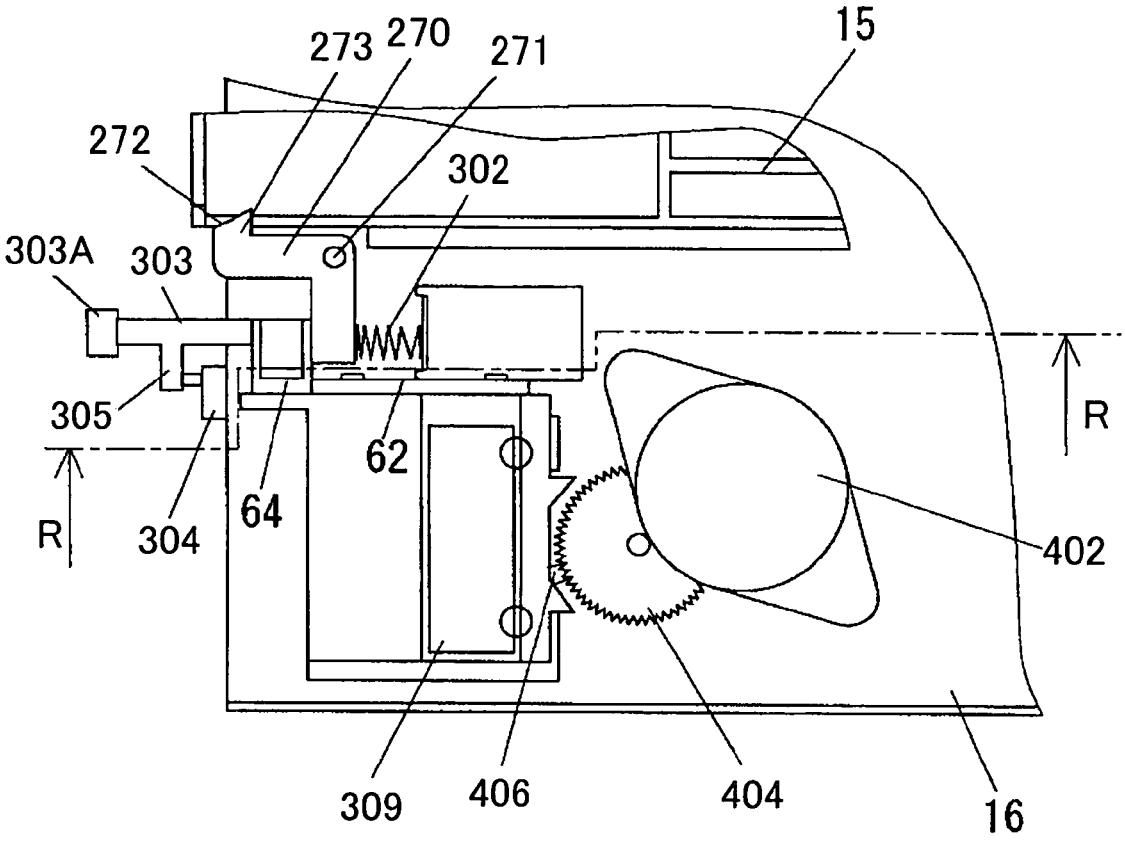
FIG. 41A is a plan view illustrating a part of the image recording device when the cassette eject button is operated during a print operation.
Figure 41B:
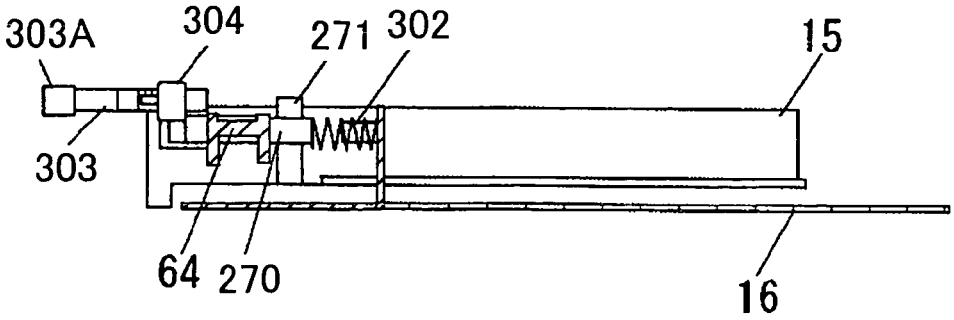
FIG. 41B is a cross-sectional view taken along line R—R in FIG. 41A.

While a print operation is being performed on the recording paper 50, the cap 309 is placed at its lower limit position by the motor 402 as illustrated in FIG. 40. In this state, the connector member 64 is in the retracted position where it is away from between the cassette eject rod 303 and the lock lever 270. Therefore, even if the cassette eject rod 303 is pushed in as illustrated in FIG. 41 in this state, the cassette eject rod 303 will merely be moved without hitting anything. Since the cassette eject rod 303 does not contact the lock lever 270, the input paper cassette 15 remains locked. Thus, during a print operation, the input paper cassette 15 is prevented from protruding in the forward direction from the printer assembly.

Figure 42:
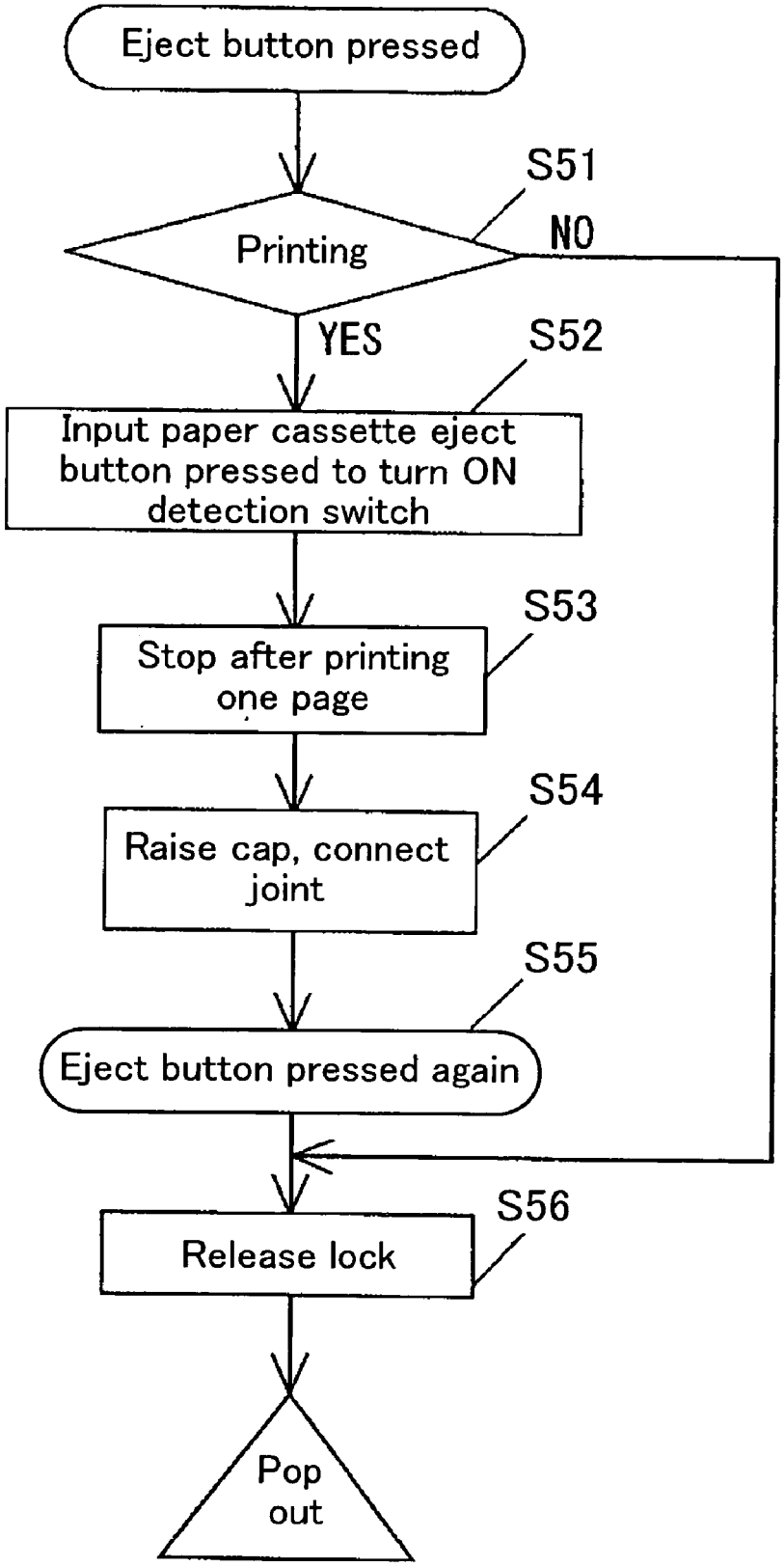
FIG. 42 is a flow chart illustrating a print operation routine.

FIG. 42 is a flow chart illustrating a print operation routine performed in the image recording device of the present embodiment. As described above, the lock lever 270 is engaged with the mating groove 272 and the connector member 64 is set in the retracted position while an image is being printed on the recording paper 50. When the cassette eject button 303A is pressed while a print operation is being performed, the connector member 64 is in the retracted position, whereby the lock lever 270 is not driven, and the detection switch 304 is turned ON (steps S51 and S52), but the print operation is continued. After finishing printing one page, the print operation is stopped in step S53. After the print operation is stopped, the motor 402 is driven to move the cap 309 up, and the connector member 64 is set in the connecting position (step S54). In this state, if the cassette eject button 303A is pushed in again (step S55), the cassette eject rod 303 pivots the lock lever 270 via the connector member 64, and the locking tongue 273 of the lock lever 270 comes off the mating groove 272 to release the lock (step S56). Thus, the input paper cassette 15 pops out in the forward direction.

Embodiment 10

Figure 43B:
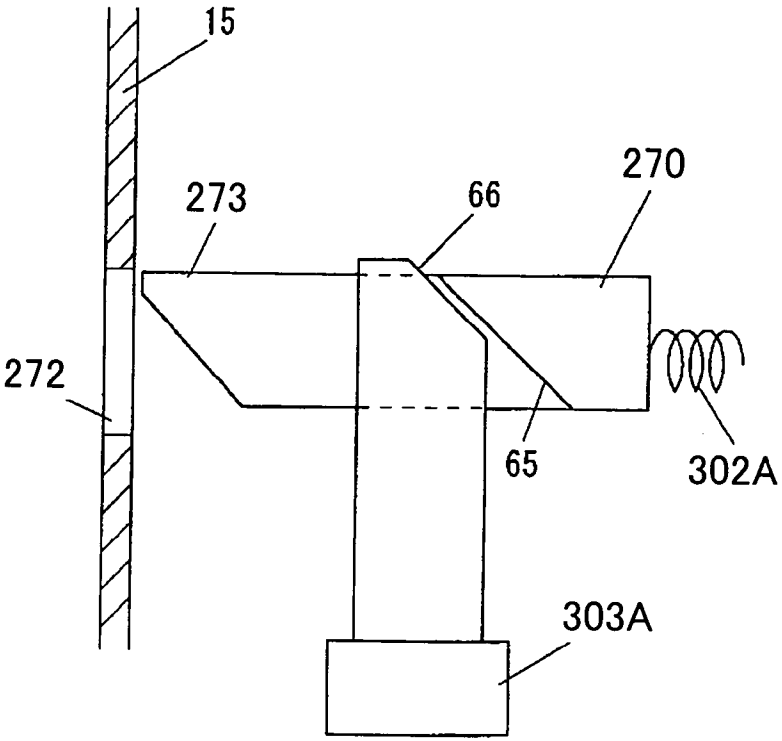
FIG. 43B is a plan view illustrating the lock lever having been moved by the cassette eject button.
Figure 43A:
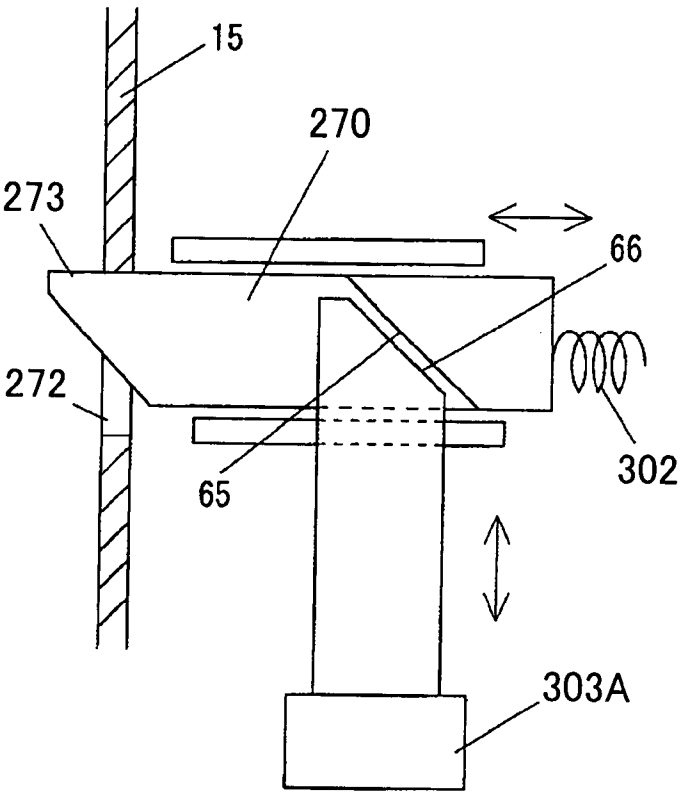
FIG. 43A is a plan view illustrating a lock lever in the stand-by state in an image recording device of Embodiment 10.

FIG. 43A is a plan view illustrating the lock lever in the image recording device of Embodiment 10 of the present invention being in the stand-by state, and FIG. 43B is a plan view illustrating the lock lever of FIG. 43A having been moved by the cassette eject button. In the embodiments described above, the lock lever 270 pivots about the pin 271. In the present embodiment, the lock lever 270 is provided in the printer assembly 1 so that it can linearly reciprocate. In order to convert the linear movement of the cassette eject button 303A into the linear movement of the lock lever 270, the cassette eject button 303A is provided with an inclined surface 66 to be in contact with an inclined surface 65 formed in the lock lever 270. The lock lever 270 is provided with a spring member 302A for applying a spring force to urge the locking tongue 273 at the tip of the lock lever 270 into the mating groove 272. Therefore, when the cassette eject button 303A is pushed in, the lock lever 270 moves away from the mating groove 272 of the input paper cassette 15 as illustrated in FIG. 43B, and when the pushing of the button 303A is released, the lock lever 270 approaches the mating groove 272 due to the spring force as illustrated in FIG. 43A.

Thus, in each printer described above, the input paper cassette 15 is not removed, even if the cassette eject button 303A is operated, while an image is being formed on the recording paper 50, thereby providing an advantageous effect that it is possible to prevent recording paper from getting creased while forming an image thereon and to prevent a paper jam.

Embodiment 11

Figure 44:
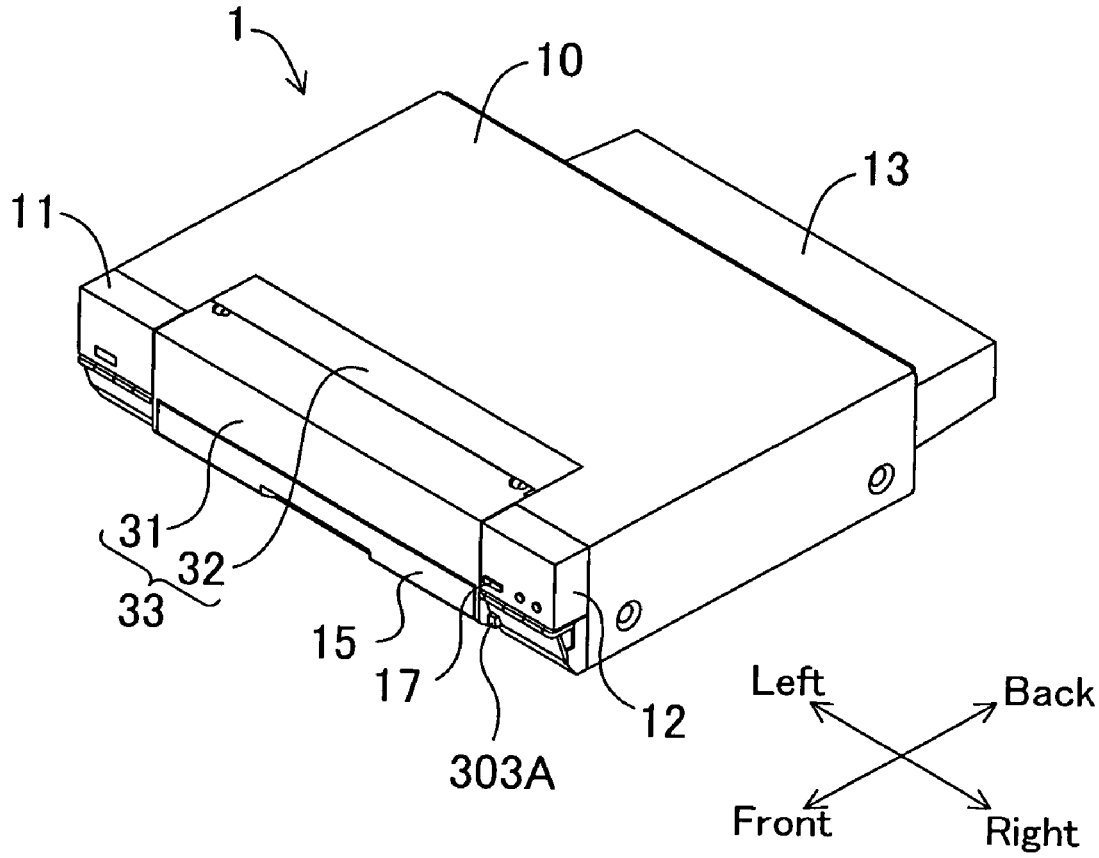
FIG. 44 is a perspective view illustrating a printer of Embodiment 11.
Figure 45:
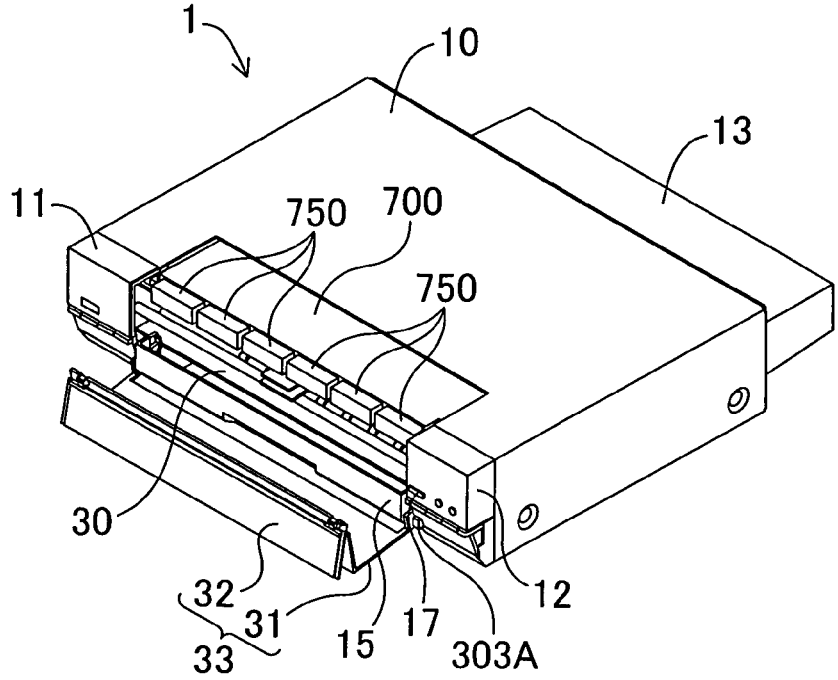
FIG. 45 is a perspective view illustrating the printer with the cover being open and with the cartridge holder being in the home position.
Figure 46:
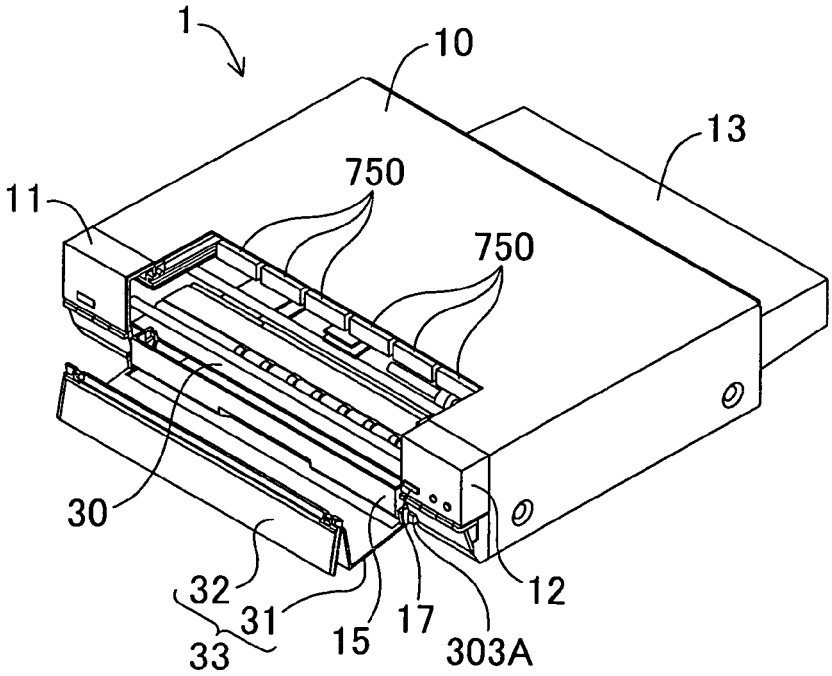
FIG. 46 is a perspective view illustrating the printer with the cover being open and with the cartridge holder being in the retracted position.

As illustrated in FIG. 44 to FIG. 46, a casing 10 of the printer 1 of the present embodiment is slim, and is generally formed in a rectangular parallelepiped shape whose length in the height direction is shorter than the length in the left-right direction and the length in the front-back direction. In the illustrated example, the length in the height direction is less than or equal to ¼ the length in the left-right direction and less than or equal to ⅓ the length in the front-back direction. An opening 30, which is provided for feeding/ejecting of paper, replacement of ink cartridges 750, etc., is formed extending from the front side to the upper side of the casing 10 at the center of the casing 10 in the left-right direction. The cover 33, which covers the opening 30 and which can be opened/closed, is provided on the front surface and the upper surface of the casing 10.

Note that in the following description, a direction perpendicular to the left-right direction of the opening 30 (i.e., the up-down direction and the front-back direction) will be referred to as a "vertical direction".

The left-side operation panel 11 and the right-side operation panel 12 are provided on the left and right, respectively, of the opening 30 on the front surface of the casing 10. The left-side operation panel 11 and the right-side operation panel 12 are provided with operation switches. Note that the cassette eject button 303A for ejecting the input paper cassette 15 in the forward direction and a cartridge holder switch 17 for moving a cartridge holder 700 to be described later are placed on the right-side operation panel 12.

The cover 33 is made up of a front cover 31 and a top cover 32 connected together by a hinge mechanism, and is foldable. The front cover 31 is a plate-like member having an L-shaped cross section, and covers the front side and a portion of the upper side of the opening 30. An opening for allowing the input paper cassette 15 to pass therethrough is formed in a lower portion of the front cover 31 so that the input paper cassette 15 can be inserted/removed with the front cover 31 being closed. The top cover 32 is a flat plate-like member and covers a portion of the upper side of the opening 30. The length of the top cover 32 in the vertical direction (the length in the front-back direction) is preferably ⅓ to ⅔, and more preferably ½, the length of the upper surface of the opening 30. This is to minimize the distance by which the cover 33 protrudes upward when the cover 33 is opened/closed. By reducing the distance by which the cover 33 protrudes upward, the printer 1 can be installed in a place where there is not a large space above.

As illustrated in FIG. 45 and FIG. 46, when the cover 33 is opened, the front cover 31 and the top cover 32 are folded together. By folding the top cover 32, it is possible to prevent the cover 33 from blocking the area in front of the opening 30. Thus, with the cover 33 being open, a large space is obtained in front of the opening 30, thereby facilitating the operation of putting a hand into the opening 30 in a jam removal operation, etc.

Figure 47:
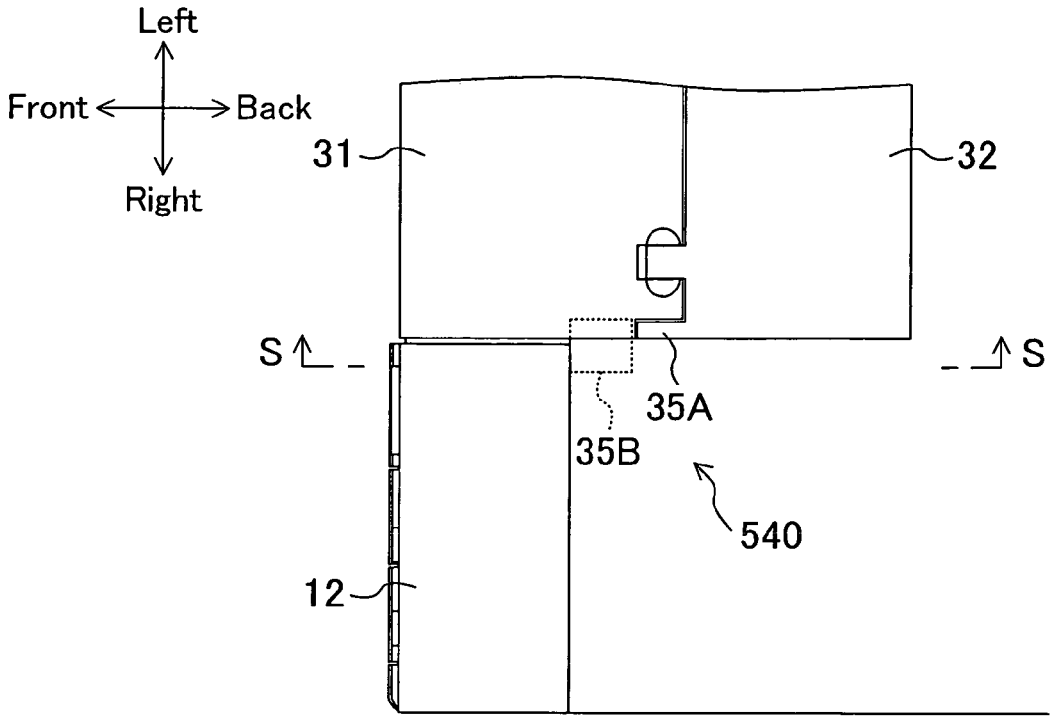
FIG. 47 is a plan view illustrating a right-side portion of the printer.
Figure 48:
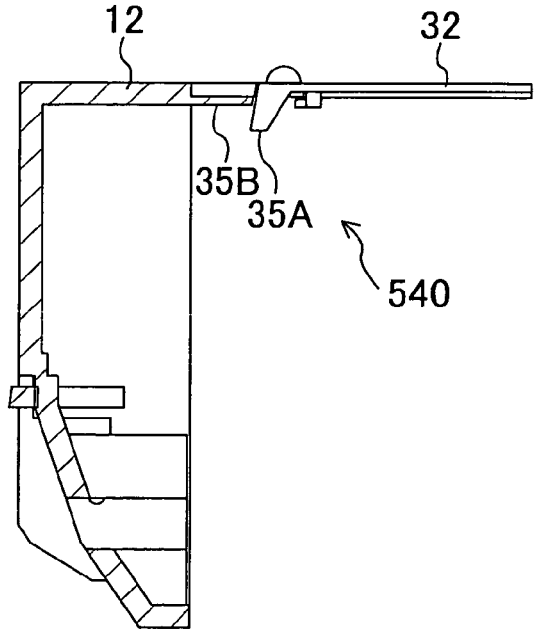
FIG. 48 is a cross-sectional view taken along line S—S in FIG. 47.
Figure 49:
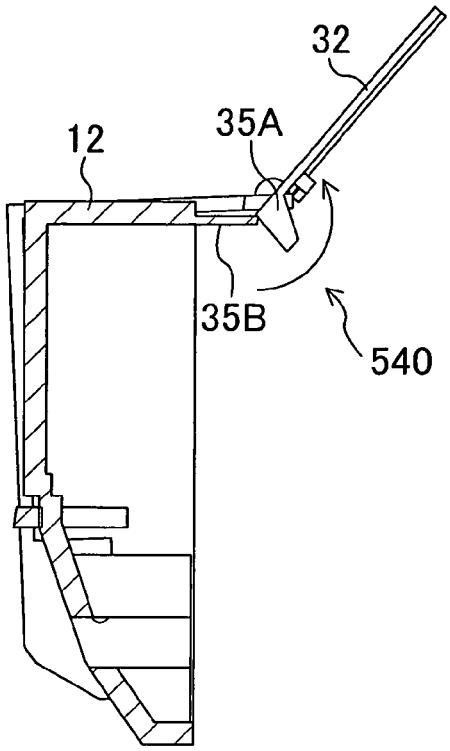
FIG. 49 is a view corresponding to FIG. 48 with the cover being unfolded.
Figure 50:
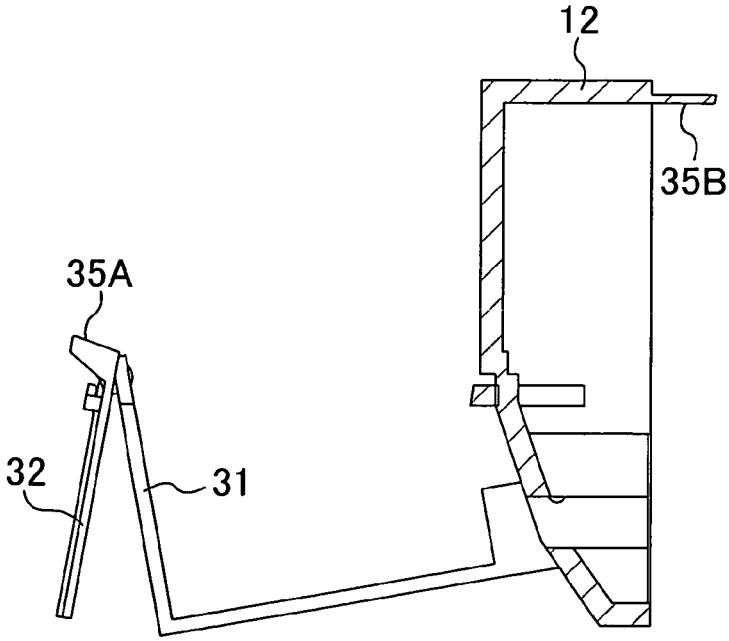
FIG. 50 is a view corresponding to FIG. 48 after the cover has been unfolded.

As illustrated in FIG. 47 and FIG. 48, a protrusion 35A protruding downward is provided on each side of the top cover 32 along the front edge thereof. The left-side operation panel 11 and the right-side operation panel 12 each include a contact portion 35B extending rearward on the upper surface thereof to be in contact with a middle portion of the protrusion 35A in the up-down direction. When opening the cover 33, the contact portions 35B of the panels 11 and 12 push the protrusions 35A of the top cover 32 rearward, whereby a rotation moment in the forward direction is applied to the top cover 32 as illustrated in FIG. 49. As a result, the top cover 32 automatically rotates in the forward direction in an interlocked manner with the opening action of the cover 33. Thus, the cover 33 is folded automatically as the cover 33 is opened (see FIG. 50). The protrusion 35A and the contact portion 35B together form a folding mechanism 540.

Figure 51:
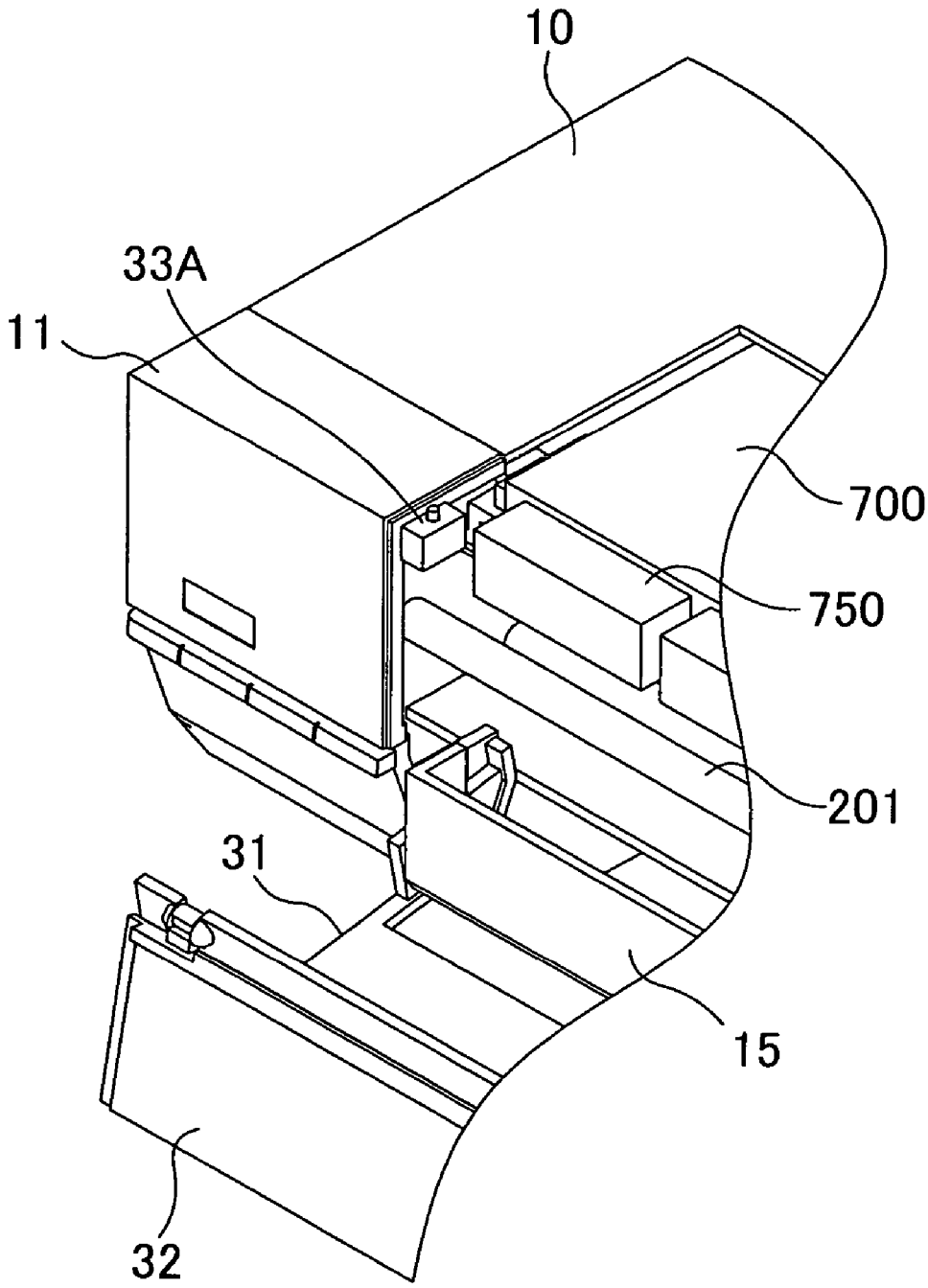
FIG. 51 is an enlarged partial perspective view illustrating the printer with the cover being open.

Note that although not shown in FIG. 45, etc., the printer 1 includes a sensor 33A as a cover detection device for detecting the open/closed state of the cover 33, as illustrated in FIG. 51. Note however that the type of the cover detection device is not limited to any particular type, and the cover detection device may be a detection device well known in the art.

Next, the internal structure of the printer 1 will be described. As illustrated in FIG. 52 to FIG. 59, a recording section 100, the input paper cassette 15 and the ink cartridge holder 700 for holding a plurality of ink cartridges 750 are provided inside the casing 10. The present printer 1 is a so-called "off-carriage type" recording device in which the ink cartridges 750 are placed separately from the carriage 202.

The recording section 100 includes an inkjet recording head 101 (see FIG. 56), a sub-tank 104 for supplying ink to the recording head 101, the carriage 202 carrying the recording head 101 and the sub-tank 104 thereon, and a platen 103 opposing the recording head 101.

Figure 52:
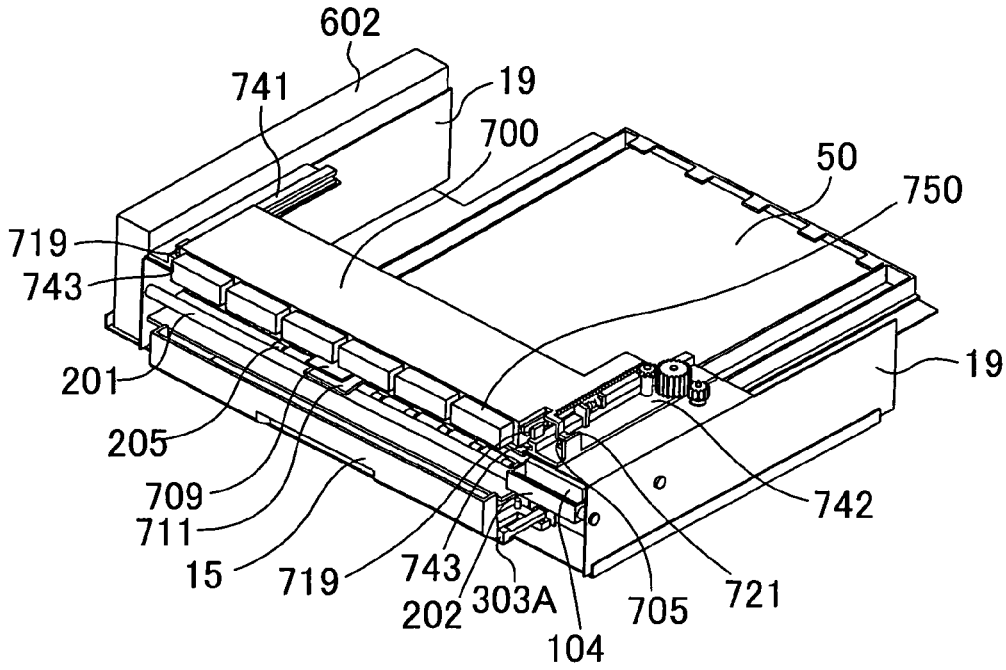
FIG. 52 is a perspective view illustrating the internal structure of the printer with the cartridge holder being in the home position.
Figure 53:
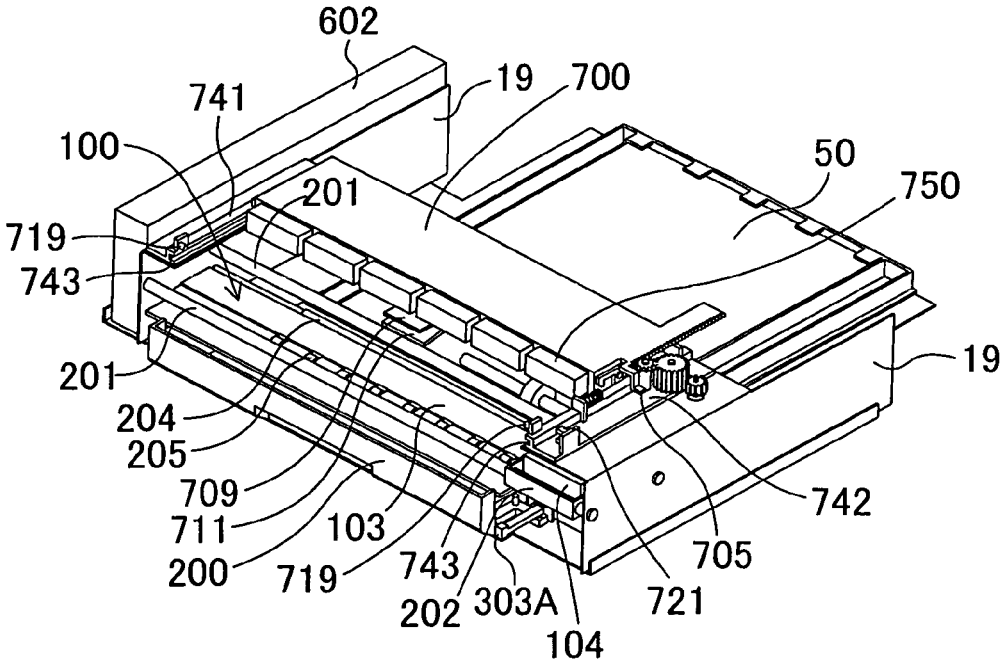
FIG. 53 is a perspective view illustrating the internal structure of the printer with the cartridge holder being in the retracted position.
Figure 54:
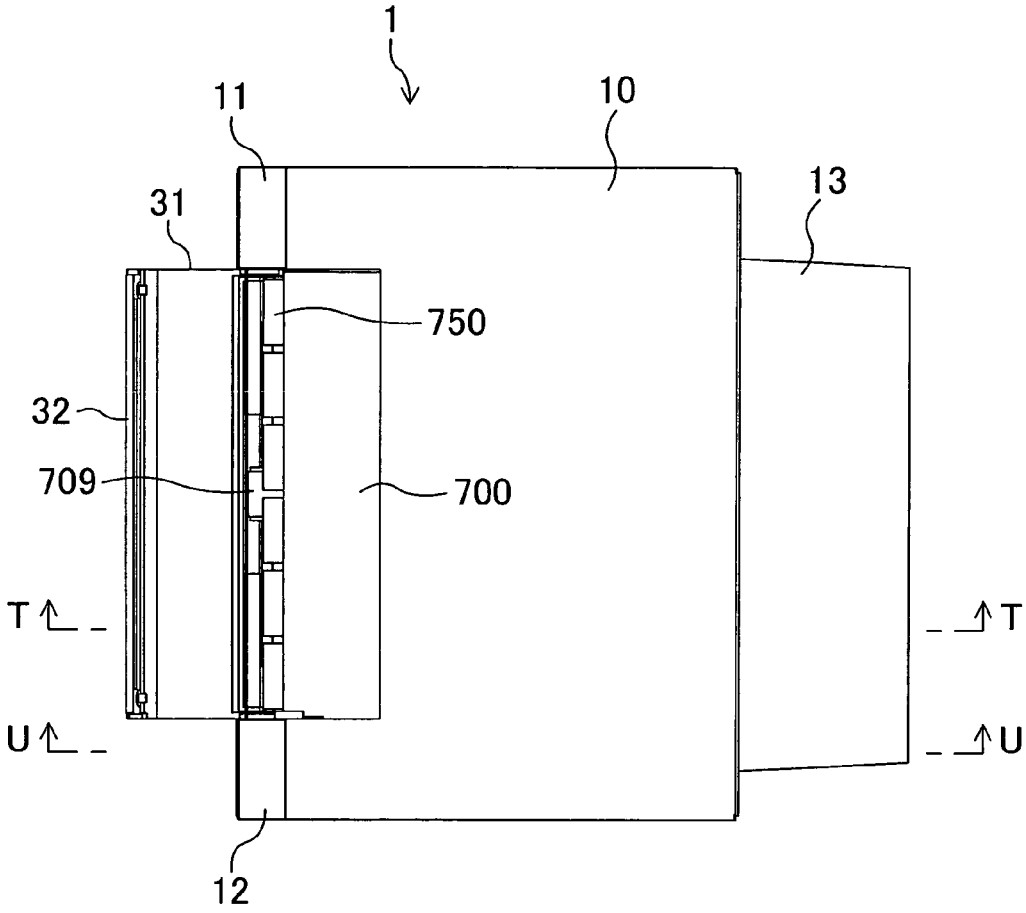
FIG. 54 is a plan view illustrating the printer with the cartridge holder being in the home position.

As illustrated in FIG. 52 and FIG. 53, the side frames 19 and 19 extending in the front-back direction are provided on the left side and the right side in the casing 10. Two carriage shafts 201 are fixed to near-front-end portions of the side frames 19 and 19, extending in the left-right direction and arranged in the front-back direction with respect to each other. The carriage 202 is provided with a driving mechanism (not shown), and the carriage 202 is reciprocated along the carriage shafts 201 by the driving mechanism.

The side frames 19 and 19 form a chassis supporting the carriage shafts 201. Note that the term "chassis" herein refers to a member serving as a base for securing a power source such as a motor, a member serving as a base for supporting power transmission means such as a gear, a pulley and a roller, or a member serving as a base for supporting a driven member such as a carriage.

Figure 55:
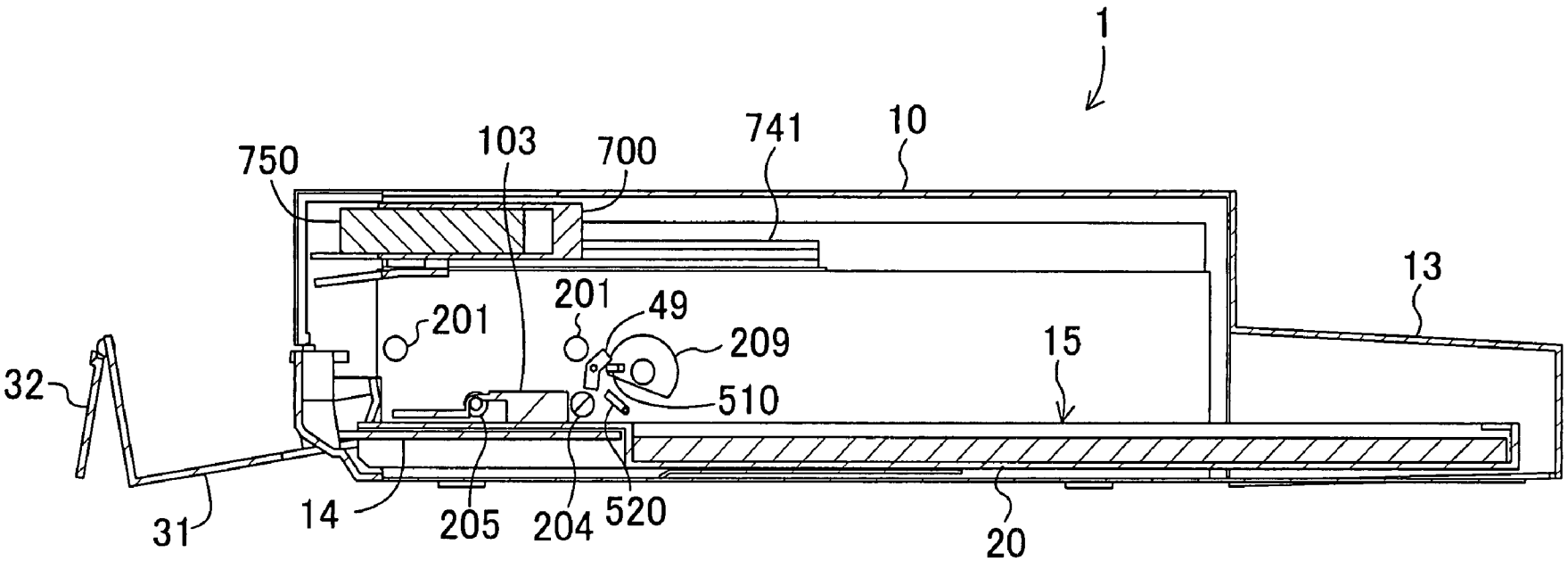
FIG. 55 is a cross-sectional view taken along line T—T in FIG. 54.

As illustrated in FIG. 55, the carrier roller 204 is provided rearward of the platen 103, and the paper eject roller 205 is provided forward of the platen 103. Moreover, a paper feed roller 209 is provided rearward of the carrier roller 204. The recording paper 50 in the input paper cassette 15 is picked up by the paper feed roller 209, and carried by the carrier roller 204 between the recording head 101 and the platen 103. Note that reference numeral 520 denotes a separation pad.

A paper lever 49 and a detection sensor 510 for detecting the rotation of the paper lever 49 are provided between the paper feed roller 209 and the carrier roller 204. As the recording paper 50 starts being carried, the paper lever 49 is subject to a rotational force from the tip of the recording paper 50 and rotates (it rotates in the clockwise direction in FIG. 55). While the recording paper 50 is being carried, the rotated state is maintained. The paper lever 49 is subject to a restoring force from a spring (not shown), and as the rear edge of the recording paper 50 passes, it rotates in the opposite direction (it rotates in the counterclockwise direction in FIG. 55) due to the restoring force from the spring to its original position. The detection sensor 510 is turned ON when the paper lever 49 is in the rotated state and OFF when it returns to the original position. Therefore, the detection sensor 510 is ON while the recording paper 50 is passing between the paper feed roller 209 and the carrier roller 204, and the detection sensor 510 is OFF after the recording paper 50 passes therebetween.

The amount by which the recording paper 50 is carried can be detected based on the amount of time for which the detection sensor 510 is continuously ON, the amount of rotation of the carrier roller 204 made over that time period, etc. The amount by which the recording paper 50 is carried is a predetermined amount, which can be uniquely determined by the size of the recording paper 50. Thus, if the detected amount by which it is carried exceeds the predetermined amount, it is assumed that a paper jam has occurred. In the present embodiment, a paper jam (or a jam) is detected in this manner. Thus, the paper lever 49 and the detection sensor 510 together form a jam detection device. Note however that means for detecting a paper jam is not limited to those having a structure as described above, and may of course be those having other structures.

Note that the presence/absence of a jam may be indicated in a display section on the panels 11 and 12 of the casing 10. Alternatively, it may be indicated on a personal computer, a TV, etc., connected to the printer 1. Alternatively, it may be notified by a sound, etc.

As illustrated in FIG. 52 and FIG. 53, the input paper cassette 15 is placed at the bottom inside the casing 10, and is detachably attached to the casing 10. The lateral width of the input paper cassette 15 is shorter than that of the casing 10. Therefore, some free space is provided on both sides of the input paper cassette 15 inside the casing 10. Moreover, the length of the input paper cassette 15 in the front-back direction is longer than the length of the side surface of the casing 10 in the front-back direction. Therefore, the rear end of the input paper cassette 15, being in the attached position, protrudes past the side surfaces of the casing 10 in the rearward direction while being covered by a protruding portion 13 on the back of the casing 10 (see FIG. 44).

As illustrated in FIG. 55, the input paper tray 20 for storing the recording paper 50 before an image is recorded thereon is formed in a rear portion of the input paper cassette 15, and the output paper tray 14 for supporting the recording paper 50 after an image is recorded thereon is formed in a front portion of the input paper cassette 15. The output paper tray 14 can extend/collapse in the front-back direction, and is pulled out in the forward direction to protrude in the forward direction from the casing 10 during a recording operation.

The cartridge holder 700 is a holding member for detachably holding a plurality of ink cartridges 750. In the present printer 1, the ink cartridges 750 attached to the cartridge holder 700 contain black, cyan, magenta, yellow, light cyan and light magenta ink.

As will be described later, the cartridge holder 700 can move in the front-back direction. Herein, the most forward position will be referred to as the home position (see FIG. 45, FIG. 52, FIG. 54, FIG. 55 and FIG. 56), and the most rearward position will be referred to as the retracted position (see FIG. 46, FIG. 53, FIG. 57, FIG. 58 and FIG. 59).

Figure 60:
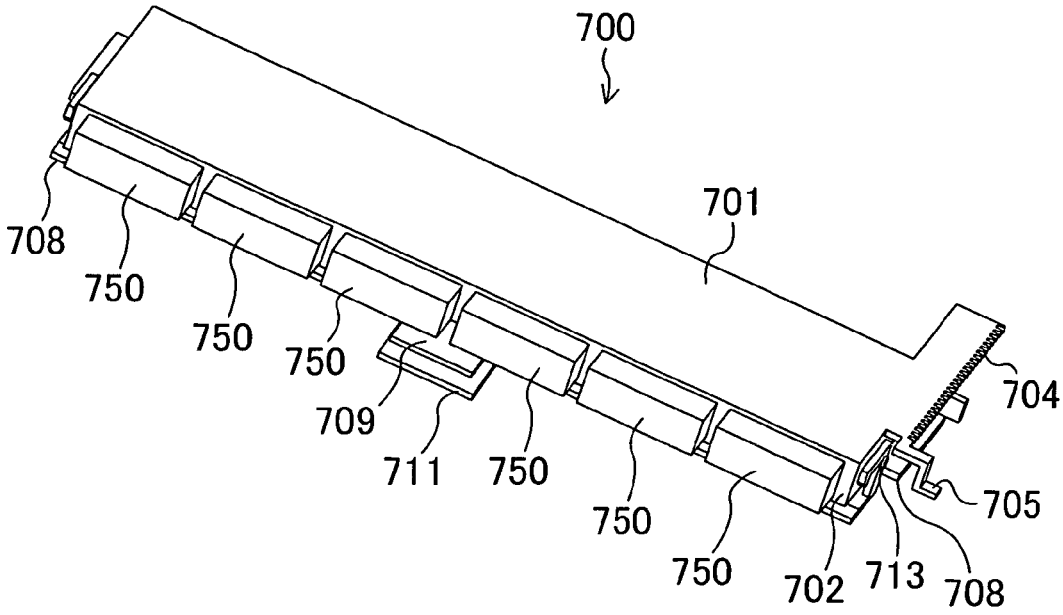
FIG. 60 is a perspective view illustrating the cartridge holder.
Figure 61:
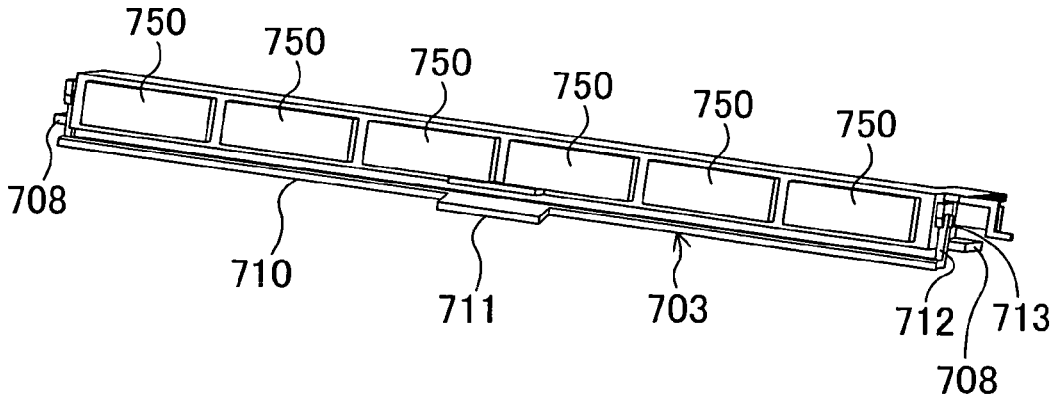
FIG. 61 is a perspective view illustrating the cartridge holder.

As illustrated in FIG. 60 and FIG. 61, the cartridge holder 700 includes an upper plate 701, a holder body 702 and a lock lever 703.

Sawteeth are formed on the right end surface of the upper plate 701, and the right end portion of the upper plate 701 forms a rack 704. A rib 705 protruding in the rightward direction is provided in the right end portion of the upper plate 701. The rib 705 is used for detecting the position of the cartridge holder 700, the details of which will be described later.

Figure 62:
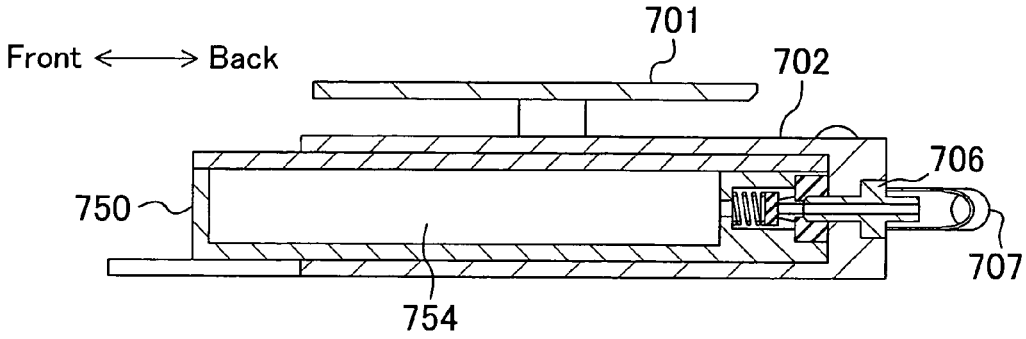
FIG. 62 is a cross-sectional view illustrating the ink cartridge and the cartridge holder.
Figure 63:
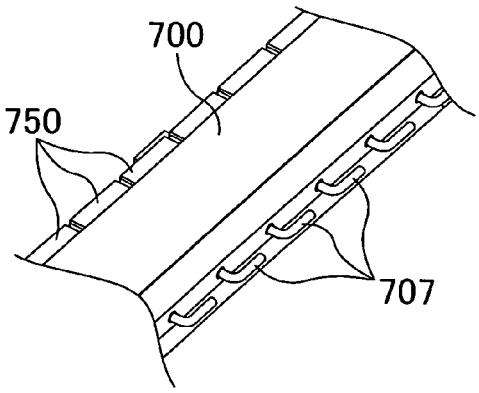
FIG. 63 is a perspective view illustrating the cartridge bolder.

The holder body 702 includes slots into which the ink cartridges 750 are inserted. As illustrated in FIG. 62, an ink needle 706 for drawing ink out of the ink cartridge 750 is fixed deep inside each slot, i.e., on the rear inner surface of the holder body 702. The ink needle 706 passes through the holder body 702, and the tip of the ink needle 706 is projecting into the holder body 702. The base portion of the ink needle 706 is exposed outside the holder body 702. As illustrated in FIG. 63, one end of a flexible ink tube 707 is attached to the base portion of the ink needle 706 on the back of each ink cartridge 750.

The other end of the ink tube 707 is connected to the sub-tank 104 provided in the carriage 202. Therefore, ink in each ink cartridge 750 is supplied to the sub-tank 104 through the ink tube 707, and then supplied from the sub-tank 104 to the recording head 101.

As illustrated in FIG. 60, a slide plate 708 extending in the front-back direction is provided both on the left side and on the right side of the holder body 702. Moreover, an upper tab 709 protruding in the forward direction is formed under the central portion of the front surface of the holder body 702.

The lock lever 703 is provided under the holder body 702. The lock lever 703 is used to lock the cartridge holder 700 into the home position and to release the lock. The lock lever 703 includes a plate-like member 710 extending in the left-right direction, a claw-like hook portion 712 extending upward at each end of the plate-like member 710, and a lower tab 711 protruding in the forward direction at the center of the plate-like member 710. A shaft 713 protruding in the outward direction is formed on each of the left and right end surfaces of the holder body 702, and the hook portion 712 is rotatably fit around the shaft 713. Thus, the lock lever 703 can pivot with respect to the holder body 702.

Figure 64:
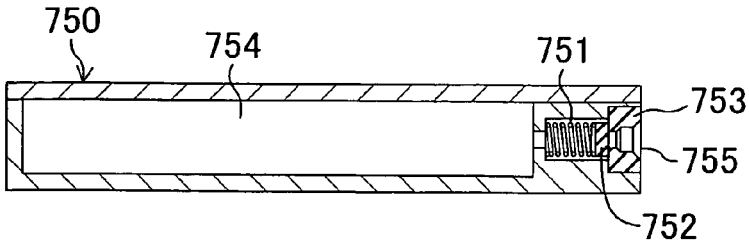
FIG. 64 is a cross-sectional view illustrating the ink cartridge.

As illustrated in FIG. 64, an ink chamber 754 storing ink therein is formed inside the ink cartridge 750, and an ink supply port 755 is provided at one end of the ink cartridge 750. A rubber lid 753 having a supply port formed at the center thereof is fit in the ink supply port 755. A coil spring 751 and a valve 752 fixed to the tip of the coil spring 751 are provided near the ink supply port 755 inside the ink cartridge 750.

With the ink cartridge 750 not being attached to the cartridge holder 700, the valve 752 is biased toward the rubber lid 753, and the supply port of the rubber lid 753 is closed by the valve 752. As illustrated in FIG. 62, when the ink cartridge 750 is attached to the cartridge holder 700, the ink needle 706 pushes the valve 752 in the forward direction against the biasing force of the coil spring 751 to open the valve 752. Thus, ink inside the ink chamber 754 is drawn out through the ink needle 706 and the ink tube 707.

As illustrated in FIG. 53, holder guides 741 and 742 for slidably holding the cartridge holder 700 are provided respectively on the inner side (right side) of the left side frame 19 and the inner side (left side) of the right side frame 19. The holder guides 741 and 742 each include a groove 743 extending in the front-back direction and engaged with the slide plate 708 of the cartridge holder 700.

Figure 65:
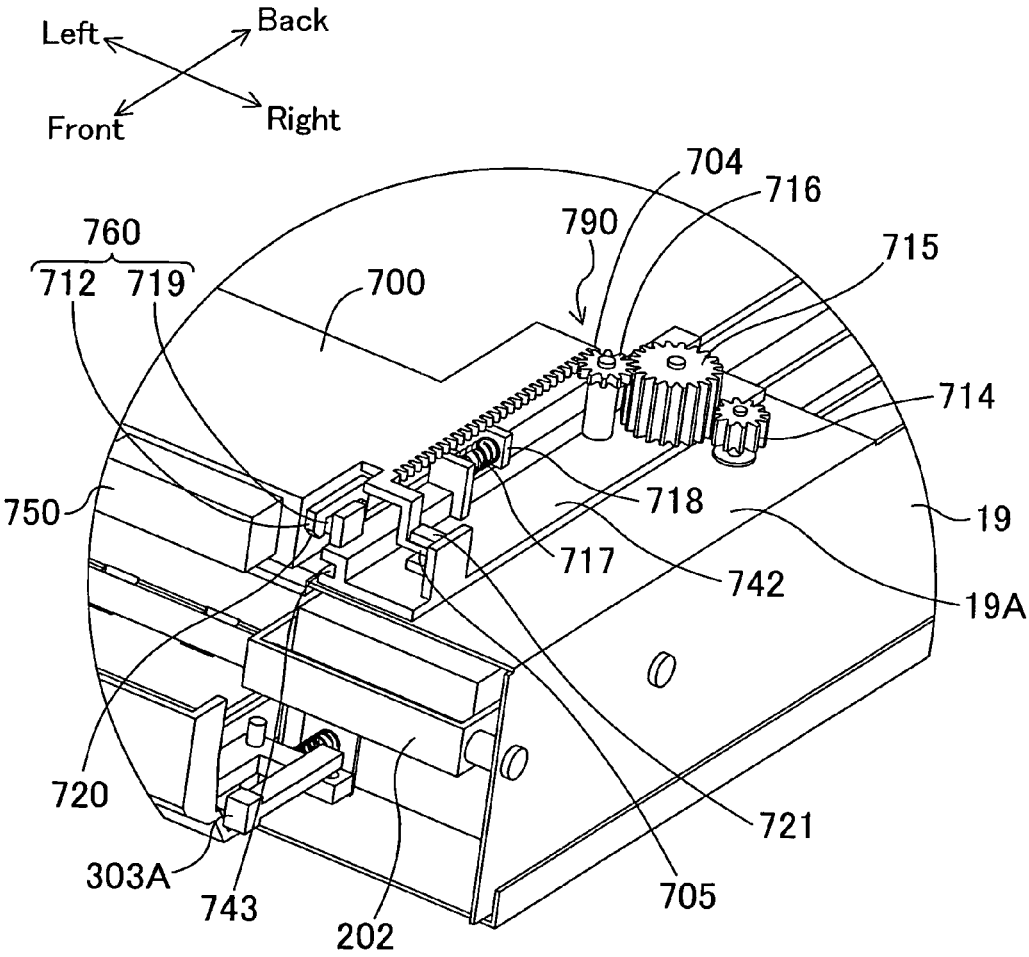
FIG. 65 is an enlarged perspective view illustrating a portion of a cartridge holder of Embodiment 11 near the right end thereof with the cartridge holder being in the home position.
Figure 66:
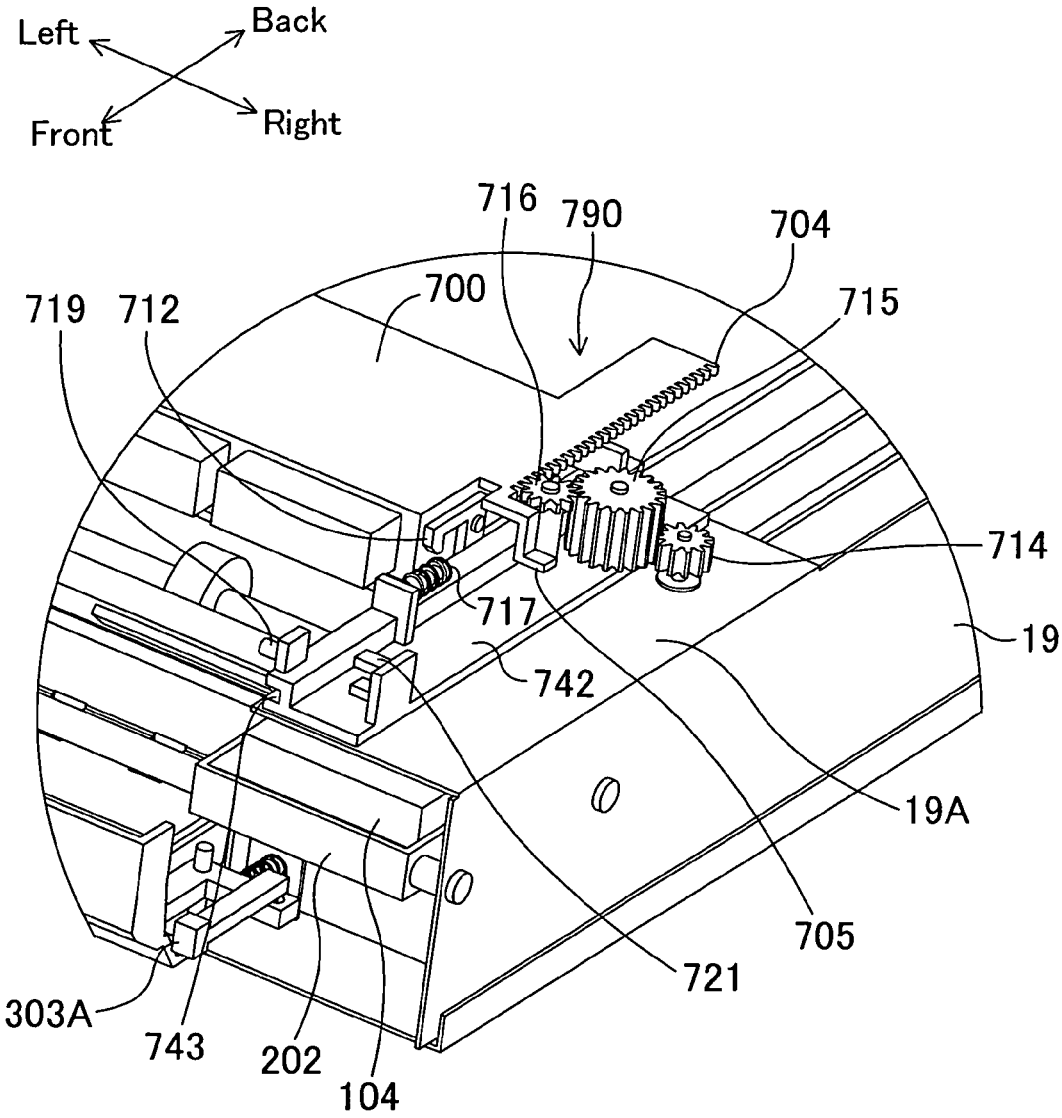
FIG. 66 is an enlarged perspective view illustrating a portion of the cartridge holder near the right end thereof with the cartridge holder being in the retracted position.

As illustrated in FIG. 65 and FIG. 66, the frame 19A extending in the inward (leftward) direction is provided at the upper end of the right side frame 19. The frame 19A is provided with a motor pinion 714 connected to a motor (not shown). Moreover, the holder guide 742 is provided with a gear 715 meshed with the motor pinion 714, and a gear 716 meshed with the gear 715. The gear 716 is meshed with the rack 704 of the cartridge holder 700. Therefore, as the motor pinion 714 rotates, the cartridge holder 700 moves in the front-back direction. The motor pinion 714 and the gears 715 and 716 together form a driving mechanism 790 for moving the cartridge holder 700 in the front-back direction. Note that the motor pinion 714 is operated by the cartridge holder switch 17.

The holder guide 742 is provided with a coil spring 717 extending in the rearward direction, and the cartridge holder 700 includes a contact plate 718 to be in contact with the coil spring 717. In the home position, the coil spring 717 is pushed in the forward direction by the contact plate 718 to be in a contracted state. Therefore, when the cartridge holder 700 is in the home position, the coil spring 717 gives a rearward biasing force to the contact plate 718. Thus, the cartridge holder 700 is subject to a force in the rearward direction.

A locking pin 719 protruding in the inward direction is provided in a front portion of each of the holder guides 741 and 742. The locking pin 719 is for stopping the hook portion 712 of the lock lever 703 when the cartridge holder 700 is in the home position. Therefore, the hook portion 712 and the locking pin 719 are for locking the cartridge holder 700 in the home position, and together form a lock mechanism 760. The hook portion 712 near the tip thereof extends in the forward direction and is bent in the downward direction, and the front side of the tip portion bent in the downward direction forms an sliding surface 720 being an inclined surface. When the cartridge holder 700 moves in the forward direction, the hook portion 712 hits the locking pin 719 and then rides on the locking pin 719 as the sliding surface 720 slides over the locking pin 719. As a result, the cartridge holder 700 is locked. Thus, when the cartridge holder 700 moves in the forward direction, the hook portion 712 rides on the locking pin 719 and the cartridge holder 700 is locked automatically.

Although not shown, the cartridge holder 700 is provided with a driving mechanism for rotating the lock lever 703 in a direction such that the front portion thereof moves up. In other words, there is a driving mechanism for rotating the lock lever 703 so that the hook portion 712 is released from the locking pin 719. The driving mechanism is operated by the cartridge holder switch 17, and is activated when an operation is performed to move the cartridge holder 700 into the retracted position.

Note however that the lock of the cartridge holder 700 can be released manually. By pinching and squeezing the upper tab 709 and the lower tab 711 of the cartridge holder 700 closer to each other, the lock lever 703 is rotated, and the hook portion 712 comes off the locking pin 719. Then, since the coil spring 717 is biasing the cartridge holder 700 in the rearward direction, the cartridge holder 700 moves in the rearward direction to release the lock of the cartridge holder 700.

The holder guide 742 is provided with a sensor 721 for detecting whether or not the cartridge holder 700 is in the home position. The sensor 721 is an optical sensor of a light-transmitting type or a light-reflecting type for detecting the rib 705 of the cartridge holder 700, and the sensor 721 is switched ON/OFF when the rib 705 is at a predetermined position (the position of the rib 705 when the cartridge holder 700 is in the home position).

Note that the printer 1 includes a protection device for determining whether or not the cartridge holder 700 is in the home position when performing a recording operation, and for forcibly canceling the recording operation if the cartridge holder 700 is not in the home position.

Figure 56:
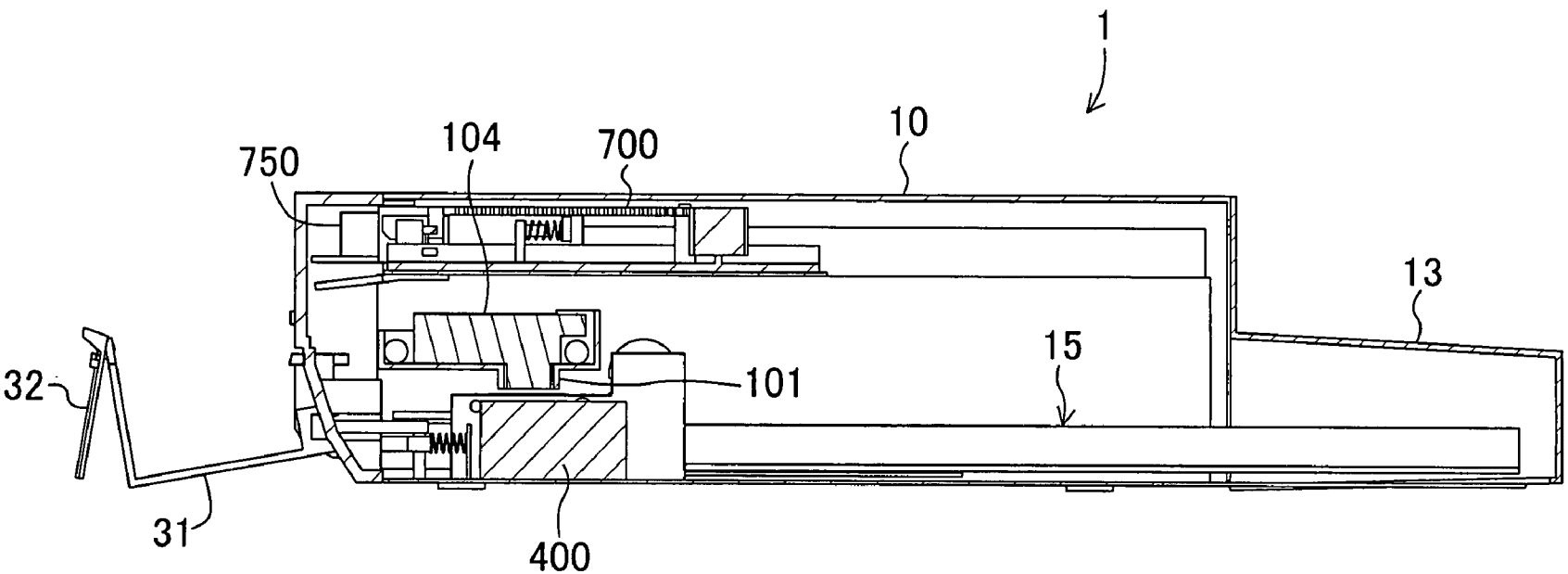
FIG. 56 is a cross-sectional view taken along line U—U in FIG. 54.
Figure 57:
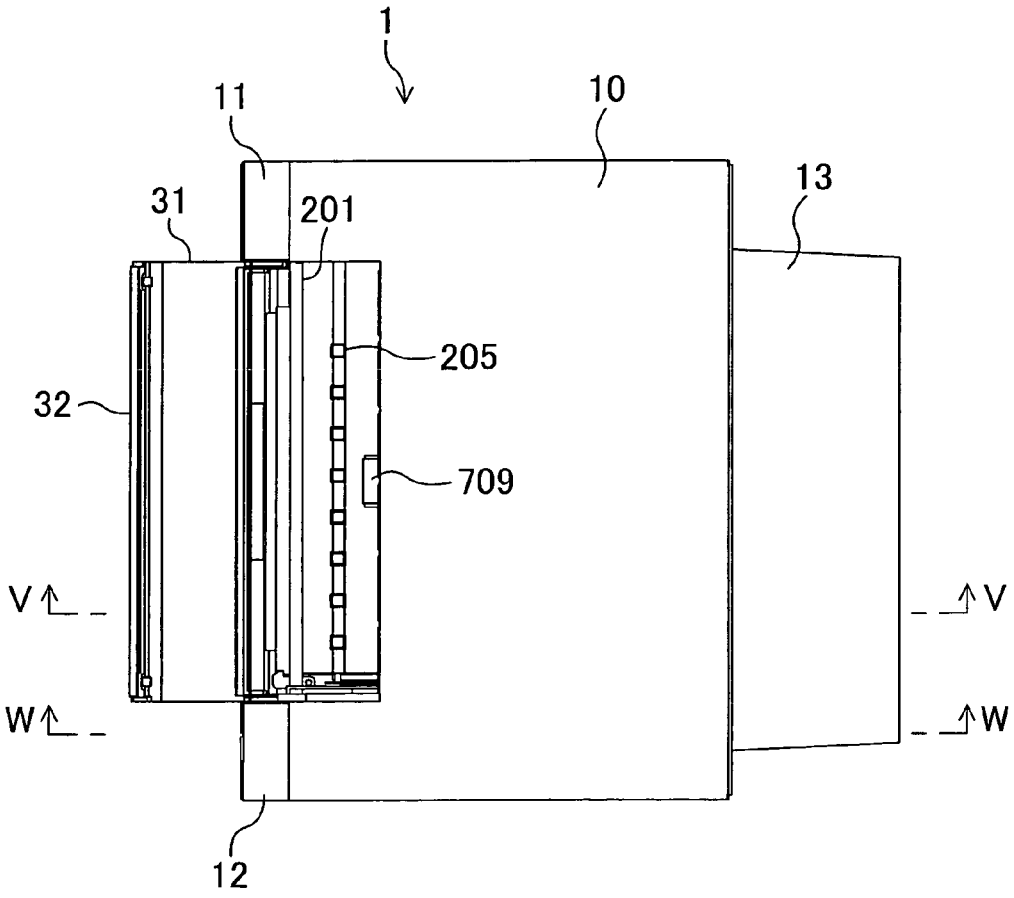
FIG. 57 is a plan view of the printer with the cartridge holder in the retracted position.
Figure 58:
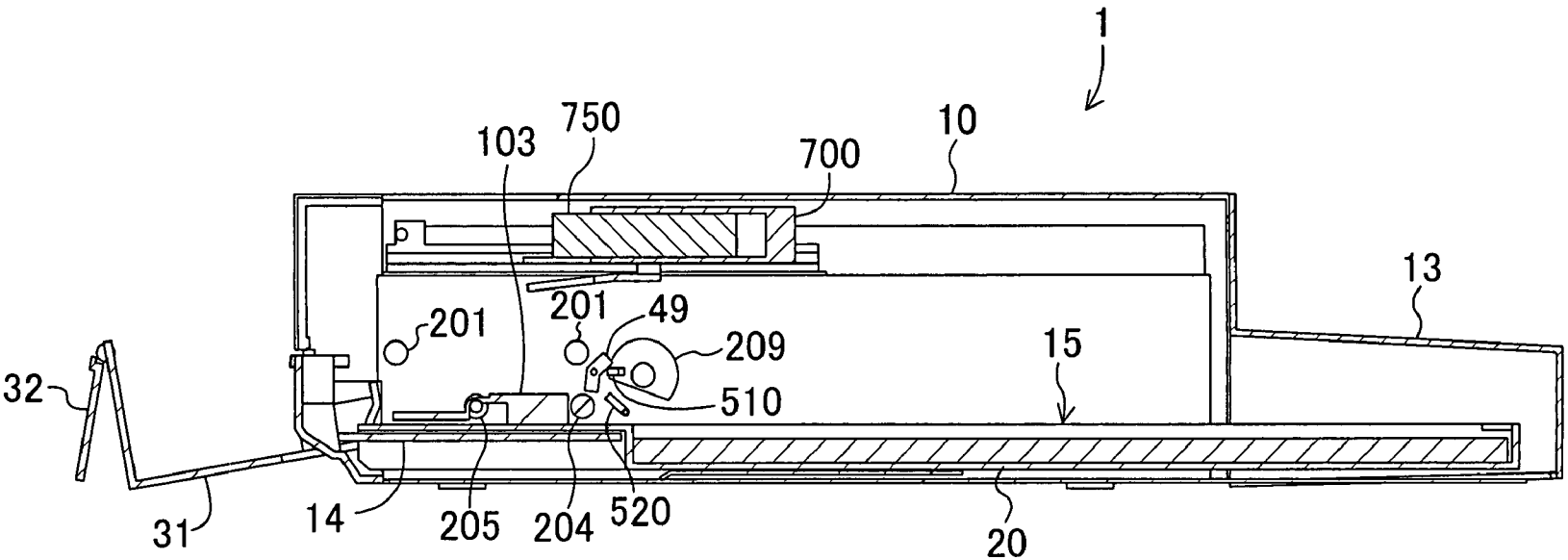
FIG. 58 is a cross-sectional view taken along line V—V in FIG. 57.
Figure 59:
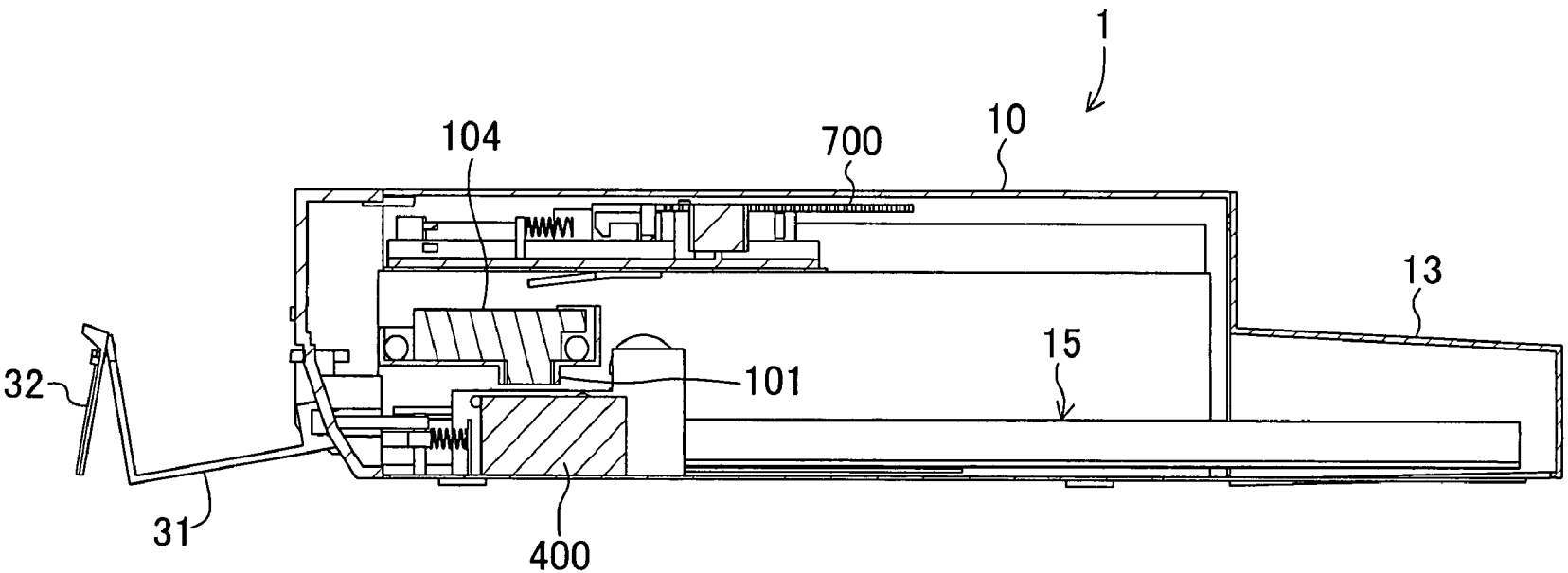
FIG. 59 is a cross-sectional view taken along line W—W in FIG. 57.

As illustrated in FIG. 56, a purging unit 400 for purging ink from the recording head 101 is provided on the right-end side of the carriage shaft 201. Although not shown, the purging unit 400 includes a cap for covering the head surface of the recording head 101, and a suction pump for sucking away the ink from the recording head 101.

As illustrated in FIG. 52 and FIG. 53, a substrate block 602 for accommodating a control substrate (not shown) in the upright position is provided on the outer side (left side) of the left side frame 19.

Next, the operation of the printer 1 will be described.

When performing a recording operation, the output paper tray 14 of the input paper cassette 15 is first pulled out in the forward direction. In that state, the recording paper 50 in the input paper cassette 15 is picked up by the paper feed roller 209, and the recording paper 50 is carried into the recording section 100 by the carrier roller 204. Then, along with the movement of the carriage 202, the recording head 101 discharges ink while moving in the left-right direction, thereby recording an image on the recording paper 50 on the platen 103. After an image is recorded, the recording paper 50 is carried by the paper eject roller 205 and ejected onto the output paper tray 14.

Next, how to replace the ink cartridge 750 will be described. When replacing the ink cartridge 750, the cover 33 is opened so that the cartridge holder 700 is exposed as illustrated in FIG. 45. In this state, a used ink cartridge 750 is pulled out from the cartridge holder 700, and a new ink cartridge 750 is inserted into the cartridge holder 700. Note that since the cartridge holder 700 is locked in the home position, the cartridge holder 700 is prevented from sliding in the rearward direction when pushing in the ink cartridge 750.

Figure 67:
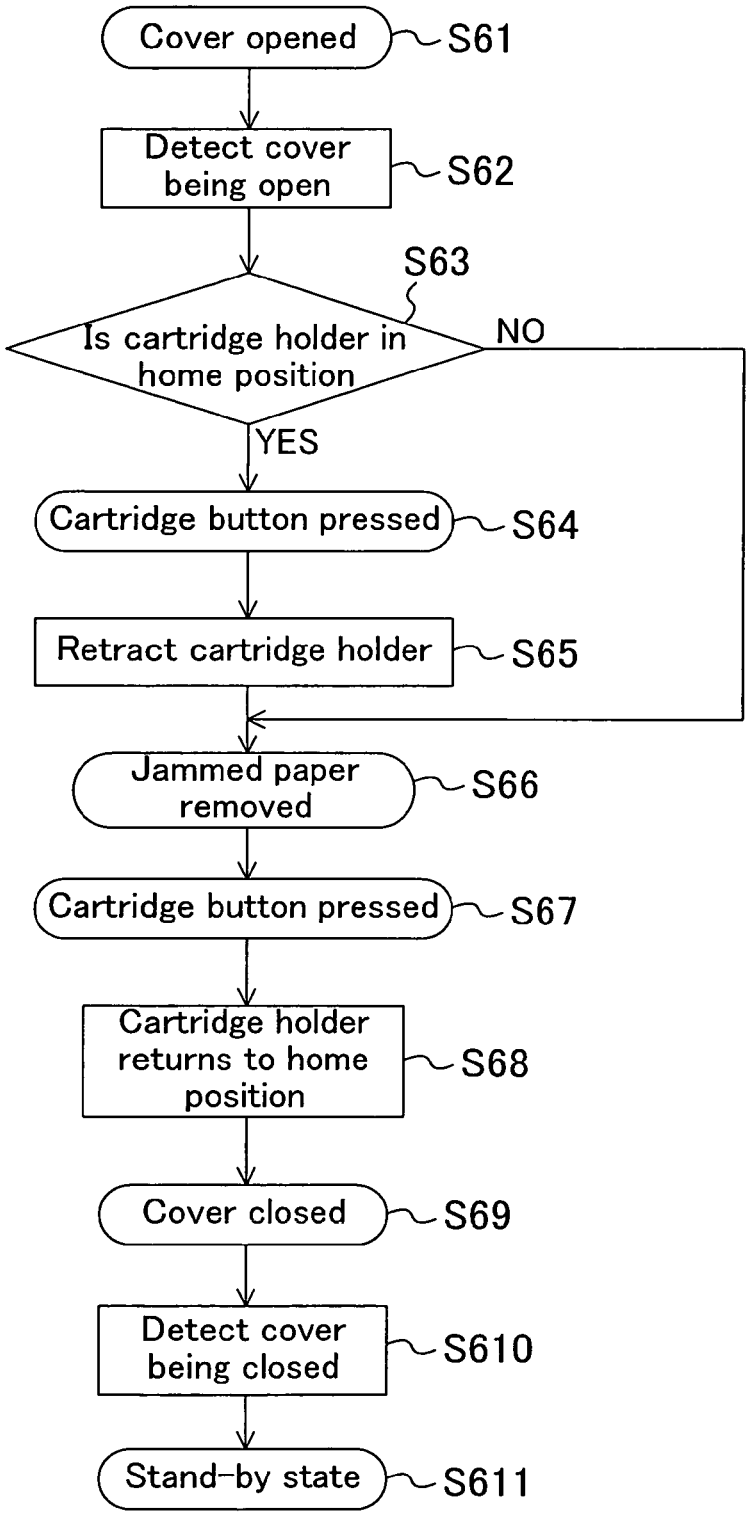
FIG. 67 is a flow chart of a jam removal operation.

Next, a jam removal operation will be described with reference to FIG. 67.

When a paper jam occurs during a recording operation, the occurrence of a paper jam is notified by the jam detection device. The notified user opens the cover 33 in step S61. Note that the cover 33 being open is detected by the cover detection device (step S62). Then, in step S63, after confirming that the cartridge holder 700 is in the home position, the cartridge holder switch 17 is pressed in step S64. Thus, the cartridge holder 700 moves rearward from the home position to the retracted position (step S65), increasing the space of the opening 30 (see FIG. 46). Then, in step S66, the user removes jammed recording paper 50, and presses the cartridge holder switch 17 (step S67). Thus, the cartridge holder 700 moves forward from the retracted position to the home position to be locked in the home position (step S68). Then, in step S69, the user closes the cover 33. Then, after the closing of the cover 33 is detected in step S610, the printer 1 is brought to the stand-by state (step S611).

Figure 68:
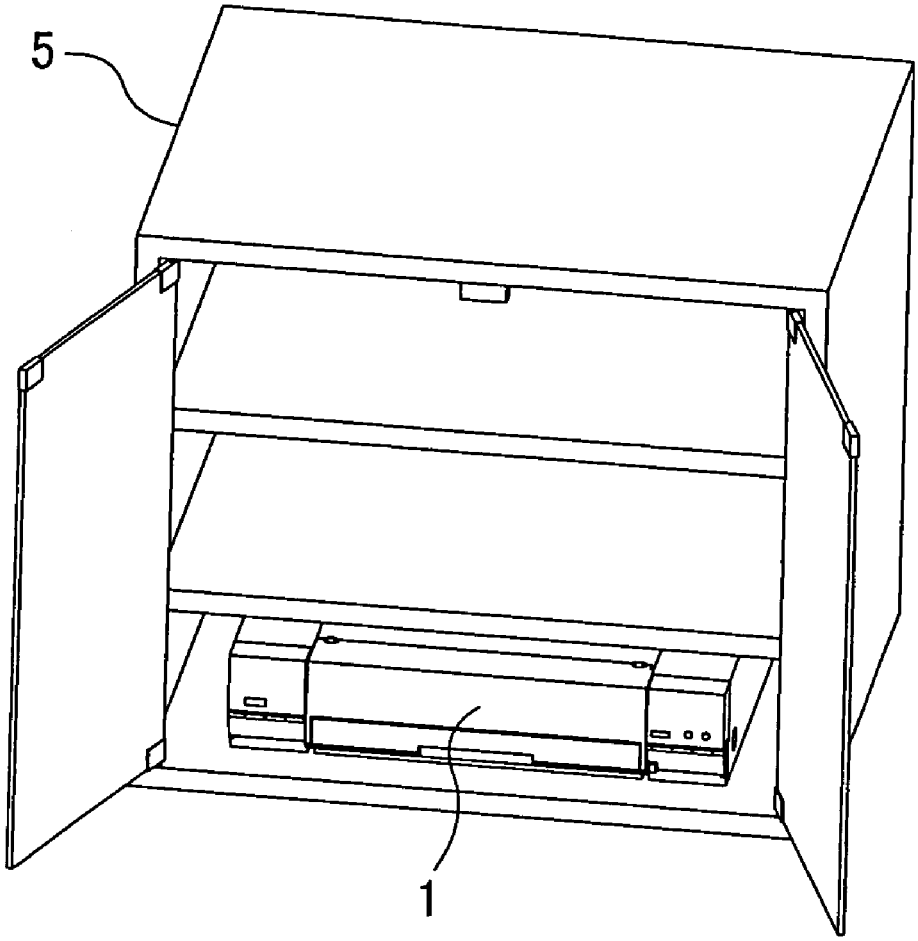
FIG. 68 is a perspective view illustrating the printer placed in a rack.

As described above, with the present printer 1, the cover 33 is made up of the front cover 31 and the top cover 32, with the cover 33 being folded when it is opened, whereby it is possible to reduce the space required for opening/closing the cover 33. Specifically, with the present printer 1, the cover 33 is foldable, whereby it is possible to reduce the amount by which the cover 33 protrudes upward when unfolding and retracting the cover 33. Therefore, the cover 33 can be opened/closed even in a place where there is not a sufficient space above, and the printer 1 can be installed even in a place with a limited height. For example, the printer 1 can be accommodated in a rack 5 whose shelf spacing is only slightly larger than the height of the casing 10, as illustrated in FIG. 68.

Moreover, since the area of the opening 30 can be increased, it is easy to put a hand into the printer 1 through the opening 30, whereby it is possible to efficiently perform the jam removal operation (removal of jammed recording paper 50, removal of a small piece of recording paper 50, etc.), the replacement of the ink cartridges 750, the maintenance of the internal mechanisms of the printer 1, etc.

Moreover, the cover 33 is folded automatically as it is opened, and the cover 33 does not have to be opened and folded manually. This facilitates the opening of the cover 33.

Moreover, in the present printer 1, the cover 33 is foldable so that the top cover 32 will be folded to extend downward when the cover 33 is opened (see FIG. 46). Therefore, it is possible to prevent the cover 33 from blocking the area in front of the opening 30, and a large space is obtained in front of the opening 30. Thus, it is easier to put a hand into the opening 30 from the front side of the casing 10, and a jam removal operation can be performed efficiently.

Moreover, with the present printer 1, the cartridge holder 700 is slidable in the front-back direction. Therefore, in a jam removal operation, the space of the opening 30 can be increased by moving the cartridge holder 700 to the rearward, retracted position. Thus, a hand being put into the opening 30 will not be obstructed by the ink cartridges 750, whereby it is possible to perform the jam removal operation easily and quickly.

With the provision of the lock mechanism 760 for locking the cartridge holder 700 in the home position, the cartridge holder 700 is prevented from moving when replacing the ink cartridges 750 even though the cartridge holder 700 is movable. Therefore, it is possible to replace the ink cartridges 750 easily.

With the provision of the driving mechanism 790 for moving the cartridge holder 700, the user does not have to manually move the cartridge holder 700, thereby reducing the workload.

With the provision of the sensor 721 for detecting the cartridge holder 700 being in the home position, the position of the cartridge holder 700 can be known easily. Moreover, the protection device is provided so that a recording operation is canceled when the cartridge holder 700 is not in the home position, whereby it is possible to prevent a damage to the ink tube 707, etc.

In the present printer 1, the flexible ink tube 707 is used as an ink channel for supplying the ink from the ink cartridge 750 to the sub-tank 104 on the carriage 202. Since the ink tube 707 can flexibly deform according to the movement of the cartridge holder 700 in the front-back direction, it is possible to prevent ink from leaking as the cartridge holder 700 moves.

Variations

In the embodiments described above, the cartridge holder 700 is moved by the user operating the cartridge holder switch 17. However, the cartridge holder switch 17 may not be necessary, and the cartridge holder 700 may be moved by an operation of another unit (e.g., a personal computer) connected to the printer 1.

Alternatively, when the cover 33 is opened while a jam has occurred, the cartridge holder 700 may be moved in an interlocked manner with the opening action of the cover 33. Specifically, a jam detection device for detecting a jam and a cover detection device for detecting the opening of the cover 33 may be provided, whereby the cartridge holder 700 is automatically moved from the home position to the retracted position when the cover 33 is opened while a jam has occurred. Alternatively, when the cover 33 is closed, the cartridge holder 700 may be returned to the home position in an interlocked manner with the closing action.

Figure 69:
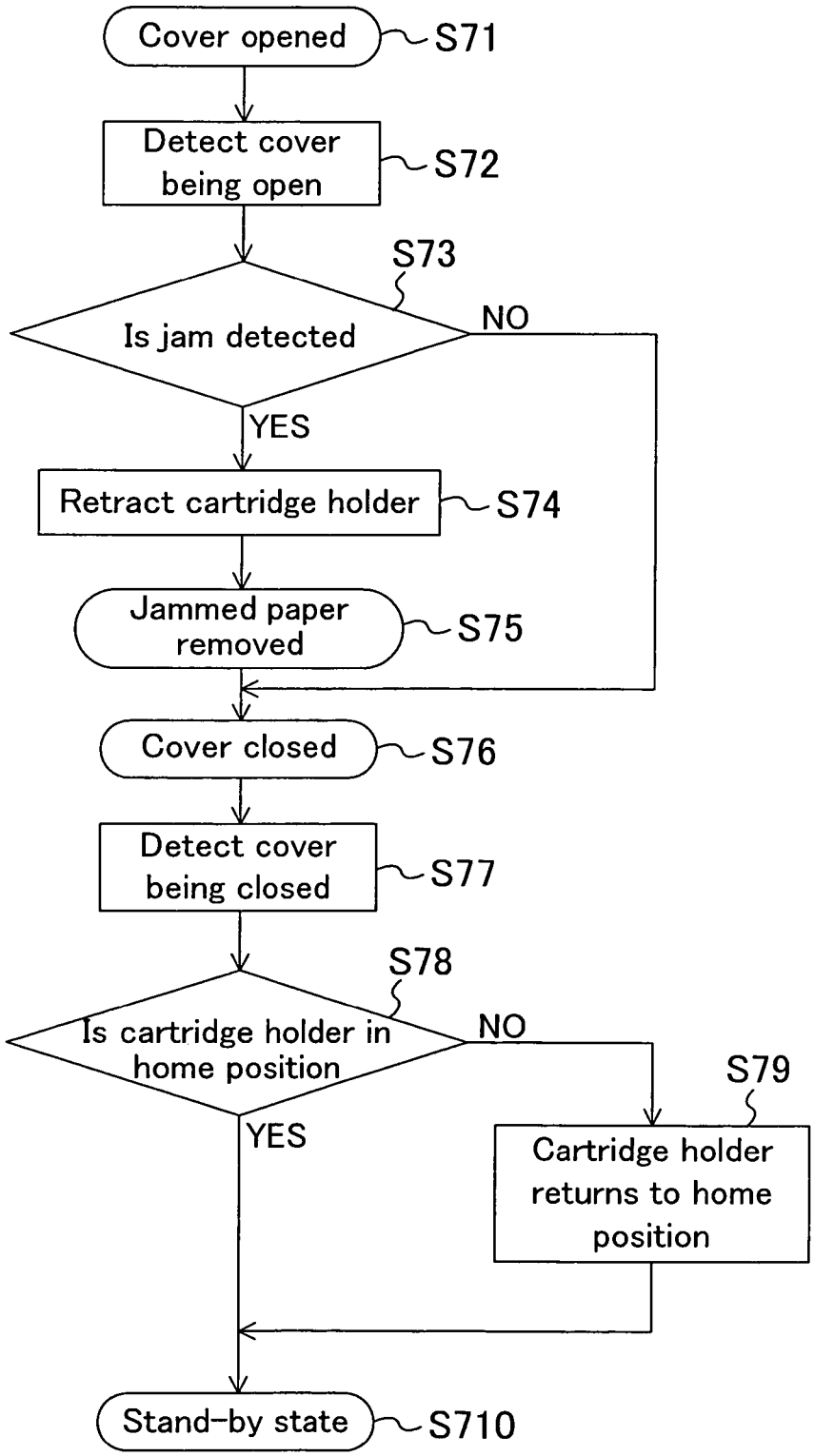
FIG. 69 is a flow chart of a jam removal operation.

FIG. 69 shows a flow chart where the cartridge holder 700 is moved in an interlocked manner with the opening/closing of the cover 33. As the user opens the cover 33 in step S71, the opening of the cover 33 is detected in step S72. Then, it is determined in step S73 whether or not a jam has occurred, and if a jam has occurred, the process proceeds to step S74 where the cartridge holder 700 moves from the home position to the retracted position. After the cartridge holder 700 moves back to the retracted position, the recording paper 50 causing the paper jam is removed by the user (step S75). Then, as the user closes the cover 33 in step S76, the closing of the cover 33 is detected (step S77), and it is determined in step S78 whether or not the cartridge holder 700 is in the home position. If the cartridge holder 700 is not in the home position, the process proceeds to step S79 to wait for the cartridge holder 700 to return to the home position. If it is determined in step S78 that the cartridge holder 700 is in the home position, the process proceeds to step S710 where the printer 1 is brought to the stand-by state.

Moreover, in the embodiments described above, a driving mechanism for moving the cartridge holder 700 is provided for automated movement of the cartridge holder 700. However, it is understood that the driving mechanism may be omitted, in which case the cartridge holder 700 is moved manually.

Embodiment 12

Figure 71:
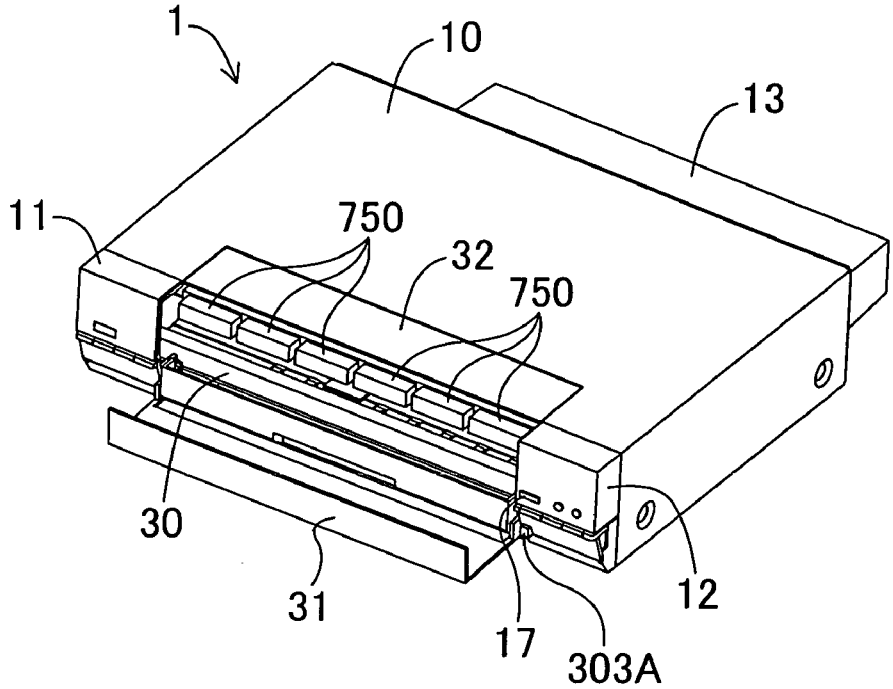
FIG. 71 is a perspective view illustrating the printer with the cover being open and with the cartridge holder being in the home position.
Figure 72:
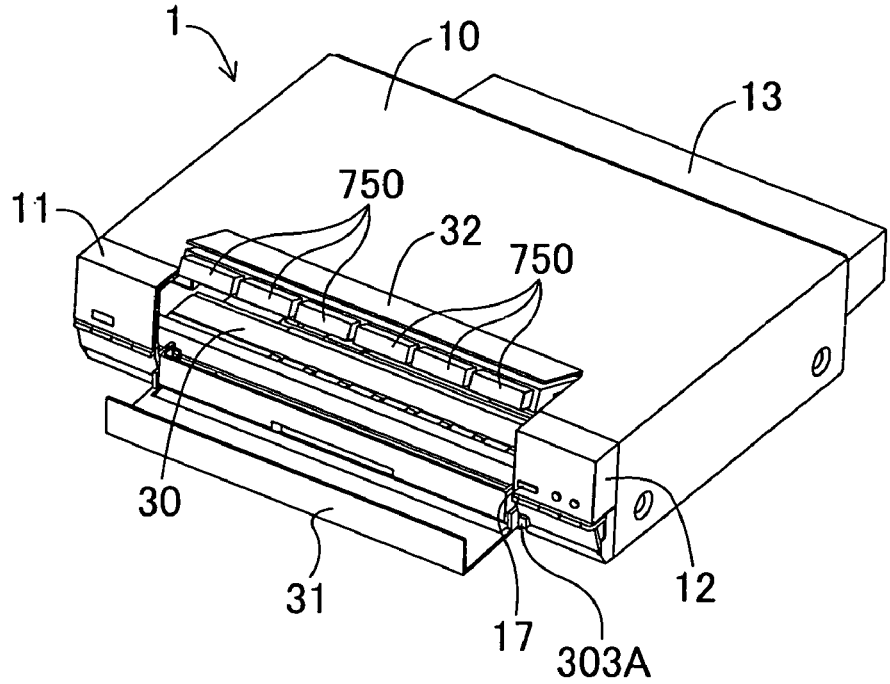
FIG. 72 is a perspective view illustrating the printer with the cover being open and with the cartridge holder being in the retracted position.

In the printer 1 of Embodiment 11, the cartridge holder 700 is slid in the front-back direction to increase the space of the opening 30. In contrast, in the printer 1 of Embodiment 12, the cartridge holder 700 is rotated to increase the space of the opening 30 as illustrated in FIG. 71 and FIG. 72. In the following description, the position where the cartridge holder 700 is not inclined (generally horizontal) will be referred to as the home position (see FIG. 71), and the position where the cartridge holder 700 is inclined with the front side thereof being raised will be referred to as the retracted position (see FIG. 72).

Figure 70:
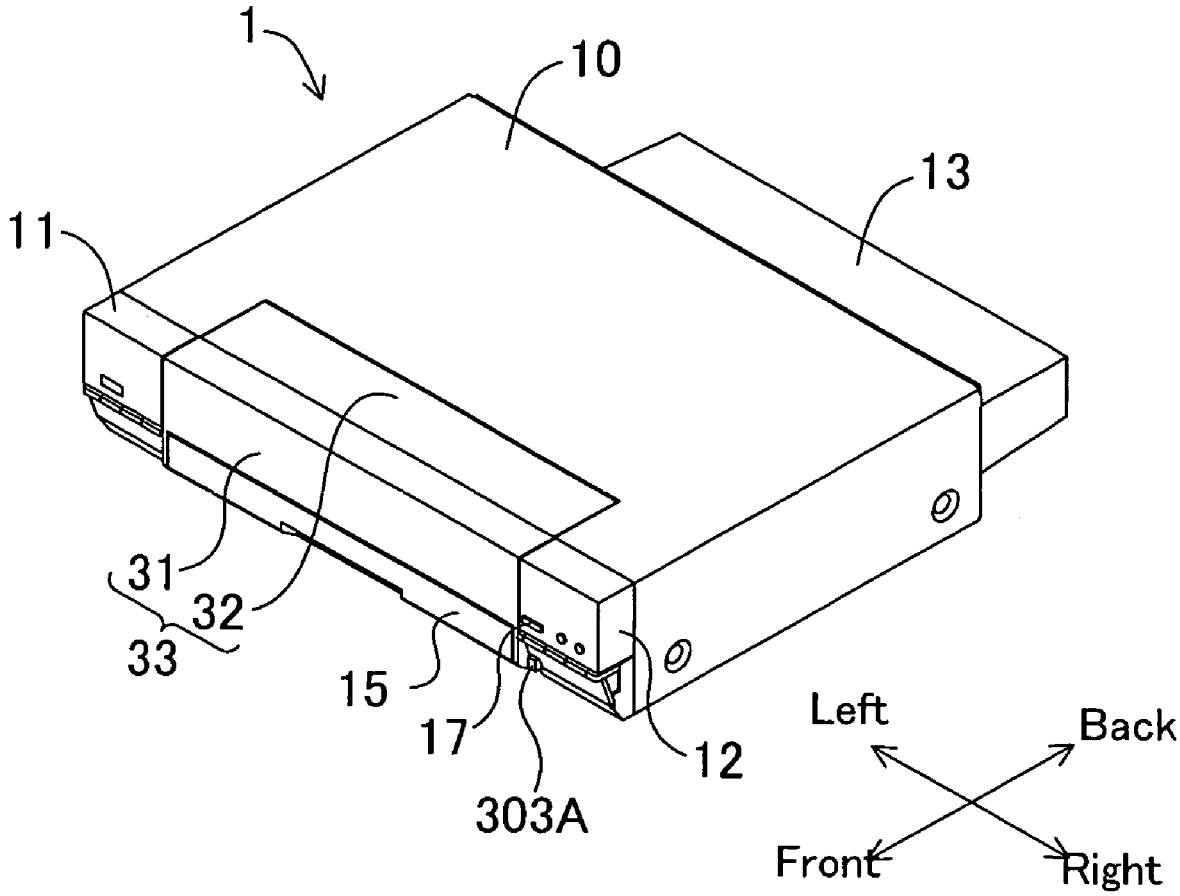
FIG. 70 is a perspective view illustrating a printer of Embodiment 12.

As illustrated in FIG. 70 to FIG. 72, in Embodiment 12, the front cover 31 and the top cover 32 are separate from each other so that they can be opened in opposite directions from a certain point in the vertical direction. Specifically, the front cover 31 rotates in the forward direction about its lower end, and the top cover 32 rotates in the upward direction about its rear end. Thus, the front cover 31 and the top cover 32 are unfolded in opposite directions.

Other than this, the apparent structure thereof is the same as that of Embodiment 11, and will not be further described below. Next, the internal structure of the printer 1 of Embodiment 12 will be described.

Figure 73:
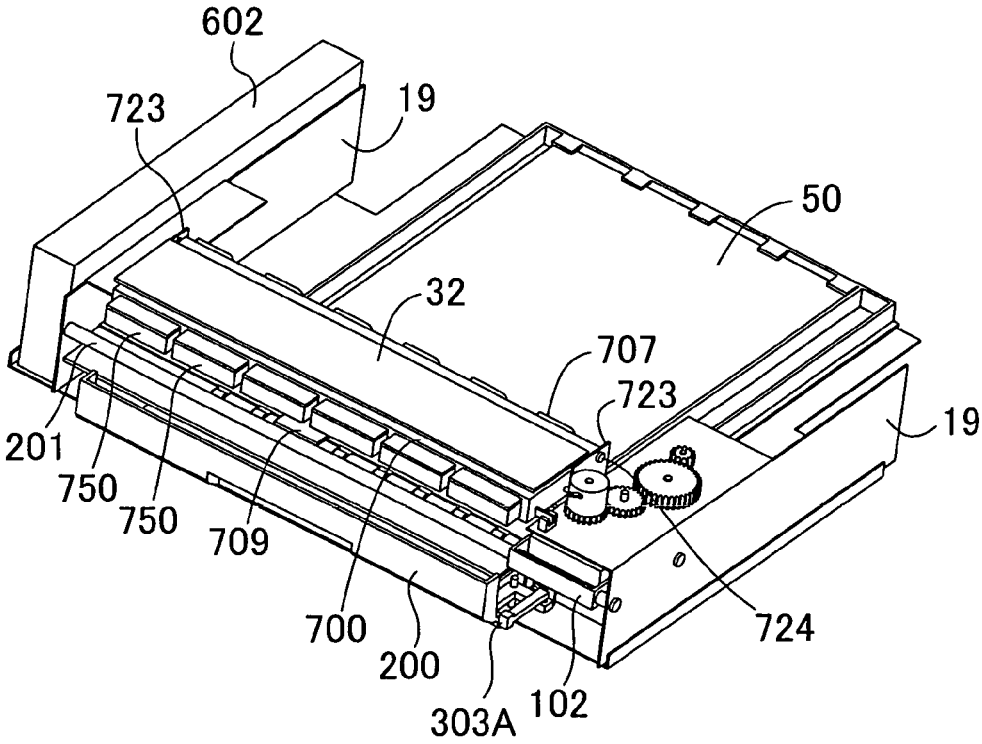
FIG. 73 is a perspective view illustrating the internal structure of the printer with the cartridge holder being in the home position.
Figure 74:
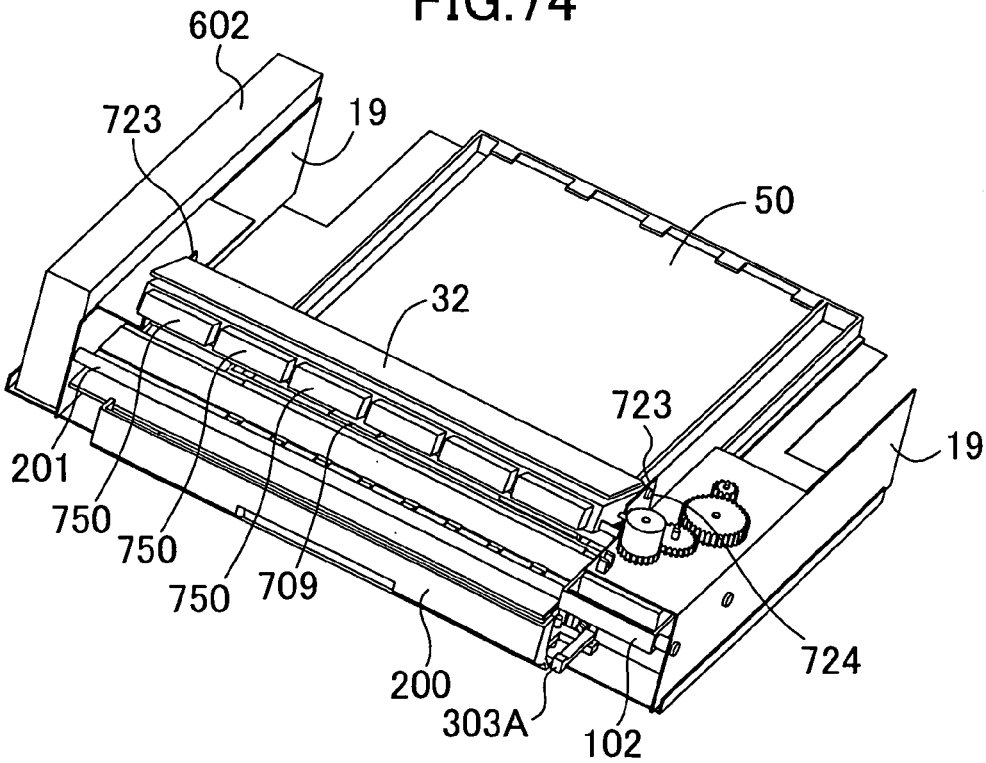
FIG. 74 is a perspective view illustrating the internal structure of the printer with the cartridge holder being in the retracted position.

As illustrated in FIG. 73 and FIG. 74, the cartridge holder 700 of Embodiment 12 has substantially the same structure as that of the holder body 722 of Embodiment 11. The tab 709 protruding in the forward direction is provided under the central portion of the front surface of the cartridge holder 700. The cartridge holder 700 is fixed to the reverse side of the top cover 32 and rotates together with the top cover 32.

Figure 75:
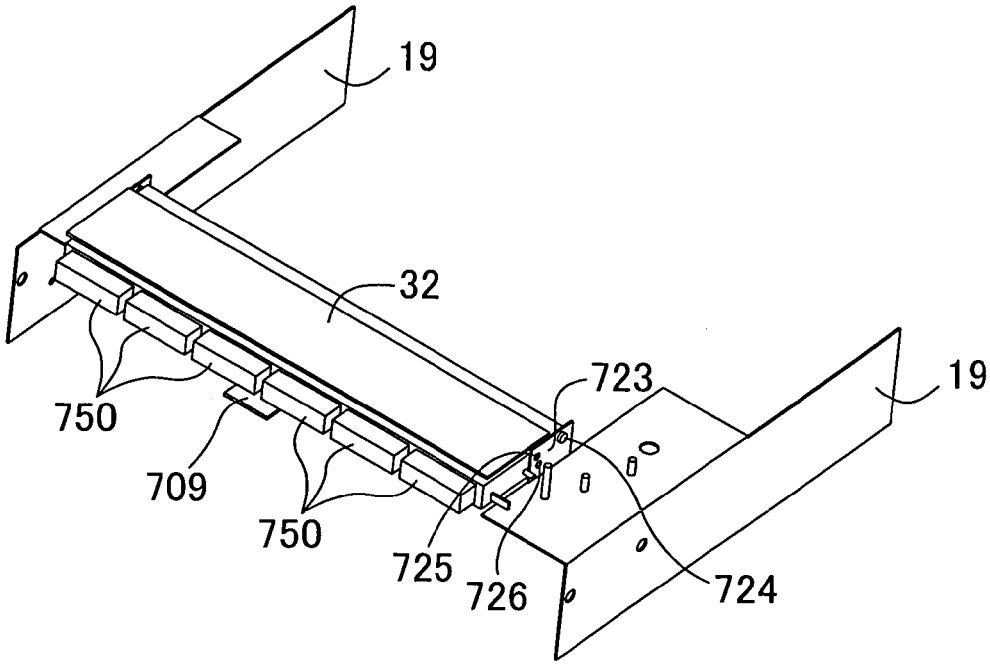
FIG. 75 is a perspective view illustrating the cartridge holder and a side frame.
Figure 76:
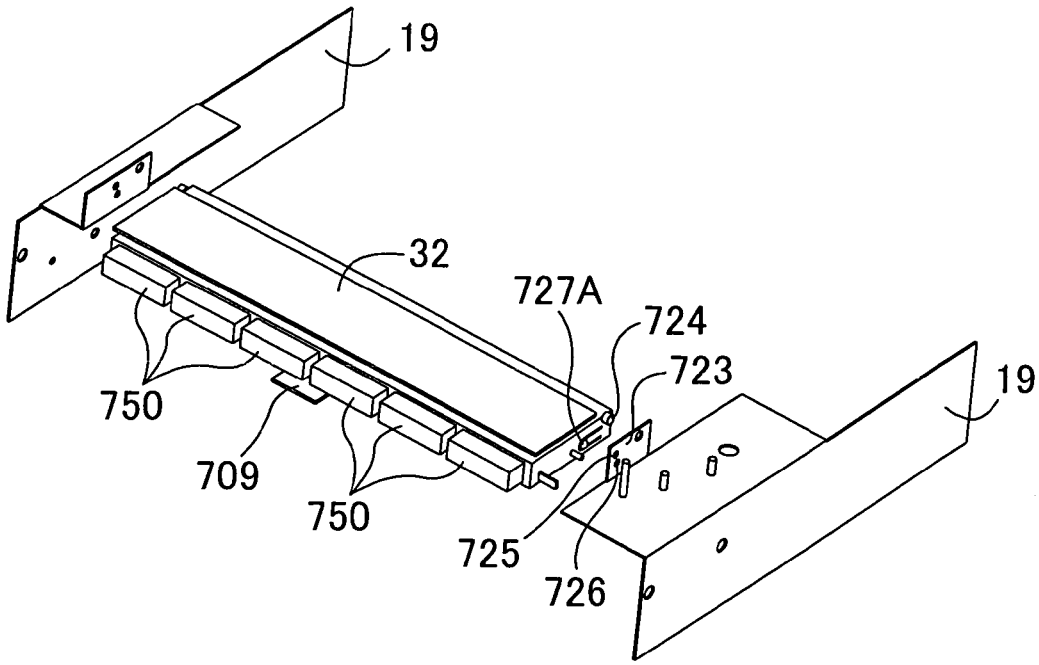
FIG. 76 is an exploded perspective view illustrating the cartridge holder and the side frame.

As illustrated in FIG. 75 and FIG. 76, a shaft 724 protruding in the outward direction is formed in a rear portion of each of the left and right side surfaces of the cartridge holder 700. A frame 723 for rotatably supporting the shaft 724 of the cartridge holder 700 is provided on the left side and on the right side of the cartridge holder 700 inside the casing 10. Moreover, a hemispheric protrusion 727A is provided in the central portion of each side surface of the cartridge holder 700. Lock holes 725 and 726 engaged with the protrusion 727A are formed in the frame 723. The lock hole 725 and the lock hole 726 are generally aligned with each other in the up-down direction. The upper lock hole 725 is a hole for locking the cartridge holder 700 in the retracted position, and the lower lock hole 726 is a hole for locking the cartridge holder 700 in the home position.

Figure 77:
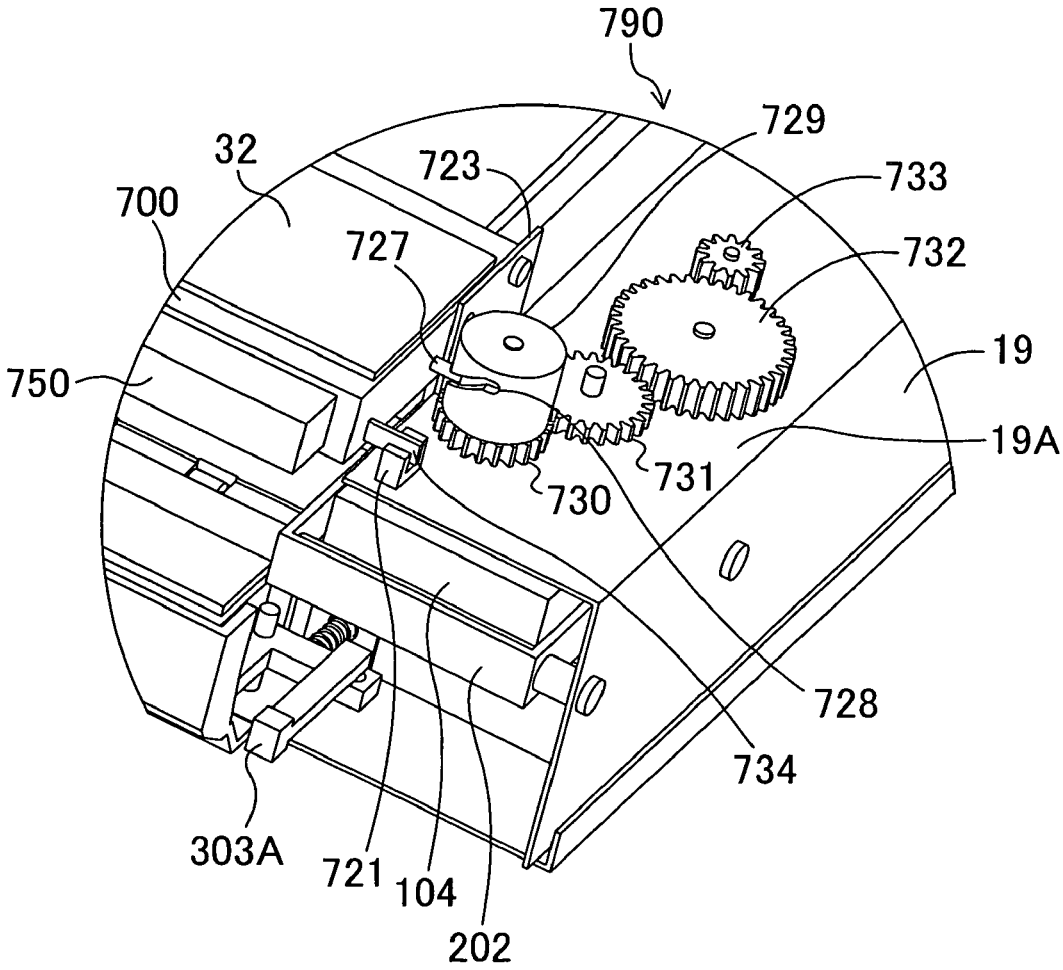
FIG. 77 is an enlarged perspective view illustrating a portion of a cartridge holder of Embodiment 12 near the right end thereof with the cartridge holder being in the home position.
Figure 78:
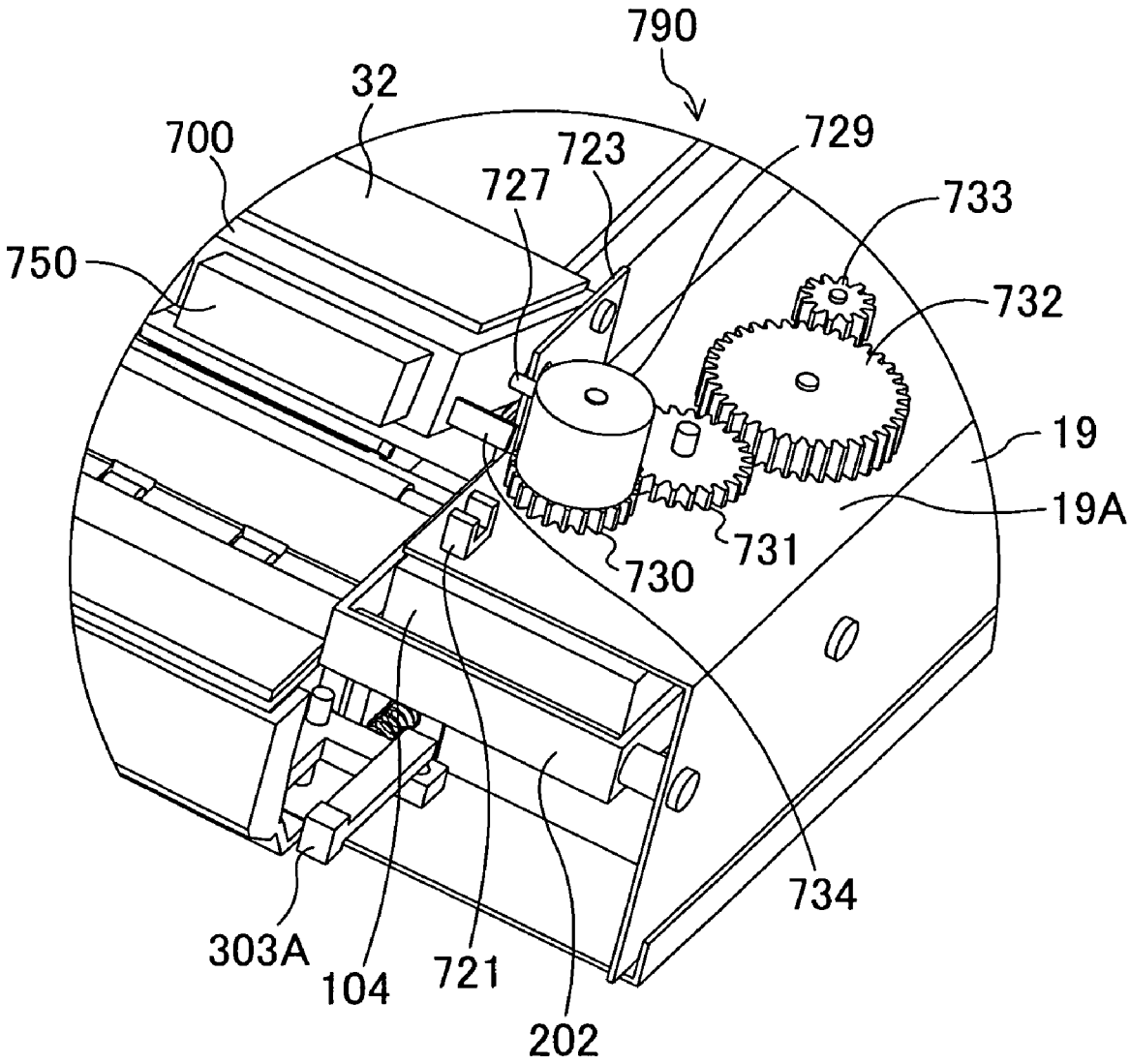
FIG. 78 is an enlarged perspective view illustrating a portion of the cartridge holder near the right end thereof with the cartridge holder being in the retracted position.

As illustrated in FIG. 77 and FIG. 78, a moving pin 727 protruding in the rightward direction is provided on the right end surface of the cartridge holder 700. A cylindrical member 729 with a groove 728 engaged with the moving pin 727 is provided on a side frame 19A. A pinion 730 coaxial with the cylindrical member 729 is fixed on the bottom of the cylindrical member 729, and the pinion 730 is meshed with a motor pinion 733 via pinions 731 and 732. Note that a motor (not shown) is connected to the motor pinion 733. The groove 728 of the cylindrical member 729 is a spiral groove such that the moving pin 727 is moved up and down as the cylindrical member 729 rotates.

A rib 734 protruding in the rightward direction is provided in a front portion of the right end surface of the cartridge holder 700. The sensor 721 for detecting the rib 734 is provided on the side frame 19A. The sensor 721 is an optical sensor of a light-reflecting type or a light-transmitting type whose output signal is turned ON or OFF when the rib 734 is at a predetermined position (the position of the rib 734 when the cartridge holder 700 is in the home position).

Other than this, the structure and the operation of the printer 1 are the same as those of Embodiment 11. In the present embodiment, the cartridge holder 700 can be rotated in a similar manner to that of the sliding movement of the cartridge holder 700 of Embodiment 11. Specifically, the cartridge holder 700 can be rotated from the home position to the retracted position or from the retracted position to the home position based on the operation of the cartridge holder switch 17. Alternatively, when the front cover 31 is opened while a jam has occurred, the cartridge holder 700 may be automatically rotated from the home position to the retracted position in an interlocked manner with the front cover 31, or it may be returned to the home position in an interlocked manner with the closing of the front cover 31.

While the cartridge holder 700 is rotated by the motor pinion 733 in the embodiment described above, the cartridge holder 700 may be manually rotated by pushing up the tab 709 of the cartridge holder 700. In such a case, the driving mechanism 790 such as the motor pinion 733 will be unnecessary.

Similar effects to those of Embodiment 11 can be obtained in the present embodiment. In a jam removal operation, the cartridge holder 700 can be inclined with the front side thereof being raised so as to increase the space of the opening 30. Thus, a hand being put into the opening 30 will not be obstructed by the ink cartridges 750, whereby it is possible to perform the jam removal operation easily and quickly.

Variation 1

While the front cover 31 and the top cover 32 are not interlocked with each other in the embodiment described above, the front cover 31 and the top cover 32 may be interlocked with each other. In other words, the cartridge holder 700 may be rotated according to the opening/closing action of the front cover 31. Next, a variation in which the cartridge holder 700 and the front cover 31 are interlocked with each other will be described.

Figure 79:
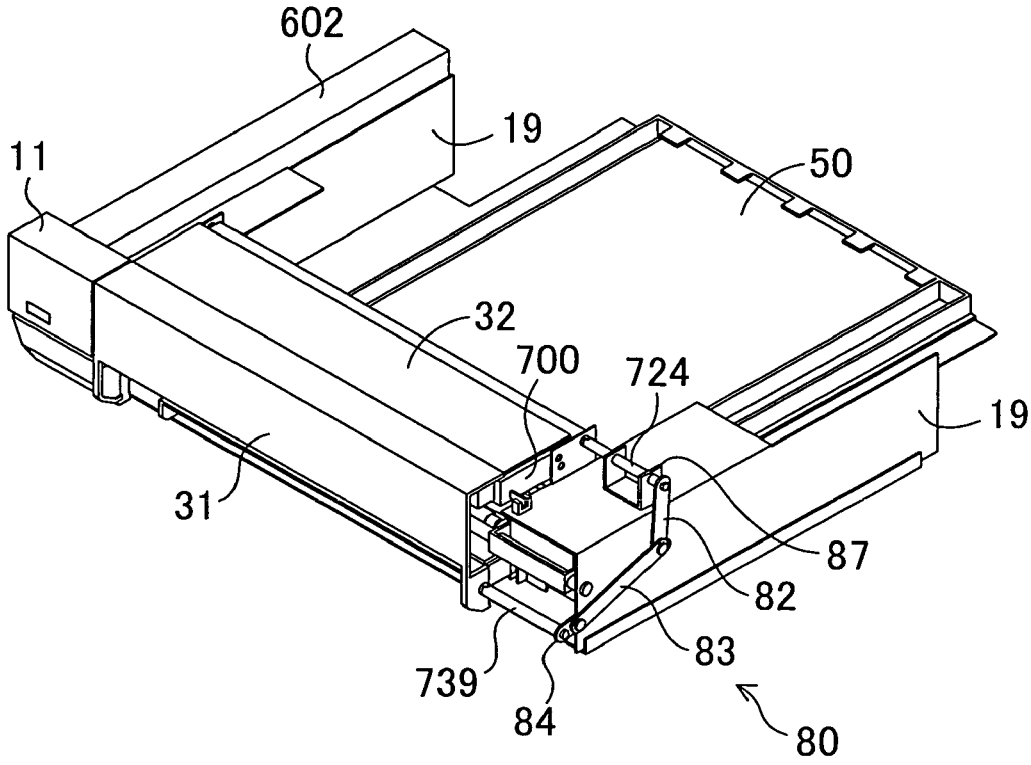
FIG. 79 is a perspective view illustrating the internal structure of a printer according to Variation 1 of Embodiment 12.
Figure 80:
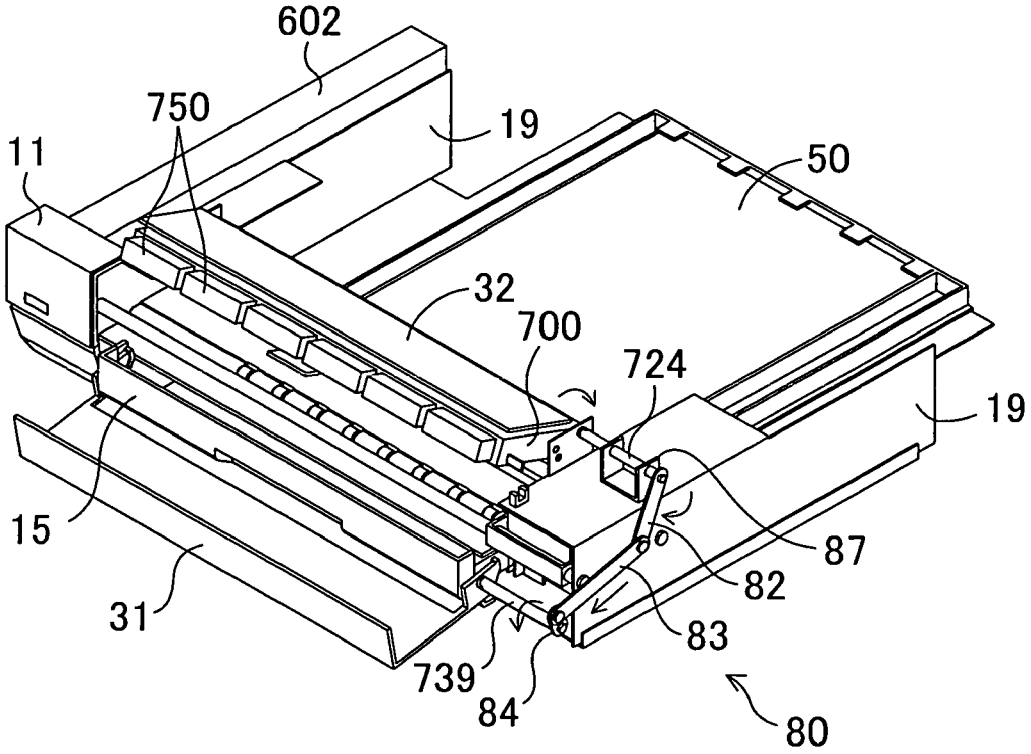
FIG. 80 is a perspective view illustrating the internal structure of the printer.

In this variation, the shaft 724 of the cartridge holder 700 is extended in the rightward direction as illustrated in FIG. 79 and FIG. 80. The shaft 724 is supported by a shaft guide 87, and the tip of the shaft 724 is fixed to a lever 82 so that it cannot be rotated. Therefore, the lever 82 is rotated as the shaft 724 rotates.

The other end of the lever 82 is pin-connected to one end of a lever 83. The other end of the lever 83 is pin-connected to one end of a lever 84. The other end of the lever 84 is fixed, so that it cannot be rotated, to a shaft 739 extending from the right end surface of the front cover 31. Therefore, the lever 84 is rotated as the shaft 739 rotates. Note that, although not shown, the shaft 739 is rotatably supported inside the right-side operation panel 12.

Thus, the cartridge holder 700 and the front cover 31 are connected to each other via an interlock mechanism 80 being a crank mechanism. As indicated by an arrow in FIG. 80, when the front cover 31 is opened, the shaft 739 of the front cover 31 rotates and the rotation action is transmitted to the shaft 724 of the cartridge holder 700 via the levers 82 to 84, thus rotating the shaft 724. As a result, the cartridge holder 700 rotates in the upward direction, rotating the cartridge holder 700 from the home position to the retracted position. Similarly, when the front cover 31 is closed, the rotation action of the shaft 739 is transmitted to the shaft 724 via the levers 82 to 84, and as the shaft 724 rotates, the cartridge holder 700 rotates from the retracted position to the home position.

Note that since the cartridge holder 700 and the top cover 32 are fixed to each other so that they rotate together, the top cover 32 is also opened/closed in an interlocked manner with the front cover 31.

Variation 2

While a sufficient space of the opening 30 of the casing 10 is needed in a jam removal operation so that a hand can easily be put in, such a large space is not necessary when replacing the ink cartridges 750. In view of this, a small cover may be provided for the operation of replacing the ink cartridges 750.

Figure 81:
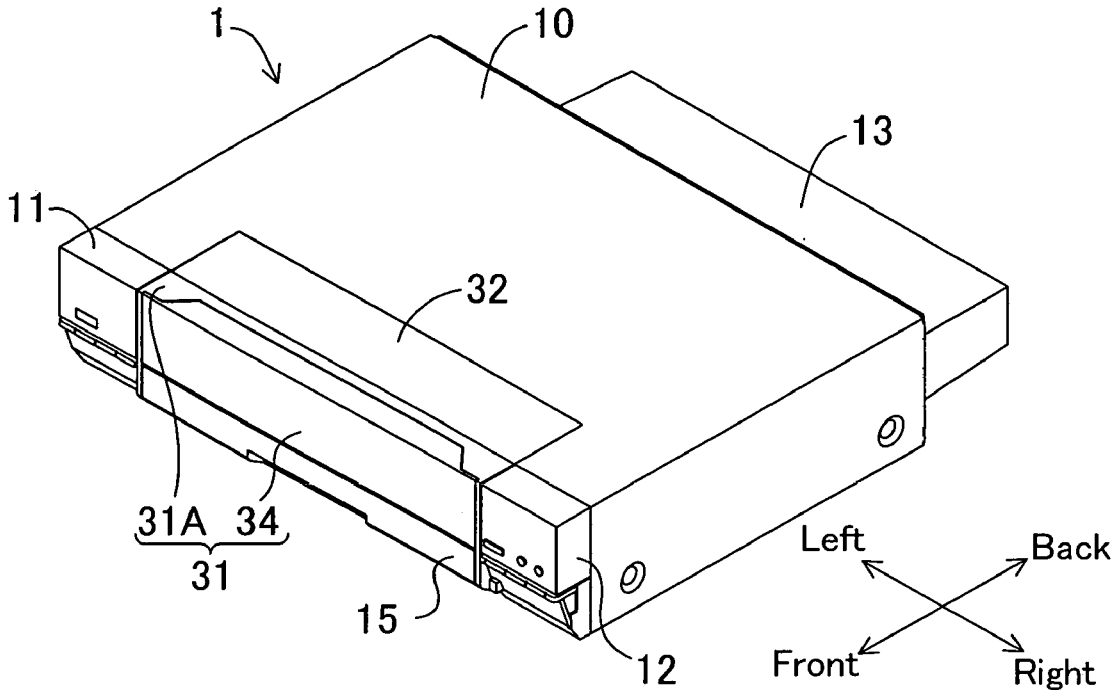
FIG. 81 is a perspective view illustrating the internal structure of a printer according to Variation 2.
Figure 82:
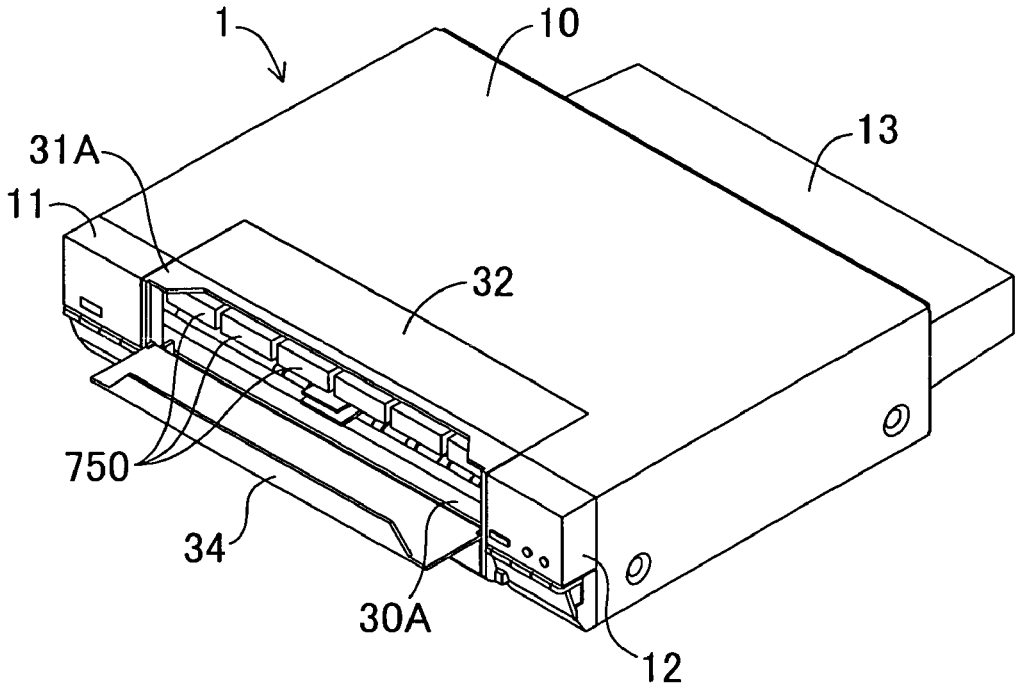
FIG. 82 is a perspective view illustrating the printer with the cover being open.

For example, as illustrated in FIG. 81 and FIG. 82, an opening 30A may be provided in a portion of the front cover 31, and a small cover 34 may be provided within the front cover 31 for covering the opening 30A so that it can be opened/closed. In other words, the front cover 31 may be a double cover including a first cover 31A and the second cover 34. Note that when the first cover 31A is opened, the second cover 34 also opens together with the first cover 31A.

In this variation, only the second cover 34 is opened/closed when replacing the ink cartridges 750. In a jam removal operation, the first cover 31A is opened/closed (with the second cover 34 being opened/closed together with the first cover 31A).

In this variation, the usability of the printer 1 is improved as only the second cover 34 can be opened/closed when replacing the ink cartridges 750.

Note that it is preferred also in this variation to provide the interlock mechanism 80 for interlocking the opening/closing action of the first cover 31A with that of the top cover 32 while not interlocking the opening/closing action the second cover 34 with that of the top cover 32.

Embodiment 13

Figure 84:
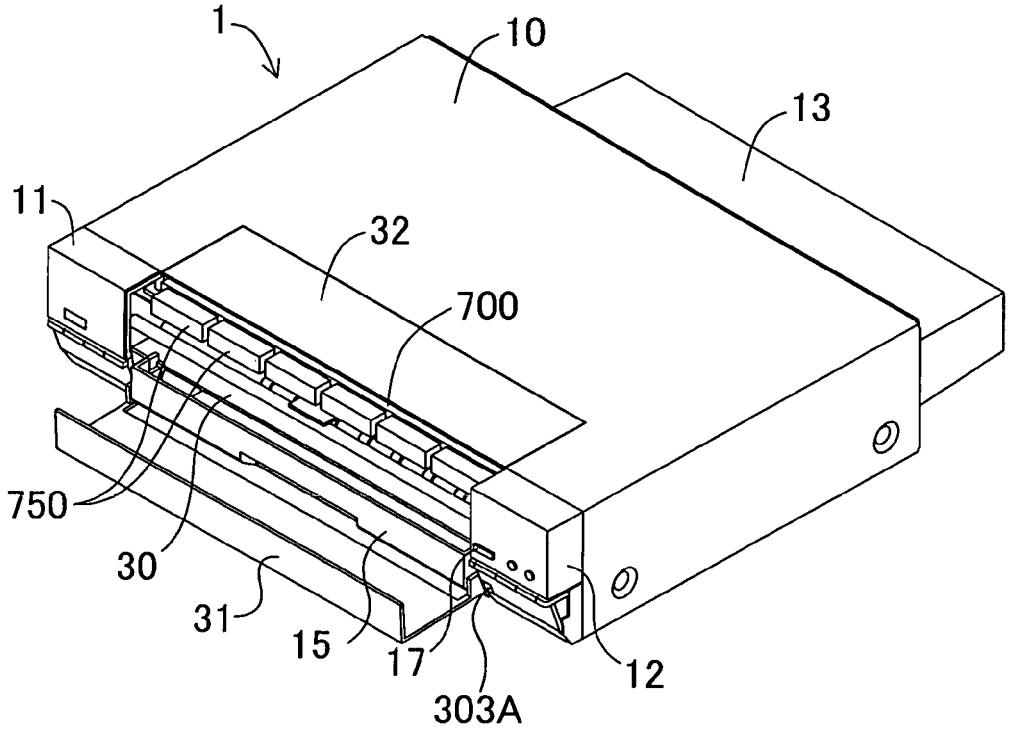
FIG. 84 is a perspective view illustrating the printer with the cover being open and with the cartridge holder being in the home position.
Figure 85:
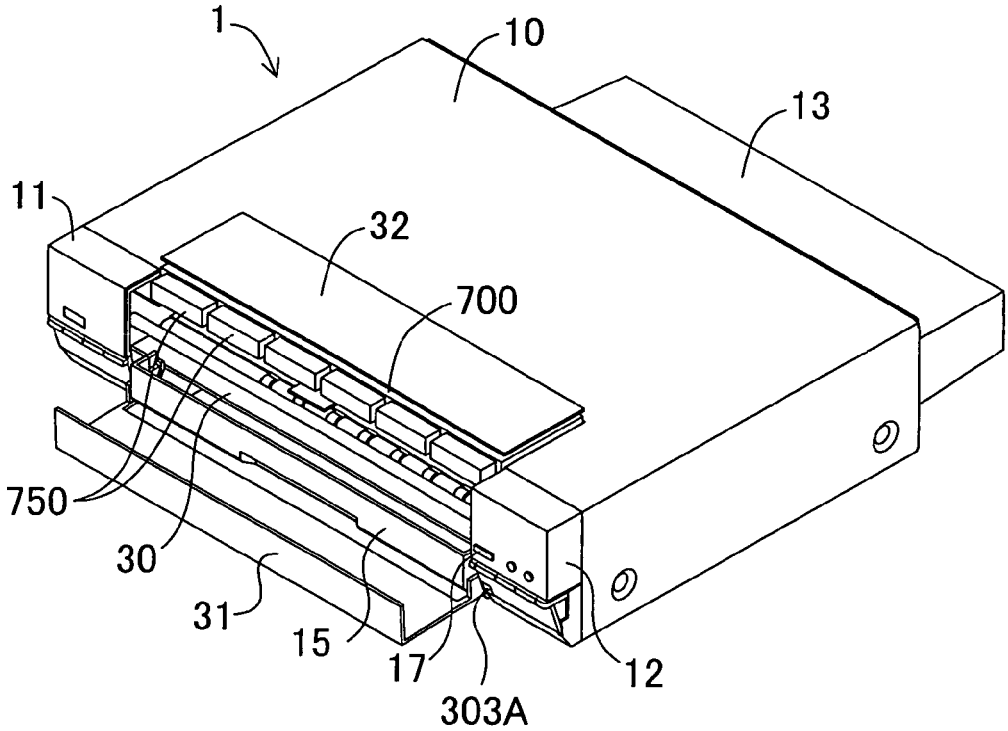
FIG. 85 is a perspective view illustrating the printer with the cover being open and with the cartridge holder being in the retracted position.

As illustrated in FIG. 84 and FIG. 85, in the printer 1 of Embodiment 13, the cartridge holder 700 is slid in the up-down direction to increase the space of the opening 30. In the following description, the lower position of the cartridge holder 700 will be referred to as the home position (see FIG. 84) and the upper position thereof will be referred to as the retracted position (see FIG. 85).

Figure 83:
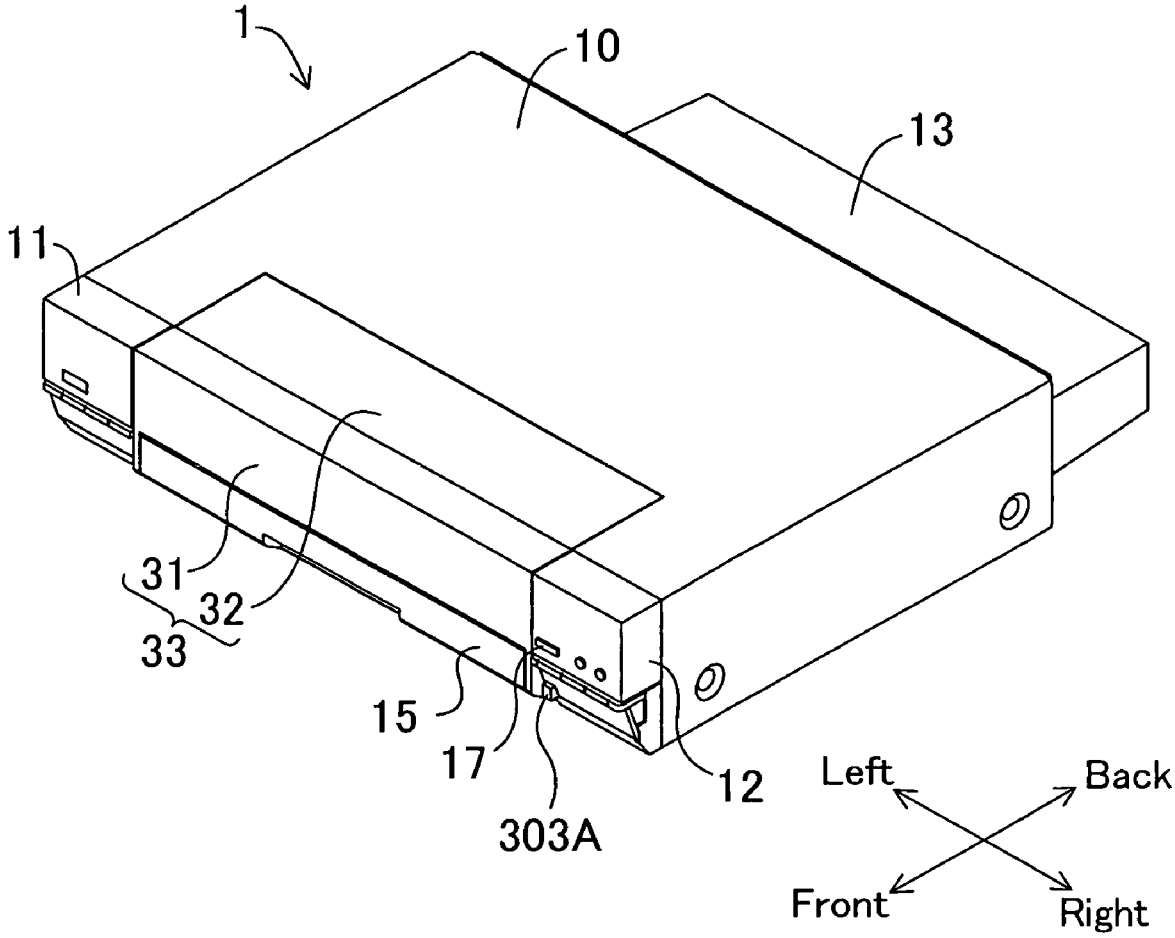
FIG. 83 is a perspective view illustrating a printer of Embodiment 13.

As illustrated in FIG. 83 to FIG. 85, the front cover 31 and the top cover 32 are separate from each other also in Embodiment 13. As in Embodiment 12, the front cover 31 is unfolded in the forward direction. The top cover 32 is integrated together with the cartridge holder 700 so that the integrate member as a whole is moved up and down.

Other than this, the apparent structure thereof is the same as that of Embodiment 11, and will not be further described below. Next, the internal structure of the printer 1 of Embodiment 13 will be described.

Figure 86:
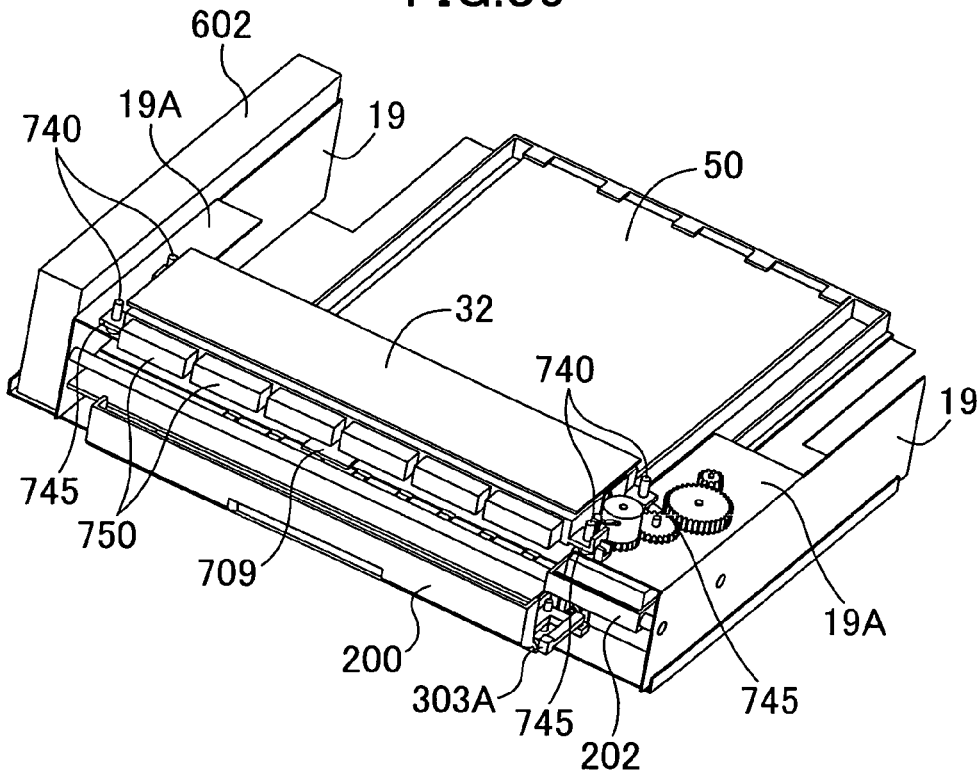
FIG. 86 is a perspective view illustrating the internal structure of the printer with the cartridge holder being in the home position.
Figure 87:
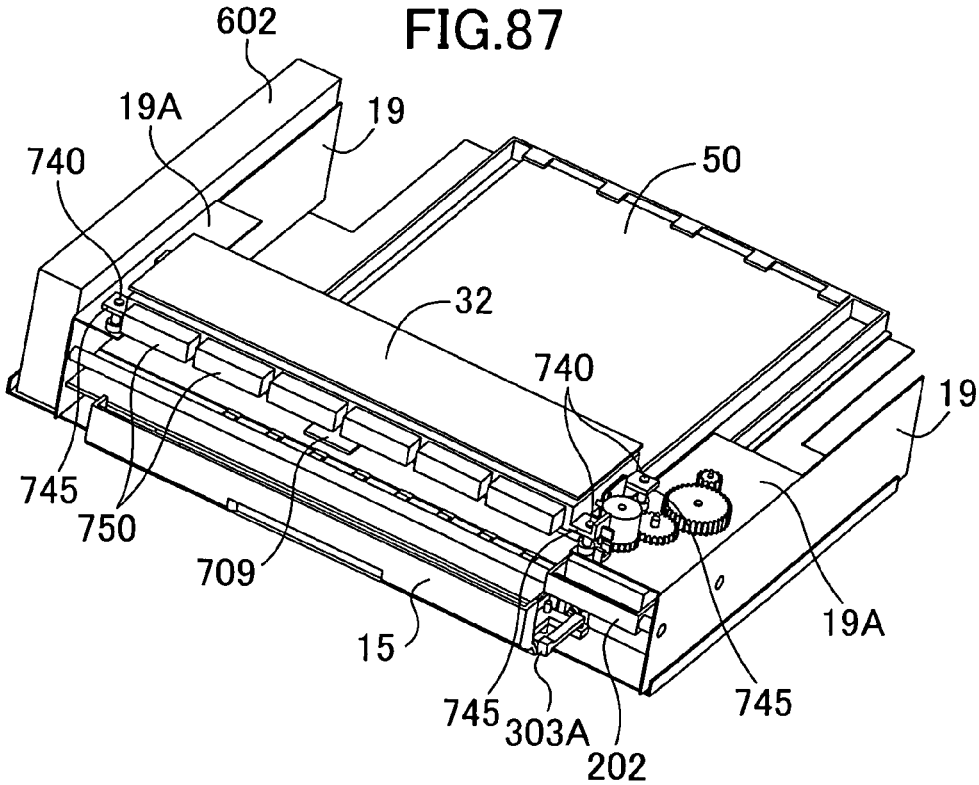
FIG. 87 is a perspective view illustrating the internal structure of the printer with the cartridge holder being in the retracted position.

As illustrated in FIG. 86 and FIG. 87, the cartridge holder 700 of Embodiment 13 has substantially the same structure as that of the holder body 702 of Embodiment 11. The tab 709 protruding in the forward direction is provided under the central portion of the front surface of the cartridge holder 700.

Each of the left side frame 19A and the right side frame 19A is provided with two slide shafts 740 extending in the upward direction and arranged in the front-back direction with respect to each other. Guide plates 745 extending in the outward direction are provided on each of the left and right end surfaces of the cartridge holder 700. The guide plate 745 includes a through hole for allowing the slide shaft 740 to pass therethrough, and the slide shaft 740 is fit in the guide plate 745. Thus, the cartridge holder 700 is guided in the up-down direction by the slide shafts 740.

Figure 88:
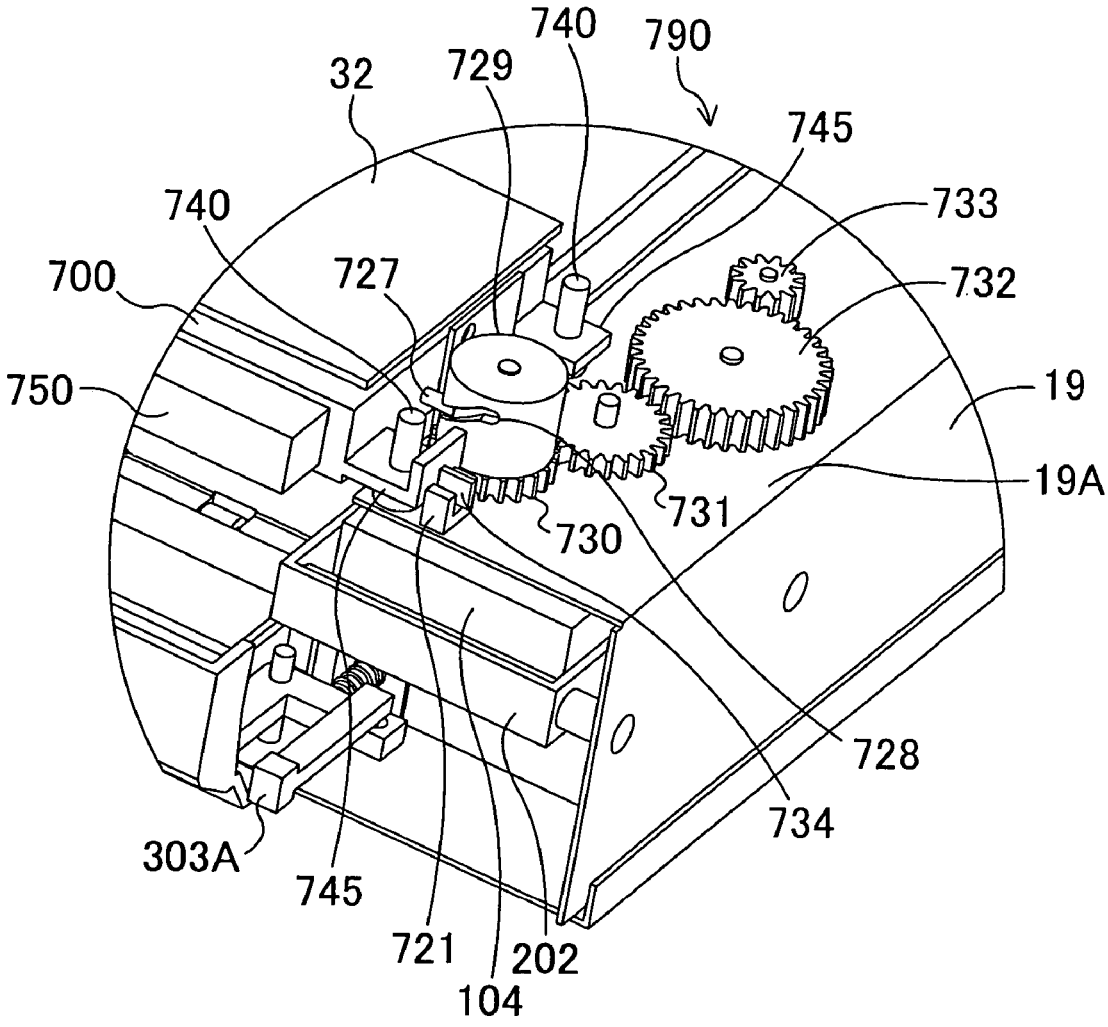
FIG. 88 is an enlarged perspective view illustrating a portion of the cartridge holder of Embodiment 13 near the right end thereof with the cartridge holder being in the home position.
Figure 89:
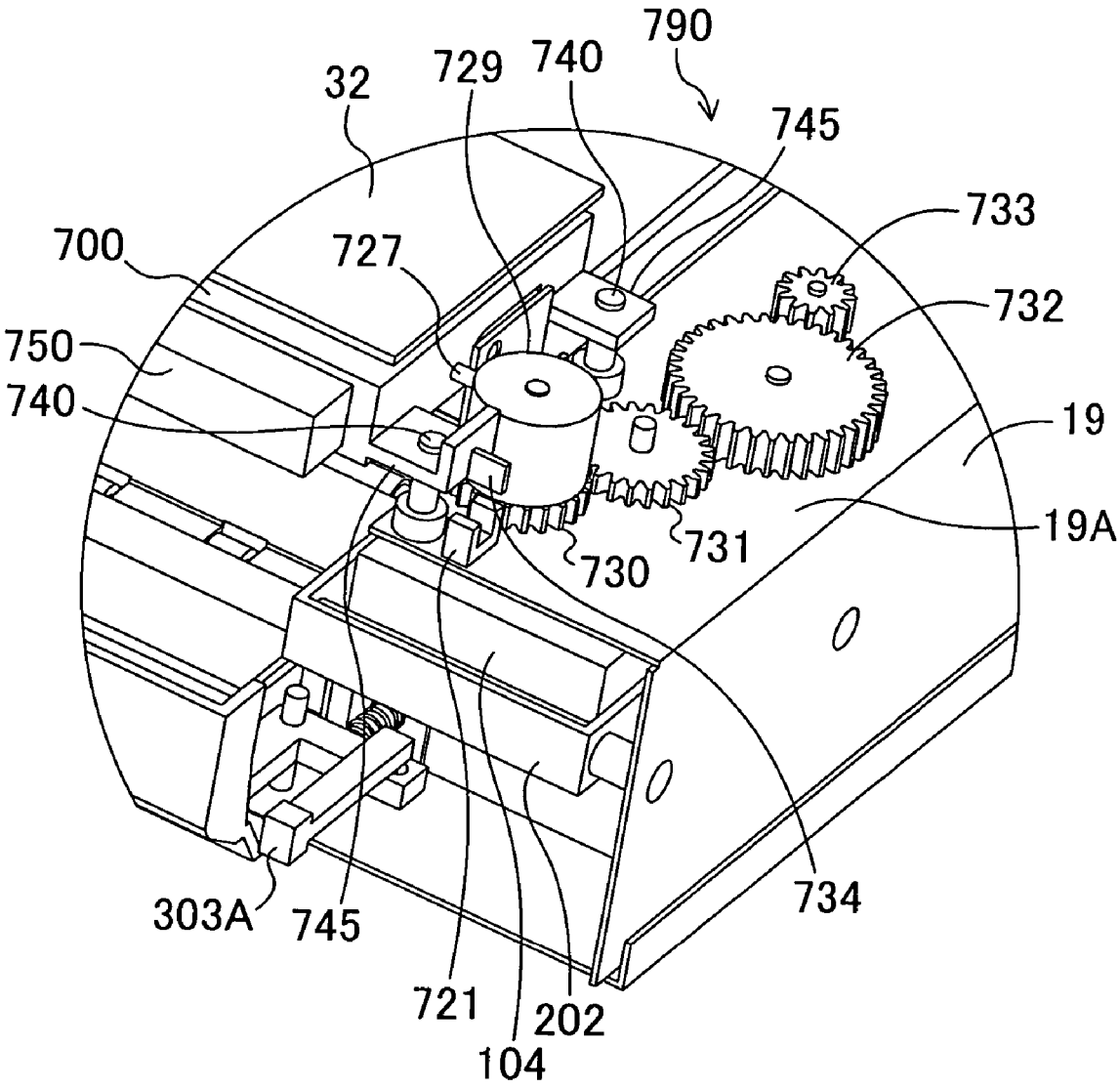
FIG. 89 is an enlarged perspective view illustrating a portion of the cartridge holder near the right end thereof with the cartridge holder being in the retracted position.

As illustrated in FIG. 88 and FIG. 89, the moving pin 727 protruding in the rightward direction is provided on the right end surface of the cartridge holder 700. As in Embodiment 12, the cylindrical member 729, the pinions 730 to 732 and the motor pinion 733 are provided on the side frame 19A. As in Embodiment 12, the groove 728 of the cylindrical member 729 is formed in a spiral pattern so that the moving pin 727 is moved up and down as the cylindrical member 729 rotates.

The rib 734 protruding in the rightward direction is provided on the guide plate 745, which is provided on a right front portion of the cartridge holder 700. As in Embodiment 12, the sensor 721 for detecting the rib 734 is provided on the right side frame 19. The sensor 721 is an optical sensor whose output signal is turned ON or OFF when the rib 734 is at a predetermined position (the position of the rib 734 when the cartridge holder 700 is in the home position).

Other than this, the structure and the operation of the printer 1 are the same as those of Embodiment 11. In the present embodiment, the cartridge holder 700 can be slid in the up-down direction as with the sliding movement in the front-back direction of the cartridge holder 700 of Embodiment 11. Specifically, the cartridge holder 700 can be moved up and down from the home position to the retracted position or from the retracted position to the home position based on the operation of the cartridge holder switch 17. Alternatively, when the front cover 31 is opened while a jam has occurred, the cartridge holder 700 may be automatically moved up from the home position to the retracted position in an interlocked manner with the opening action of the front cover 31, or it may be returned to the home position in an interlocked manner with the closing of the front cover 31. It is understood that the cartridge holder 700 may alternatively be moved up and down manually.

Similar effects to those of Embodiment 11 can be obtained in the present embodiment. In a jam removal operation, the cartridge holder 700 can be moved up to increase the space of the opening 30. Thus, a hand being put into the opening 30 will not be obstructed by the ink cartridges 750, whereby it is possible to perform the jam removal operation easily and quickly.

Embodiment 14

Figure 90:
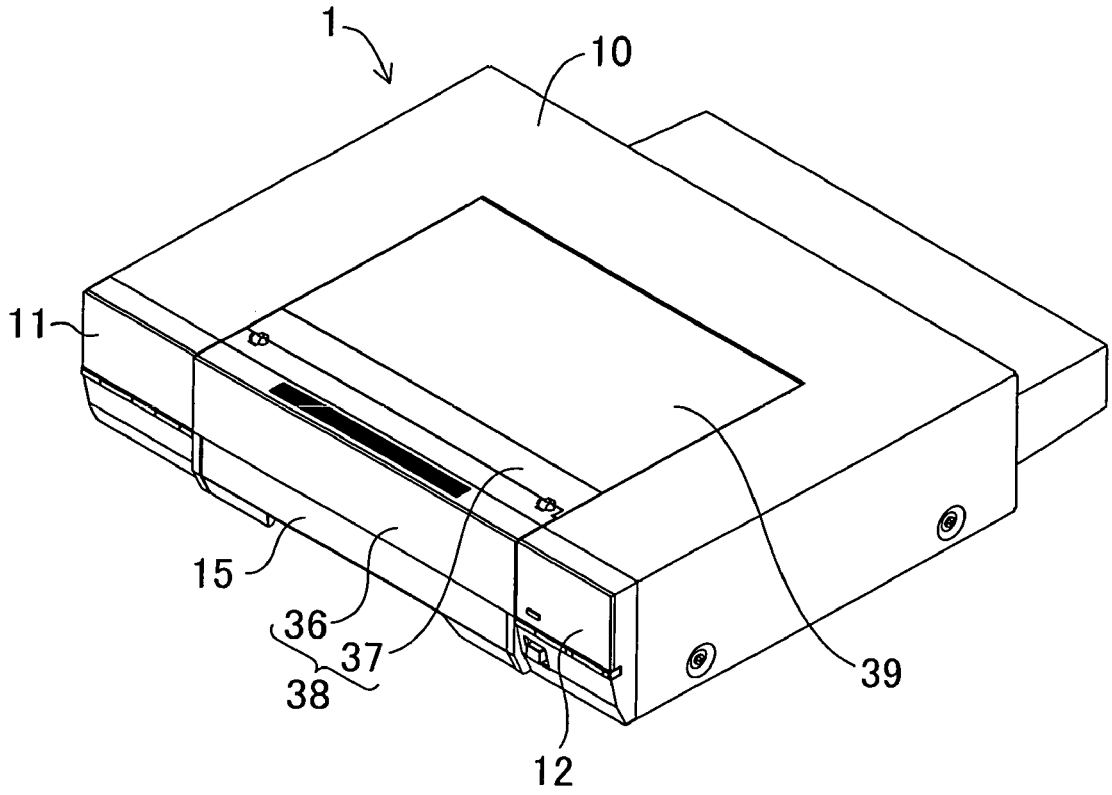
FIG. 90 is a perspective view illustrating a printer of Embodiment 14.
Figure 91:
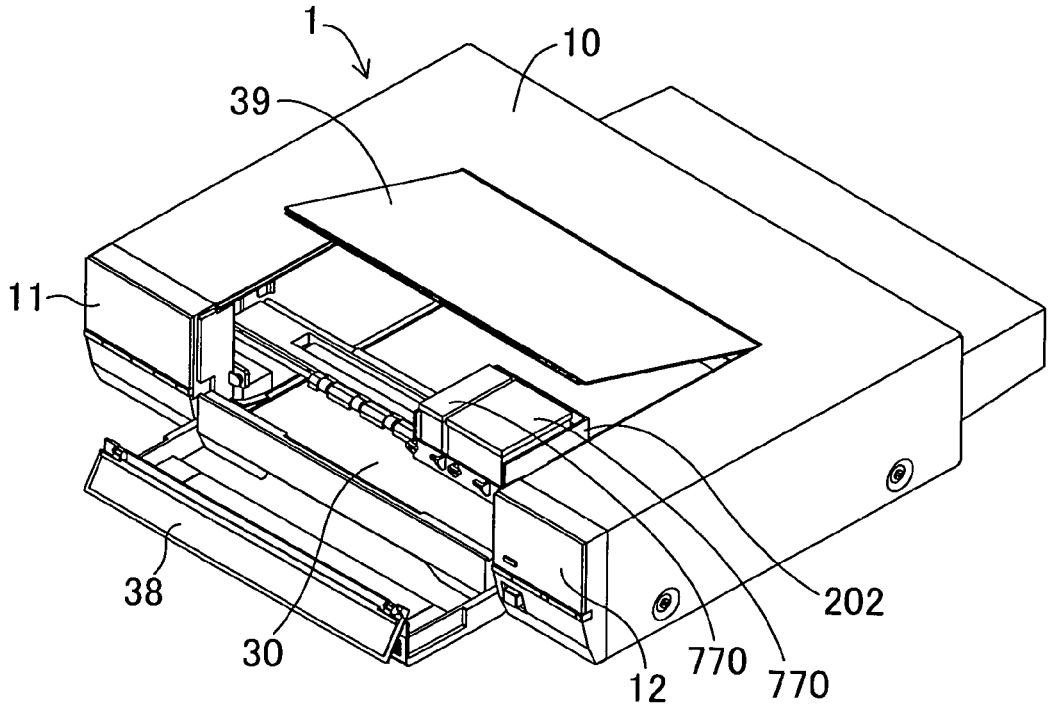
FIG. 91 is a perspective view illustrating the printer with the cover being open.
Figure 92:
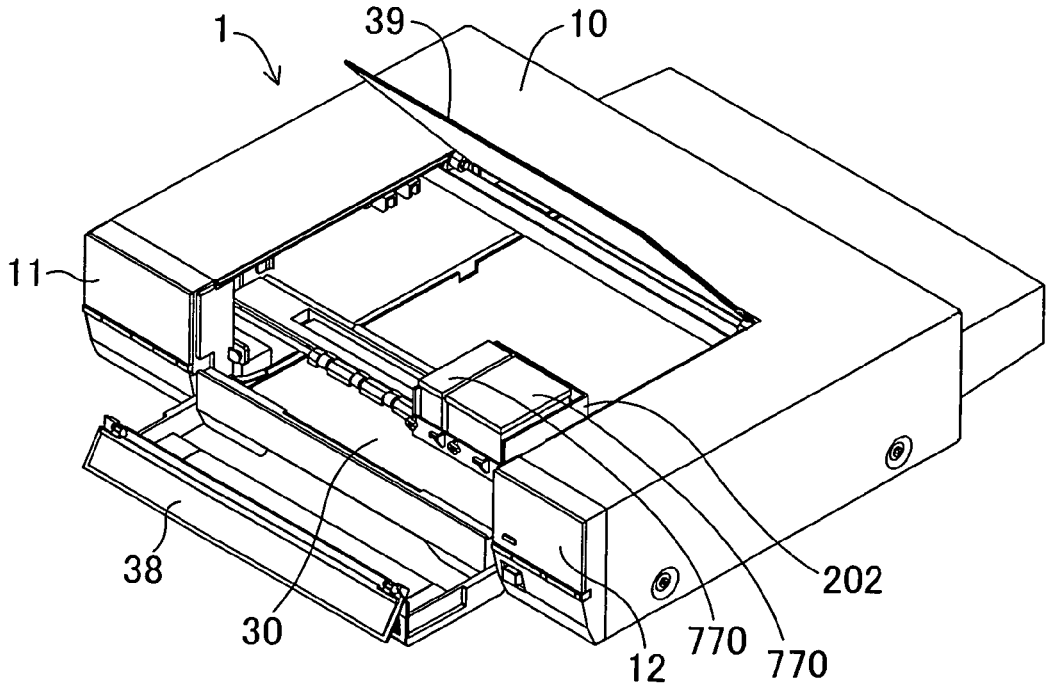
FIG. 92 is a perspective view illustrating the printer with the cover being open.

As illustrated in FIG. 90 to FIG. 92, the printer 1 of Embodiment 14 is a so-called "on-carriage type" printer in which ink cartridges 770 are carried on the carriage, and includes a front cover 38 and a top cover 39 that can be opened in opposite directions in the vertical direction.

The present printer 1 is also a slim printer that can be accommodated in an audio rack, or the like, and includes substantially the same casing 10 as that of Embodiment 11. Note however that in the present embodiment, the opening 30 of the casing 10 is larger than that of Embodiment 11, with the length of the opening 30 in the front-back direction being equal to or greater than ½ the length of the casing 10 in the front-back direction.

The front cover 38 is made up of a first cover 36 and a second cover 37 connected together by a hinge mechanism, and is foldable. The first cover 36 is a plate-like member having an L-shaped cross section, and covers the front side and a portion of the upper side of the opening 30 of the casing 10. An opening for allowing the input paper cassette 15 to pass therethrough is formed in a lower portion of the first cover 36 so that the input paper cassette 15 can be inserted/removed with the first cover 36 being closed.

The top cover 39 is a flat plate-like member and covers a portion of the upper side of the opening 30. The length of the top cover 39 in the vertical direction (the length in the front-back direction) is preferably ⅓ to ⅔ the length of the casing 10 in the front-back direction so as to facilitate the replacement of the ink cartridges 770. In the present embodiment, the length of the top cover 39 in the vertical direction is about ½ the length of the casing 10 in the front-back direction.

The structure of the first cover 36 and the second cover 37 is the same as that of the front cover 31 and the top cover 32 of Embodiment 11 and will not be further described below. Moreover, a folding mechanism similar to that of Embodiment 11 is provided in the present embodiment, whereby when the front cover 38 is opened, the second cover 37 is automatically folded along with the opening action (see FIG. 48 to FIG. 50), as with the front cover 31 and the top cover 32 of Embodiment 11.

Figure 93:
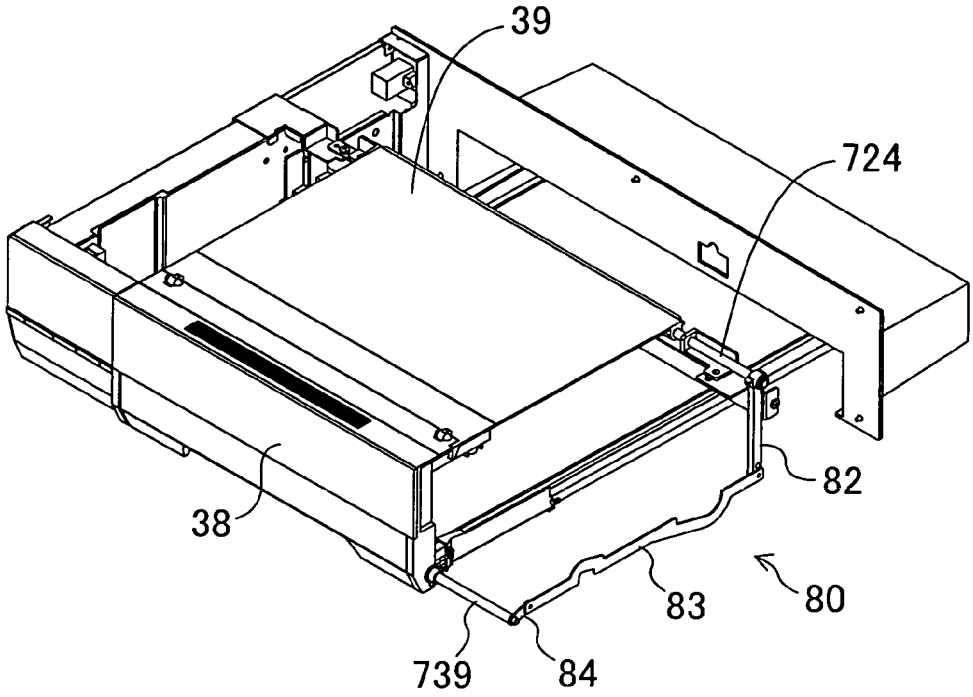
FIG. 93 is a perspective view illustrating a portion of the printer.
Figure 94:
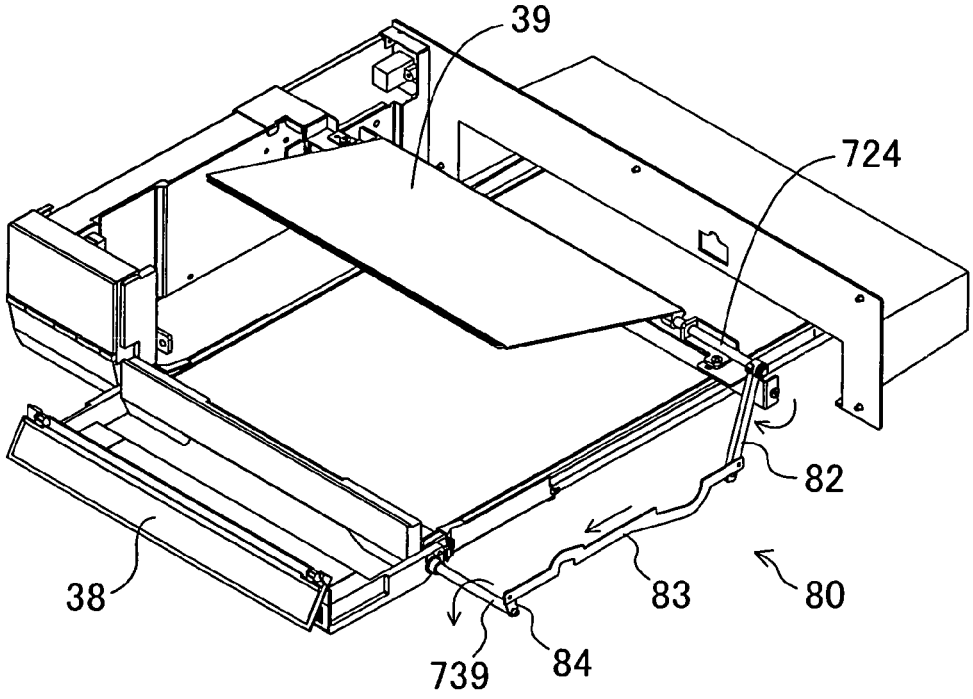
FIG. 94 is a perspective view illustrating a portion of the printer.

As illustrated in FIG. 93 and FIG. 94, the front cover 38 and the top cover 39 are opened/closed in an interlocked manner with each other. The interlock mechanism 80 for interlocking the front cover 38 and the top cover 39 with each other is similar to that of Embodiment 12. Specifically, the rotation shafts 724 and 739 extending in the left-right direction are provided at the rear end of the top cover 39 and the lower end of the front cover 38, respectively, and the lever 82 fixed to the rotation shaft 724 of the top cover 39 and the lever 84 fixed to the rotation shaft 739 of the front cover 38 are pin-connected to the lever 83. The forward rotation moment of the front cover 38 is converted into the upward rotation moment of the top cover 39, and the backward rotation moment of the front cover 38 is converted into the downward rotation moment of the top cover 39. Thus, when one of the front cover 38 and the top cover 39 is opened, the other is also opened, and when one is closed, the other is also closed.

Figure 95:
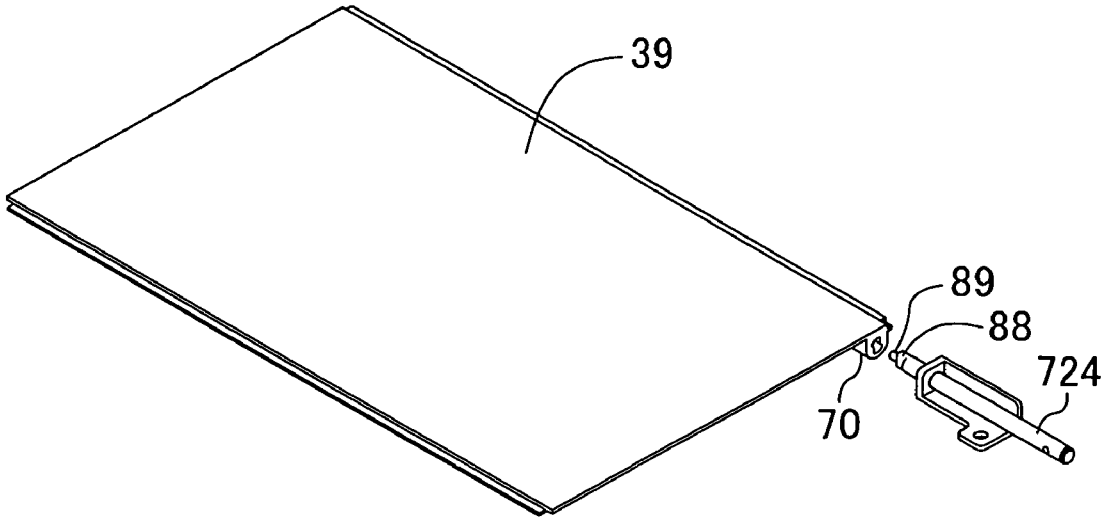
FIG. 95 is a perspective view illustrating an upper cover.
Figure 96:
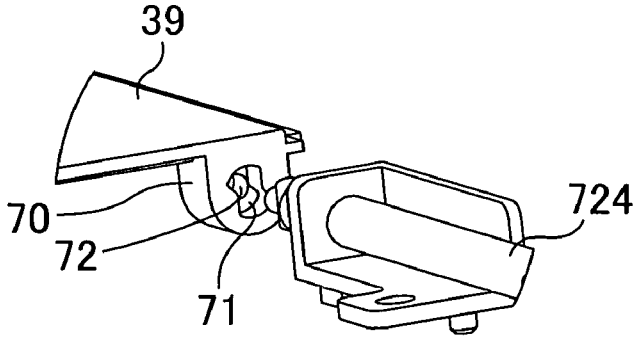
FIG. 96 is a partial cross-sectional view illustrating the upper cover.

As illustrated in FIG. 95 and FIG. 96, a bearing protrusion 70 into which the rotation shaft 724 is inserted is formed at the rear end of the top cover 39. The tip of the rotation shaft 724 includes a cut portion 88 having a generally rectangular cross section with arc-shaped short sides, and a coaxial portion 89 protruding from the tip of the cut portion 88 and having a circular cross section with a diameter smaller than that of the cut portion 88. Thus, the tip of the rotation shaft 724 is tapered in two steps. The bearing protrusion 70 includes a depression deepened in two steps. Specifically, the bearing protrusion 70 includes a depression 71 for supporting the cut portion 88, and a circular groove 72 at the center of the depression 71 for supporting the coaxial portion 89. The coaxial portion 89 rotatably fits in the circular groove 72, whereby the rotation shaft 724 and the bearing protrusion 70 are axially aligned with each other. The shape of the cross section of the depression 71 is such that opposite side portions of a circle opposing each other generally in the left-right direction are bulged toward the center of the circle, whereby the depression 71 restricts the rotation of the cut portion 88 past a certain degree while allowing the rotation thereof to a slight degree.

Figure 97A:
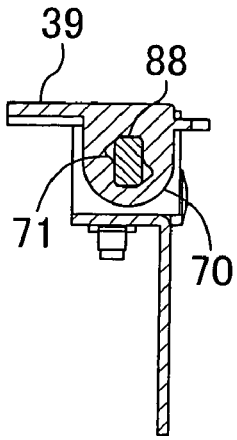
FIG. 97A to FIG. 97C are each an enlarged partial cross-sectional view illustrating the upper cover.
Figure 97B:
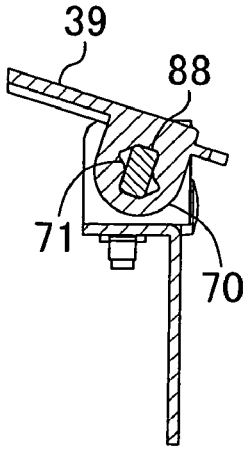
Figure 97C:
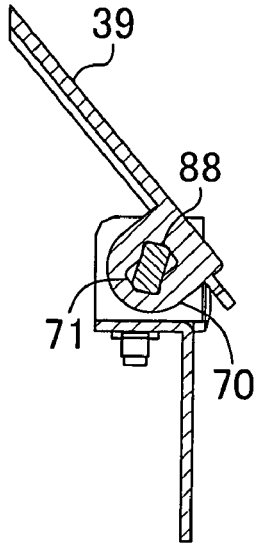

With such a structure, if an upward force is further applied to the top cover 39 after transitioning from the state where the top cover 39 is closed (see FIG. 97A) to the state where it is open (first opening-motion stop position; see FIG. 97B), the top cover 39 is brought to a more open state (second opening-motion stop position) (see FIG. 97C). Thus, it is possible to further increase the space of the opening 30. Therefore, in a case where it is necessary to put a hand deep inside the printer 1, such as when removing a small piece of recording paper 50 or when maintaining the internal units of the printer 1, the top cover 39 can be opened wide to increase the space of the opening 30, thus increasing the efficiency in the operation.

Note that it is preferred that the top cover 39 stays still in the opened state when replacing the ink cartridges 770 or when performing a jam removal operation. Therefore, a holding mechanism may be provided for holding the top cover 39 in the opened state. For example, the top cover 39 may be held in the opened state by means of a frictional force between the rotation shaft 724 and the bearing protrusion 70.

Figure 98:
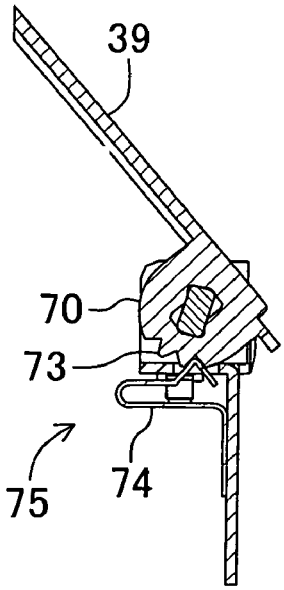

Alternatively, a jagged portion 73 may be provided on the bottom surface of the bearing protrusion 70, with a locking leaf spring 74 having a protruding portion that is engaged with the jagged portion 73, as illustrated in FIG. 98. With the provision of such a holding mechanism 75, the top cover 39 can be held reliably. Moreover, the top cover 39 can be held at a number of degrees of opening thereof.

In the present embodiment, the ink cartridges 770 are carried on the carriage 202, and ink is supplied directly from the ink cartridge 770 to the recording head 101, as illustrated in FIG. 91 and FIG. 92. When replacing the ink cartridges 770, the front cover 38 and the top cover 39 are opened, and the carriage 202 is moved leftward from the right-side home position so as to be exposed through the opening 30. In such a state, the ink cartridges 770 are replaced through the opening 30. Also in a jam removal operation, the front cover 38 and the top cover 39 are opened, and the recording paper 50 is removed through the opening 30.

Other than this, the structure is the same as that of Embodiment 11 and will not be further described below.

The front cover 38 and the top cover 39 that are opened in the opposite directions are provided also in the present embodiment, whereby it is possible to increase the opening 30 of the casing 10. Moreover, the front cover 38 is a foldable cover, whereby it is possible to increase the space in front of the opening 30. Thus, the space of the opening 30 and the space in front of the opening 30 are large, whereby the replacement of the ink cartridges 770 and a jam removal operation can be performed efficiently.

With the provision of the means for holding the top cover 39 in a position where the front side thereof is raised, i.e., the holding means for holding the top cover 39 in the opened state, the top cover 39 can stay still in the opened state, thus facilitating the replacement of the ink cartridges 770 and a jam removal operation. Moreover, the amount by which the top cover 39 is opened can be adjusted according to the space available above.

Variation 1

Figure 99:
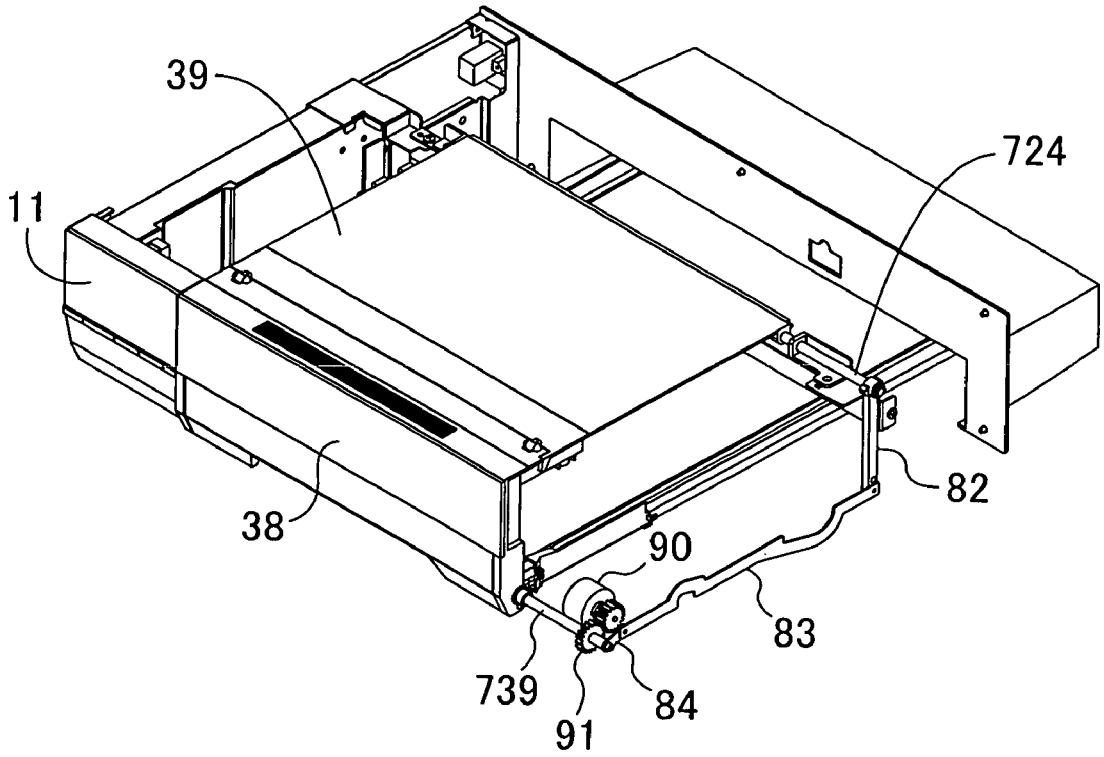

In the embodiment described above, the front cover 38 and the top cover 39 are opened/closed manually. Alternatively, a driving mechanism for driving the front cover 38 and the top cover 39 may be provided so that the front cover 38 and the top cover 39 are opened/closed automatically. For example, a pinion 91 may be provided along the rotation shaft 739 of the front cover 38, with a motor pinion 90 meshed with the pinion 91, as illustrated in FIG. 99. The motor pinion 90 may be operated from the printer 1 or from another unit (e.g., a personal computer) connected to the printer 1. For example, a switch for operating the motor pinion 90 (i.e., a switch for opening/closing the cover) may be provided on the left-side operation panel 11 or the right-side operation panel 12.

Variation 2

Figure 100:
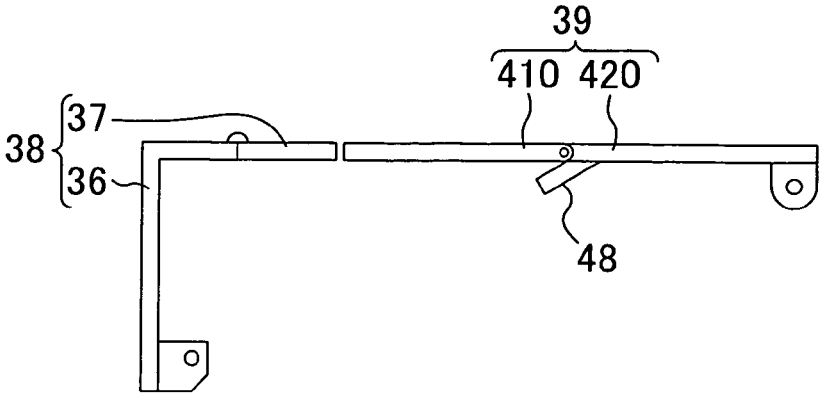

In the embodiment described above, the front cover 38 is a foldable cover while the top cover 39 is a flat plate cover. However, it is understood that the top cover 39 may be a foldable cover. For example, the top cover 39 may include a front cover 46 and a rear cover 47 arranged in the front-back direction with respect to each other, and the top cover 39 may be bent so that the front cover 46 is rotated in the downward direction when opening the top cover 39, as illustrated in FIG. 100. Specifically, the top cover 39 may include the rear cover 47 that can be rotated so that the front side thereof is raised, and the front cover 46 connected to the front end of the rear cover 47 so that it can be rotated in the vertical direction. Note that it is preferred that a rib 48 for supporting the front cover 46 being in the opened state is provided on the reverse side of the rear cover 47.

Figure 101:
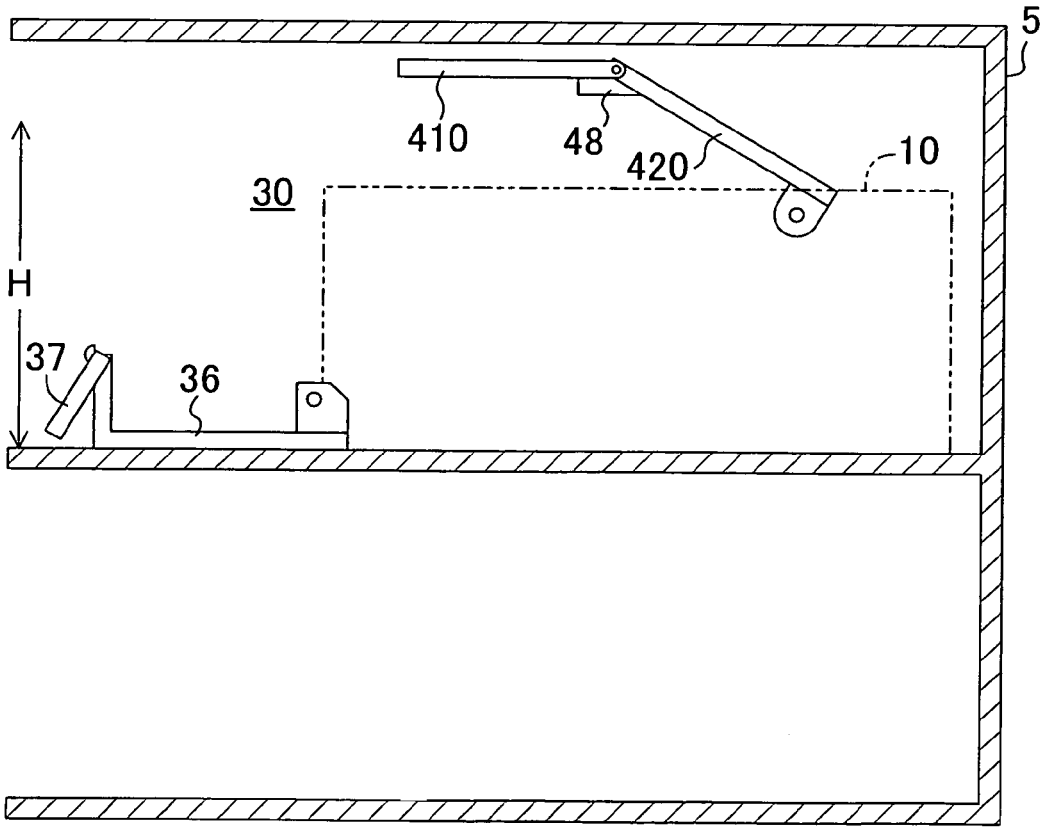

When the top cover 39 is foldable as described above, it is possible to obtain an even larger space around the opening 30 as illustrated in FIG. 101. Moreover, by providing the rib 48 as holding means for holding the front cover 46 being opened in a horizontal position, it is possible to reduce the amount by which the top cover 39 protrudes in the upward direction when the top cover 39 is opened. Therefore, the top cover 39 can be opened even when the vertical size H of the shelf spacing of the rack 5 is small.

Alternative Embodiments

It is understood that the present invention is not limited to the embodiments set forth above, but other embodiments are possible. Moreover, the embodiments set forth above may be combined with one another.

What is claimed is:

1. An image recording device, comprising:

a printer assembly including an image former configured to form an image on recording paper accommodated in an input paper tray;

an output paper receiver attached to the printer assembly so that the output paper receiver can be moved between an extended state and a housed state; and an output paper receiver state detector configured to detect an extended/housed state of the output paper receiver, wherein the image former does not perform a print operation to form an image on recording paper when the output paper receiver state detector detects that the output paper receiver is in the housed state.

2. The image recording device of claim 1, wherein the image former performs the print operation when the output paper receiver state detector detects that the output paper receiver is in the extended state.

3. The image recording device of claim 1, wherein the image former performs the print operation when the output paper receiver state detector detects that a length of the output paper receiver is sufficient with respect to a length of recording paper specified in a print instruction.

4. The image recording device of claim 1, wherein the image former performs the print operation when the output paper receiver state detector detects that a length of the output paper receiver is greater than a length of recording paper specified in a print instruction.

5. The image recording device according to claim 1, further comprising a printer driver configured to move the output tray receiver between the housed and extended states.

6. An image recording device, comprising:

a printer assembly including an image former configured to form an image on recording paper accommodated in an input paper tray;

an output paper receiver integrally provided on a front side of the input paper tray so that the output paper receiver can be moved between an extended state and a housed state; and an output paper receiver state detector configured to detect an extended/housed state of the output paper receiver, wherein the image former does not perform a print operation to form an image on recording paper when the output paper receiver state detector detects that the output paper receiver is in the housed state.

7. The image recording device according to claim 6, wherein the image former performs the print operation when the output paper receiver state detector detects that the output paper receiver is in the extended state.

8. The image recording device according to claim 6, wherein the image former performs the print operation when the output paper receiver state detector detects that a length of the output paper receiver is sufficient with respect to a length of recording paper specified in a print instruction.

9. The image recording device according to claim 6, wherein the image former performs the print operation when the output paper receiver state detector detects that a length of the output paper receiver is greater than a length of recording paper specified in a print instruction.

10. The image recording device according to claim 6, further comprising a driver configured to move the output paper receiver between the housed and extended states.

* * * * *